US006651011B1

(12) United States Patent
Bache

(10) Patent No.: US 6,651,011 B1
(45) Date of Patent: Nov. 18, 2003

(54) COMPOSITE STRUCTURES WITH FRACTURE-TOUGH MATRIX AND METHODS FOR DESIGNING AND PRODUCING THE STRUCTURES

(75) Inventor: Hans Henrik Bache, Hjallerup (DK)

(73) Assignee: Giantcode A/S, Hjallerup (DK)

( * ) Notice: Subject to any disclaimer, the term of this patent is extended or adjusted under 35 U.S.C. 154(b) by 454 days.

(21) Appl. No.: 10/009,820

(22) PCT Filed: Jun. 16, 2000

(86) PCT No.: PCT/IB00/01573

§ 371 (c)(1),
(2), (4) Date: Apr. 26, 2002

(87) PCT Pub. No.: WO01/12915

PCT Pub. Date: Feb. 22, 2001

(30) Foreign Application Priority Data

| | | |
|---|---|---|
| Jun. 16, 1999 | (DK) | 1999 01733 |
| Jun. 16, 1999 | (DK) | 1999 00853 |
| Aug. 16, 1999 | (DK) | 1999 01129 |
| Apr. 26, 2000 | (DK) | 2000 00675 |

(51) Int. Cl.[7] ..... G01B 3/00; G01B 5/00; G06F 19/00

(52) U.S. Cl. ..... 702/33

(58) Field of Search ..... 702/33; 428/113, 428/357, 222; 156/71; 404/134; 52/648.1

(56) References Cited

U.S. PATENT DOCUMENTS

| | | | | |
|---|---|---|---|---|
| 4,470,238 A | * | 9/1984 | Maistre | 52/648.1 |
| 4,686,134 A | * | 8/1987 | Ono | 428/222 |
| 4,777,069 A | * | 10/1988 | Cederberg et al. | 428/113 |
| 4,966,801 A | * | 10/1990 | Becker et al. | 428/113 |
| 5,814,403 A | * | 9/1998 | Anderson et al. | 428/357 |
| 5,836,715 A | * | 11/1998 | Hendrix et al. | 404/134 |
| 6,454,889 B1 | * | 9/2002 | Hendrix et al. | 156/71 |

FOREIGN PATENT DOCUMENTS

| | | |
|---|---|---|
| WO | WO 87/07597 | 12/1987 |
| WO | WO 98/30769 | 7/1998 |

* cited by examiner

*Primary Examiner*—John Barlow
*Assistant Examiner*—Aditya Bhat
(74) *Attorney, Agent, or Firm*—Banner & Witcoff, Ltd.

(57) ABSTRACT

Shaped composite structures which are strong, stiff and hard and, at the same time, have high toughness, comprise a matrix, for example a cement or ceramics based matrix, and embedded therein a plurality of plate shaped or at least 60 mm thick elongated reinforcement components, the reinforcement components having an at least 1.5 times higher tensile strength than the matrix, the minimum volume per cent concentration of the reinforcement components being related in the manner described in the specification to their tensile strength, and (in the case of elongated reinforcement components) also their thickness and to the compressive strength and modulus of elasticity and modulus of elasticity of the matrix. Methods for modelling and designing such structures are also disclosed, as are methods for establishing the structure from smaller matrix building blocks which may be pre-fabricated and which are arranged around prearranged reinforcement bodies and then fixed to each other and to the reinforcement.

97 Claims, 38 Drawing Sheets

| Depth | A | B | C |
|---|---|---|---|
| H | 50mm | 500mm | 5000mm |
| $d_1$ | 10mm | 100mm | 1000mm |
| $d_2$ | 0.2mm | 2mm | 20mm |
| $d_3$ | | 0.2mm | 2mm |
| $d_y$ | | | 0.2mm |
| $B_1$ | 4mm | 40mm | 400mm |
| $B_2$ | | 4mm | |
| $B_3$ | | | |
| "Bending" strength | 200 MPc | 200 MPc | 200 MPc |
| Matrix Fracture Energy | 10kN/m | 100kN/m | 1000kN/m |

COMPOSITE STRUCTURES WITH FRACTURE-TOUGH MATRIX AND METHODS FOR DESIGNING AND PRODUCING THE STRUCTURES

This is a U.S. National Phase Application Under 35 USC 371 and applicant herewith claims the benefit of priority of PCT/IB00/01573 filed Jun. 16, 2000, which was published Under PCT Article 21(2) in English and Application Nos. PA 1999 00853 filed in Denmark on Jun. 16, 1999; PA 1999 00853 filed in Denmark on Jun. 16, 1999; PA 1999 01129 filed on Aug. 16, 1999; and PA 2000 00675 filed on Apr. 26, 2000.

PART A

The present specification consists of three parts, part A (the present part), part B, and part C. Parts B and C which follow describe methods useful for designing and producing the shaped articles according to the present invention, which methods supplement the methods described in the present part, as well as a number of embodiments of the shaped articles according to the present aspect of the invention, and the description and claims relating thereto form part of the disclosure of the present invention.

Figure 1:
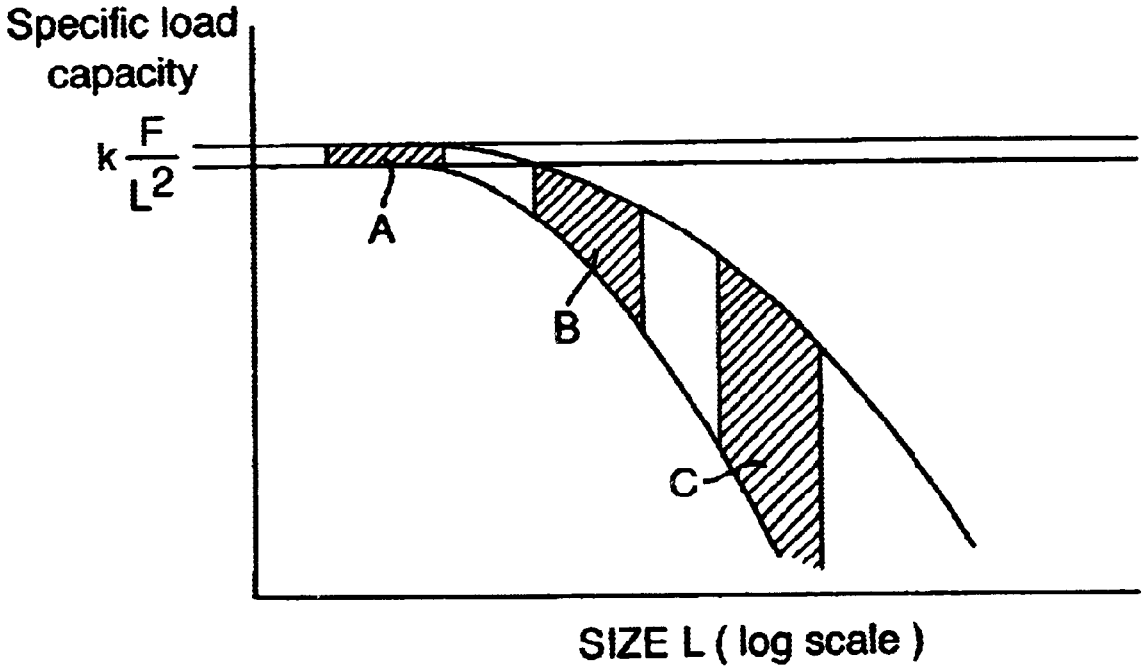
FIG. 1 illustrates the problem solved by the invention.
Figure 2A:
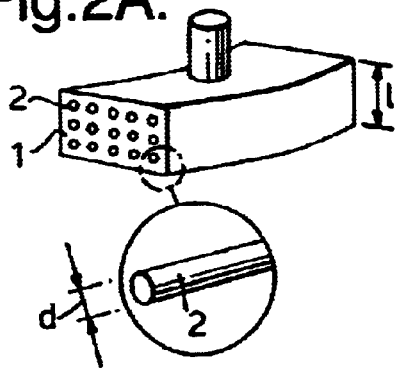
FIG. 2 illustrates a small body under load in a state of fracture.
FIG. 2B illustrates a large body under load in a state of fracture.
FIG. 2C illustrates a first step making a large body under load in a state of fracture act like a small body.
FIG. 2D illustrates the diameter of the reinforcement in FIG. 2C.
FIG. 2E shows typical behavior of body in FIG. 2C.
FIG. 2F shows a local domain of FIG. 2A.
FIG. 2G and 2H show the final solution according to the invention.
Figure 2B:
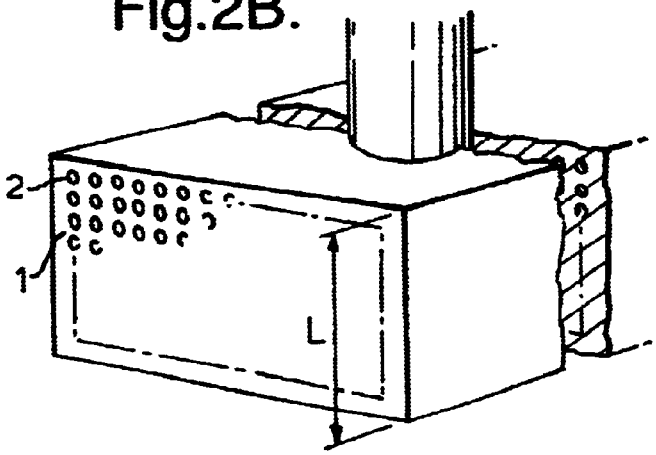
Figure 2C:
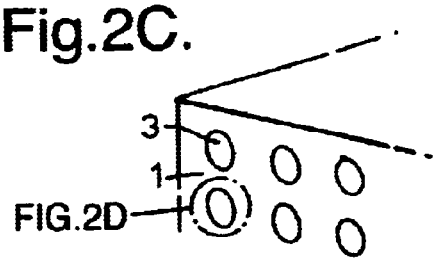
Figure 2D:
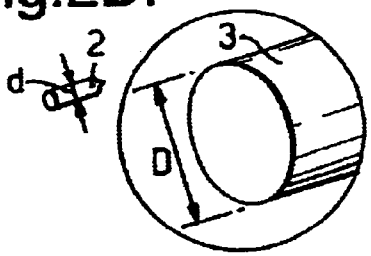
Figure 2E:
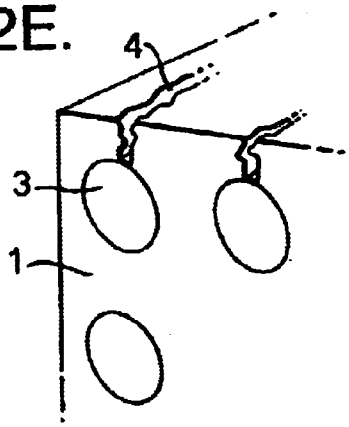
Figure 2F:
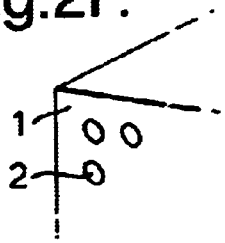
Figure 2G:
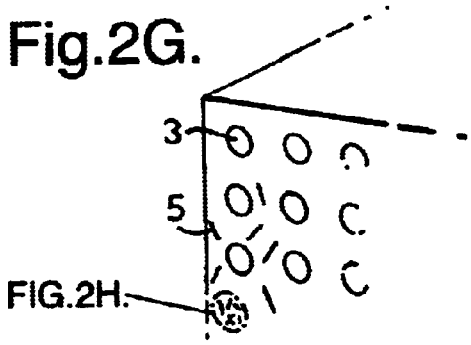
Figure 2H:
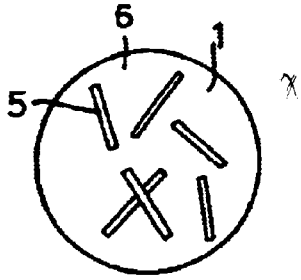

The present aspect of the invention relates to novel types of shaped articles at least domains of which have novel high performance composite structures combining high strength, high stiffness and high hardness with extremely large toughness, and/or containing very large reinforcement components, as well as to methods for their design and production. The novel composite structures make it possible to create novel large or very large bodies or structures which are capable of resisting very large severe mechanical loading while suffering only minor damage.

An aspect of the invention relates to the design of the novel large structures, their production and principles for their design, that is, materials, composite structures, bodies and engineering structures.

With the composite structures according to the present invention it is possible create combinations which have been highly desired, but which have, until now, been considered almost impossible.

Very hard/strong materials, such as glass or strong ceramics, are by nature extremely brittle. Their high strength on an atomic level, large interatomic binding forces, can be reasonably utilized only in very small or microsize objects such as fine fibers.

However, large ductility for strong materials seems possible only with materials which are able to be deformed plastically, by continuously breaking and re-establishing bonds between neighbor atoms. This mechanism seems to be reserved exclusively to metals, with atom nuclei kept together by common electron clouds.

While strong non-metal materials (cerams, glass, diamond) with atomic structure fixed by strong directional covalent or ionic bonds do not have the same yield potential—typically resulting in substantially elastic behavior under load right up to fracture, substantially without plastic flow/creep.

However, a major breakthrough in the art was constituted by the so-called CRC structures disclosed, e.g., in U.S. Pat. No. 4,979,992. In that patent, a new type of composite structures is described which is a compact reinforced composite comprising a matrix (A) with a reinforcement (B) embedded therein, the matrix (A) being a composite structure comprising a base matrix (C) which is reinforced with reinforcing bodies (D) in the form of fibers, the transverse dimension of (B) being at least 5 times as large as the transverse dimension of (D).

As an introduction to the present invention it will now be illustrated, through a number of examples,

- limitations of known art structural engineering materials, bodies, structures, design, etc.,
- how these limitations can be overcome in accordance with the principles of the present invention, and
- how further novel creations can be obtained using the principles of the invention.

EXAMPLE: LARGE, HARD, STRONG, TOUGH STRUCTURES

Problem

Under failure/fracture, large structures/bodies behave differently from similar small structures of identical hard strong material, typically showing far smaller specific load-bearing capacity/strength often a very different behavior at failure, typically much more brittle and with far larger variations in load-bearing capacity.

The problem is illustrated in FIG. 1

Solution

The problem with the altered failure/fracture behavior at increased body size/structure size is associated with the local behavior in the local fracture zone(s) which occur after collapse begins.

For bodies of the same material, the effect of what happens after collapse begins has a smaller and smaller importance the larger the bodies are. This is normally not recognized and is normally not taken into consideration in conventional design.

The solution of the problem, according to the principles of the present invention, is to modify/redesign the composite structures for the large bodies so that the behavior in the local fracture zone(s) becomes so much different and so much better that the relative importance of the contribution becomes the same with the large bodies as it was with the small well-functioning bodies.

Thereby, it is ensured that the large bodies under failure/fracture will behave similarly to the small bodies, showing substantially identical specific load-bearing capability.

An example of one out of many solutions concepts is shown in FIG. 2.

FIG. 2

A illustrates a small body under load in a state of fracture

B shows a geometrically similarly shaped large body, also in a state of fracture.

The materials are the same in the two bodies: composite mateiral with matrix material 1 reinforced with continuous reinforcement 2 with a circular cross-section, diameter d, shown in enlargement.

In accordance with the principles shown in FIG. 1, the large body fractures differently from the small body, in a more brittle manner with considerably lower specific load-bearing capacity.

C illustrates a "first step" towards creating a large body which, under fracture, behaves similarly with the small tough body A, that is, with the same large specific load-bearing capacity. In C, there is a) the same matrix material as in A b) the same reinforcement material as in A c) reinforcement which is geometrically similar to the reinforcement in A, that is, far larger reinforcement 3 with diameter $$D = d\frac{L}{l}$$

E shows typical behavior of body C, in a solution based only on increasing the dimensions of the reinforcement without at the same time performing other changes. Local failure occurs in the matrix material 1 around the reinforcement 3, illustrated by cracks 4. The reason for the failure is the far larger local brittleness in the large body E than in the corresponding local domain in the small body A (shown as F), as a result of the so-called size effect, in complete analogy with the behavior shown in FIG. 1.

H illustrates the final solution according to the invention, with large reinforcement rods 3, diameter $$D = d\frac{L}{l}$$

and at the same time modification of the matrix material, in this case with fibers 5, conferring, to the matrix material, increased fracture toughness, with fracture energy, $G_L$, larger by a factor U/l than for the matrix material 1

$$G_L = G_l\frac{L}{l}$$

where $G_l$ is the fracture energy in the matrix material 1. The fiber-toughened matrix is shown enlarged at 6.

Thereby, it has been made possible—as desired—to create large composite bodies—size L—with similar ductile behavior under fracture/failure as the small size bodies l—and with the same high specific load-carrying capacity.

The example shows one solution of the problem: to create a large body showing similarity with the small tough body A (FIG. 3) with respect to failure/fracture, based on substantially identical base matrix 1 and identical reinforcement material and amount of reinforcement per volume Using the principles of the invention, however, there are possibilities of creating new bodies/structures having obvious elements of similarity with the item and structures A, but performing much better.

This will be explained in greater detail in the following; one example is given here: Based on the design principles of the present invention, it is possible to design/create large bodies, size L, showing a fracture/failure behavior which is substantially similar to the behavior of the large, tough bodies H, but with considerably larger specific load-carrying capacity.

Thus, e.g., with 5–10 times stronger materials—stronger matrix materials, stronger reinforcement—there is the potential to create bodies with twice the specific load-carrying capacity.

This is not done by merely doubling the strengths. That would result in increased brittleness (to be discussed in greater depth in the following). By increasing, at the same time, the fracture energy of the matrix, using, e.g, particles or additional fibers, it is possible to compensate for the increased brittleness. In the present example, where the strengths are doubled, it will be necessary to increase the fracture energy by approximately a factor of four.

Very Large Structures

According to the principles of the present invention, that is, using the principles illustrated in FIG. 2 to scale from the small fracture-tough body A to the large body H, it is possible to create new very large bodies/structures showing the same high specific load-carrying capacity as the small body A, that is, without the drastic decrease in load capacity which would normally be observed when going from a small body to a large body of the same material.

Figure 3:
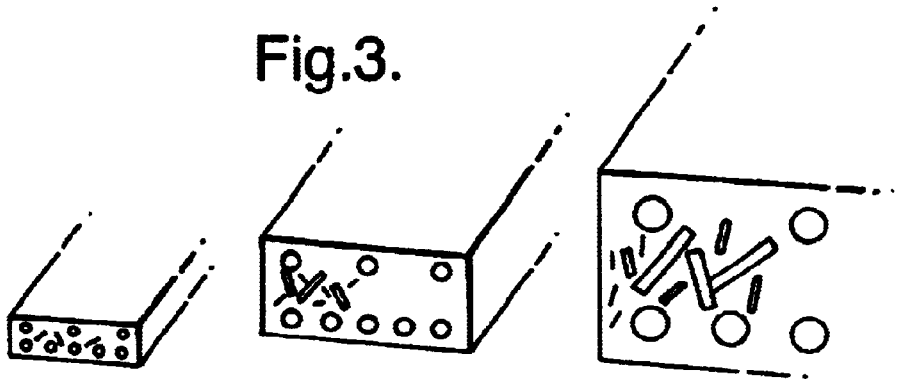
FIG. 3 shows parameters of reinforced bodies of various sizes.

In FIG. 3 are shown reinforced bodies of various sizes showing substantially identical fracture/failure behavior, characterized by substantially the same high specific load-carrying capacity, expressed, e.g, as bending strength in the range 100 to 200 MPa, and substantially the same high specific fracture toughness, characterized by, inter alia, substantially identical dimensionless ductility number $$\frac{EG}{\sigma^2 L}$$

(which will be discussed in greater detail in the following.

The matrix materials may, e.g., be based on binders built up of/formed from cement and ultrafine $SiO_2$ particles, the so-called DSP materials, (cf. the following) and up to 4 mm strong particles.

The small 50 mm thick body A is reinforced with steel rods, diameter 10 mm. The matrix has been given toughness with 0.2 mm diameter discrete steel fibers, resulting in an increase of the fracture energy G by a factor of about 100, from about 100 N/m to about 10,000 N/m=10 kN/m.

The 10 times larger 500 mm thick slab B is reinforced with 100 mm diameter steel cables The matrix has been given an about 10 times larger fracture energy, $G_B \approx 100$ kN/m, with a combination of a) 2 mm diameter discrete steel rods, b) 0.2 mm diameter discrete steel fibers, and c) hard, strong, tough particles/bodies with size s up to 40 mm.

The 5 meter thick giant slab C is reinforced with 1000 mm diameter composite reinforcement according to the invention (discussed further below). The matrix has been given enormously high fracture toughness, $G_C \approx 1000$ kN/m, about 100 times higher than in A and about 10 times higher than in the thick slab B. This has been done by building in, in relation to the matrix, a) 20 mm diameter discrete steel rods b) large, hard and strong, tough bodies with size s up to 400 mm.

With the structural designs shown, B giant slabs of thickness 0.5 meter and C 5 giant slabs of thickness 5 meters—with load-carrying capacities which are enormous in the light of the enormous thicknesses, and, at the same time, with unique, extremely tough behavior in failure/fracture.

The present invention provides novel principles for creating large bodies or articles where large reinforcement is made to co-operate with a suitable matrix as illustrated above.

In particular, the present invention teaches that in order to confer to large bodies a combination of similar toughness behavior as can be obtained in smaller bodies and large load-bearing capacity, the large bodies must contain reinforcement components which are far larger than what has been known in the art, such as rod-shaped elongated reinforcement components (rods, bars, etc, and/or reinforcement components which in themselves have a composite structure) of diameters in the range of, e.g. 60 mm, 100 mm, 200 mm, 500 mm or even up to several meters or above.

Another type of reinforcement used according to the present invention is plate-shaped reinforcement. The plate-shaped reinforcement can be used either alone, that is, in the form of a plurality of plate-shaped reinforcement components, or in combination with rod-shaped reinforcement, including the above-mentioned "thick" elongated reinforcement. The plate-shaped type of reinforcement is believed to be novel in the special embodiments and contexts described herein, and is highly advantageous, whether used in large sizes (thicknesses) or used in smaller sizes in the special structures described herein.

In connection with both of these types of reinforcement, design for large bodies or articles which are to have beneficial failure/fracture behavior similar to the failure/fracture behavior of small bodies or articles will require, in addition to the above-mentioned large reinforcement components in suitable concentrations, matrix properties which are adapted to co-operate with the reinforcement systems in question and which, to some extent, are matrix properties which have not been used or disclosed in the prior art.

An essential aspect of the present invention is to create large, strong, rigid, high energy absorbing structures by the use of 1. large, thick reinforcement combined with
2. effective fracture-toughening of surrounding matrix material.

Figure 4A:
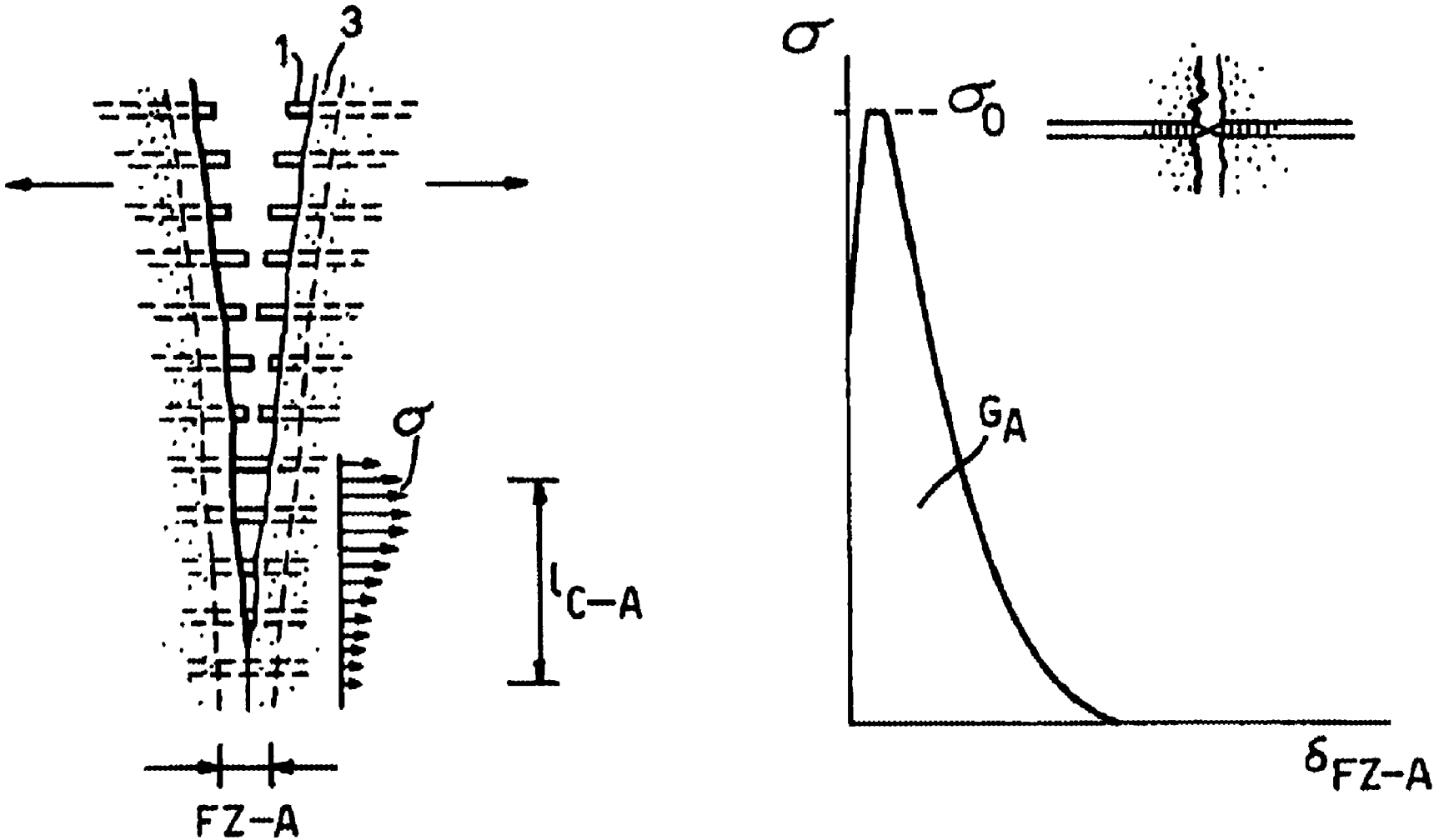
FIGS. 4A and 4B show behavior in local fracture zones at fracture under tension/peeling of a body having fine reinforcement and a body having large/thick reinforcement, respectively.
Figure 4B:
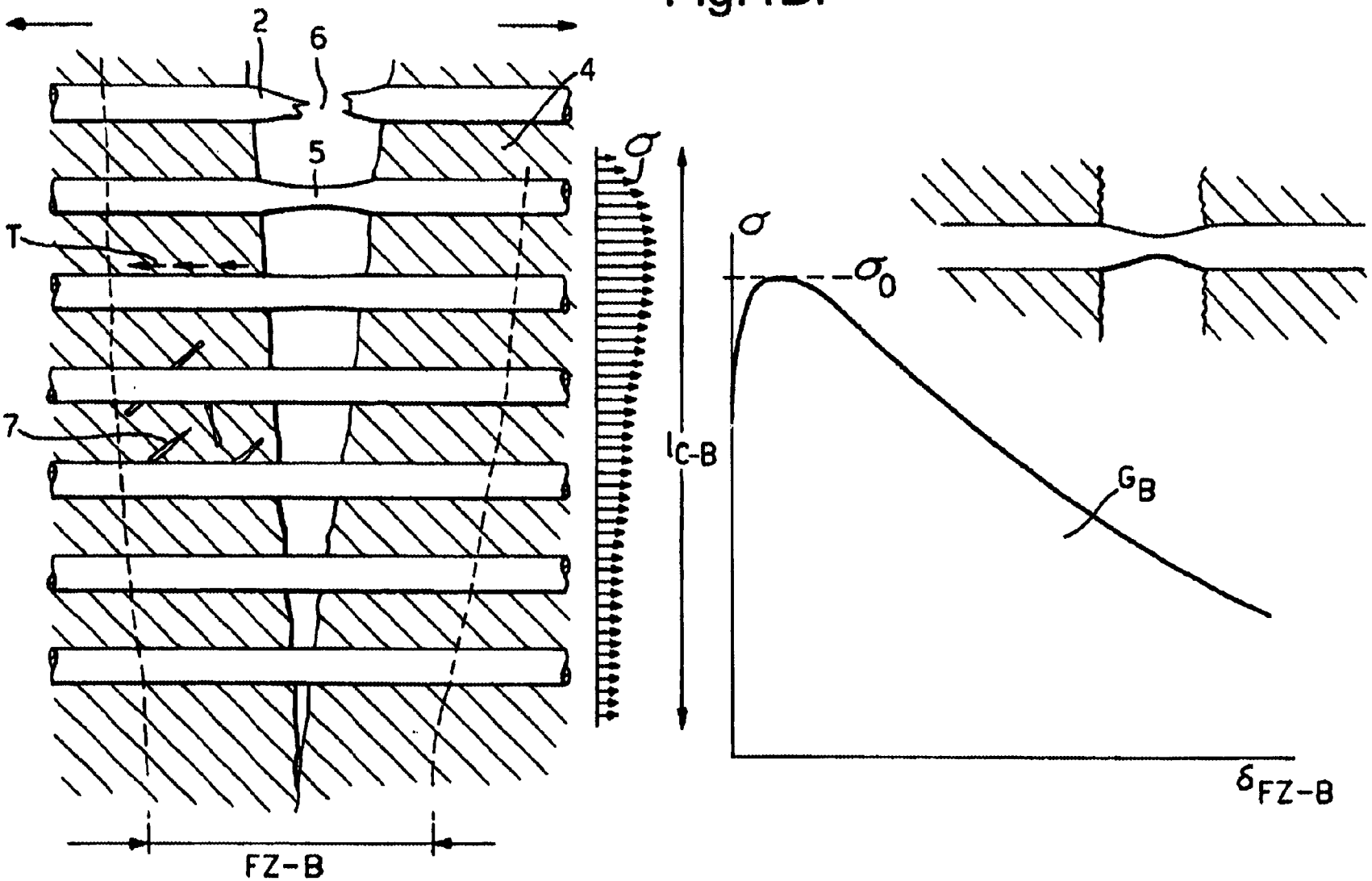
Figure 5A:
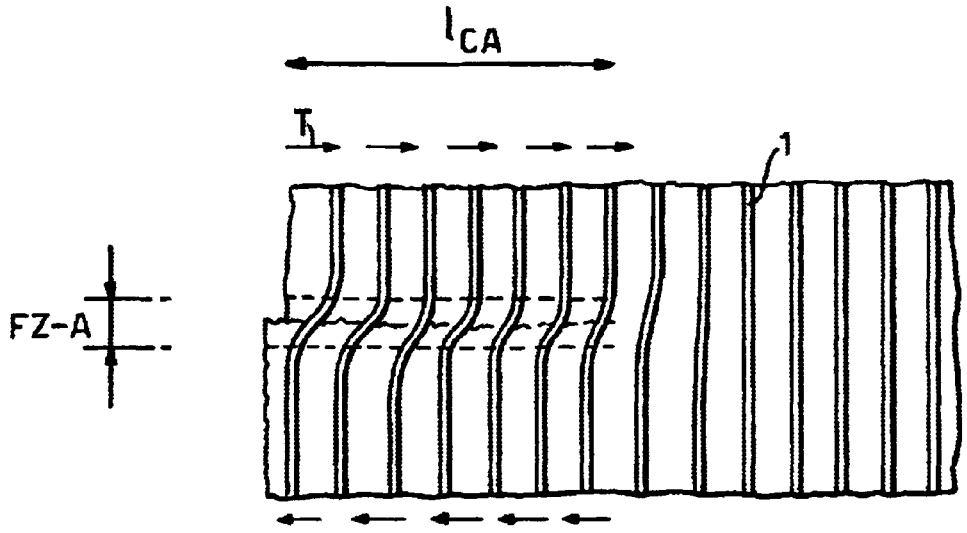
FIGS. 5A and 5B show behavior of reinforced bodies in local fracture zones at fracture under shear.
Figure 5B:
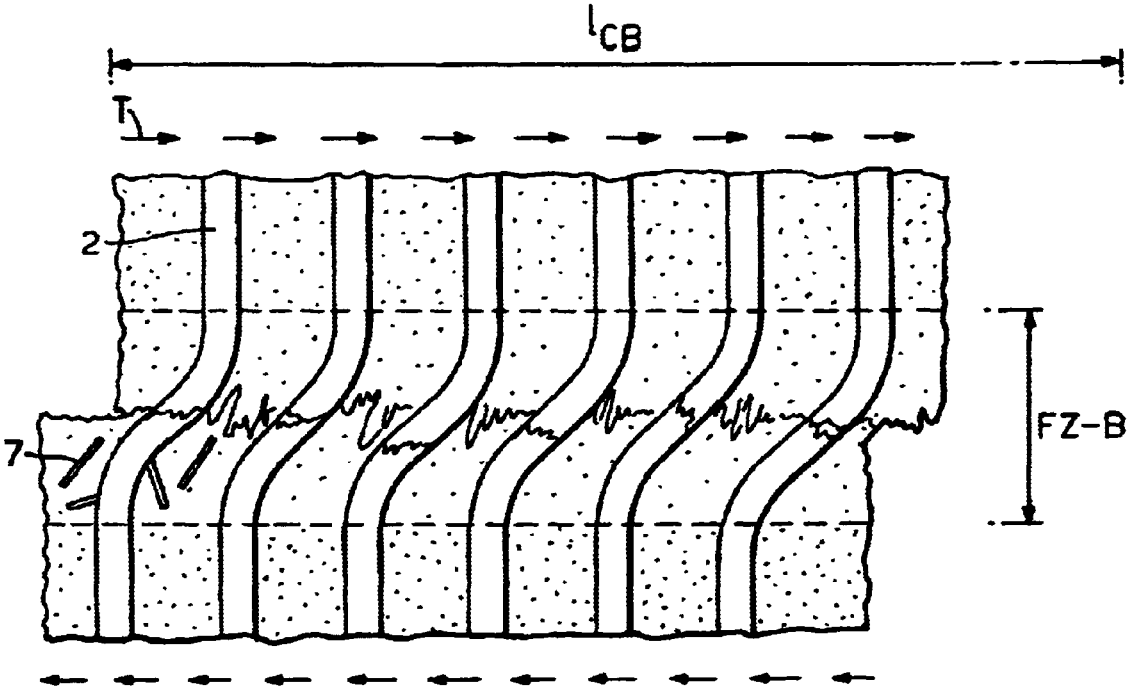

The principles are shown in FIGS. 4 and 5 which show behavior in local fracture zones at fracture under tension/peeling (FIG. 4) and shear (FIG. 5), respectively.

In conventional design for strength, similar bodies of reinforced composite structures, with identical matrix materials and with reinforcement with rods of the same material in the same amounts will be estimated to have identical load carrying capacity/strength independently of the reinforcement dimensions. Also in connection with the present invention, this is a reasonable presumption for systems where the behavior in the local fracture zones is of minor importance.

When this is not the case, the size of the reinforcement is of decisive importance.

In energy loading on most conventional bodies, such as under impact, where the body has to absorb kinetic energy, the major part of the energy is taken up by strain energy $$W_E \propto \sigma_0 \epsilon_0 L^3$$

distributed over the body.

This means that the excess work absorbed in the local fracture zone during the fracture process $$W_G \propto G L^2$$

is small compared to $W_E$.

That is, $$\frac{W_G}{W_E} << 1.$$

In preferred articles according to the present invention this is turned upside down.

A large energy absorption capacity is intentionally built into the fracture zone, typically so that this is the dominant contribution to the total energy-absorbing capacity.

That is, in articles according to the invention, $$\frac{W_G}{W_E}$$

a) is not much smaller than 1, b) is often of the about 1 ($W_G$ and $W_E$ being of the same order of magnitude), or c) is up to much larger than 1.

For these unique structures according to the invention, the use of large reinforcement is essential when—as is the case here, the design is a complex integrated design where the reinforcement is combined with unique fracture toughening of the enveloping matrix material.

FIG. 4 shows a section of fracture zones for reinforced composite materials under peeling opening of a crack under influence of tension, shown by the arrows.

A shows a body with a fine reinforcement 1 with a diameter d

B shows a body with a large/thick reinforcement 2 with diameter D.

For the present illustration/discussion it is presumed that the amount and the quality of reinforcement are the same in A and B and that the respective matrix materials behave in the same manner—and furthermore that there are the same shear stresses $\tau$ at local sliding between reinforcement and matrix in A and B.

At fracture, local/special behavior is experienced in fracture zones FZ-A and FZ-B respectively, with sliding between matrix and reinforcement and yielding/fracture of reinforcement 5 and 6.

Under local fracture, the tensions $\sigma$ are the same in the two systems, but 1. The fracture zone FZ is much larger in B than in A, $$\frac{FZ-B}{FZ-A} \approx \frac{D}{d}$$

2. The displacement of the fracture zone $\delta_{FZ}$ is much larger in B than in A.
3. The excess energy in the fraction zone to create 1 square meter of crack—G—is much larger in B than in A $$\frac{G_B}{G_A} \approx \frac{D}{d}$$

This is illustrated by graphs showing the stress $\sigma$ versus fracture zone deformation $\delta_{FZ}$. The area under the curves represents the excess energy absorbed in the crack zones per unit area—G.

4. The size of the active zone under peeling failure $l_C$ is much larger in B than in A $$\frac{l_{CB}}{l_{CA}} \approx \frac{D}{d}$$

Thus, by increasing the size of the reinforcement by a factor $$\frac{D}{d} = 5, 10, 50 \text{ or } 100,$$

respectively, it is possible to increase the excess energy capacity in the fracture zones correspondingly $$\frac{G_D}{G_d} = 5, 10, 50, 100$$

times, respectively.

FIG. 5 shows, analogously, corresponding behavior of reinforced bodies under shear, with bending/shear fracture of the reinforcement and complex failure/fracture of the matrix in the fracture zones FZ.

The above description pertaining to separation fracture (cf. FIG. 4 is general and may also be used for describing behavior under shear failure. In the expressions for energies. In the expressions relating to energies, the energy is then fracture energy $G_\tau$ related to shear and stresses are stresses $\tau$ also related to shear.

The above considerations were based on the presumption of similar behavior.

However, if the systems B with large reinforcement just used the same matrix materials as the systems A, then the behavior would not be a similar behavior.

In the systems with the large reinforcement, the matrix material surrounding the reinforcement would fail in a much more brittle behavior than the corresponding matrix material surrounding the fine reinforcement.

Typically a markedly less positive effect than indicated in the examples would be obtained by using the larger reinforcement.

According to the principles of the present invention, the serious drawback can be completely eliminated by modifying the matrix materials correspondingly.

This may be done, e.g., by increasing the fracture energy $G_m$ of the matrix material by incorporation of fine fibers or rods as illustrated in FIG. 4-7 and FIG. 5-7.

If the matrix modification consisted exclusively in—with, e.g., fibers or rods—increasing the fracture energy G, the attainment of similarity in fracture behavior would require that $$\frac{G_{m.B}}{G_{m.A}} = \frac{D}{d}$$

As an example, this would correspond to the requirements to $G_{m.B}$ shown in the below table 1 to obtain similar behavior as system A with fine reinforcement:

| SYSTEM | A | B | | | | |
|---|---|---|---|---|---|---|
| diameter (mm) | d = 10 | D = 50 | 100 | 200 | 500 | 1000 |
| D/d | 1 | 5 | 10 | 20 | 50 | 100 |
| fracture energy $G_m$ (kN/m) | 1 | 5 | 10 | 20 | 50 | 100 |

Table 1. Requirements to matrix fracture energy $G_m$ in systems with large reinforcement components (B) to obtain the same local matrix toughness in the surroundings of reinforcement components as in A. In the theory pertaining to the present invention, local matrix toughness is often expressed by the toughness number $$\frac{E_m G_m}{D\sigma^2}$$

The present invention provides new unique composite structures with large reinforcement showing far superior fracture behavior than behavior resulting from just up-scaling behavior from known art systems in the way described above.

Thus with reference to FIG. 5 which shows shear behavior, the invention provides preferred systems with strongly increased shear resistance obtained by combining the use of large reinforcement D with 1. Matrix fracture toughening, providing matrix fracture energies one to two decades (factor 10 to 100) larger than those shown in Table 1, and/or
2. Increasing matrix stiffness, and/or
3. Incorporating large, strong particles/bodies in very dense arrangements.

These measures are described in greater detail in the following.

Large Systems

This aspect of the present invention relates to large, strong, rigid, tough composite structures characterized by having heavy reinforcement, with thickness/diameter of at least 60 mm. The invention concerns composite structures reinforced with reinforcement with thickness/diameter far in excess of 60 mm, e.g., at least 80 mm, at least 100 mm, at least 200 mm, at least 500 mm and even with a diameter of at least 1 meter, at least 2 m, at least 5 m or at least 10 m or larger.

Structures according to the invention have a plurality of reinforcement components, at least two, normally at least 3, at least 5, at least 7 or more, typically at least 10, such as at least 20, e.g. at least 50, at least 100, in some cases at least 1000 or at least 2000, typically arranged in two or more layers.

Accordingly, the size of the composite structures spans over very large ranges, say from thicknesses from about at least 150–200 mm through at least 500 mm, at least 1000 mm, at least 2 meters, at least 5 meters, at least 10 meters, at least 20 meter to even at least 50 meters or more.

Figure 6A:
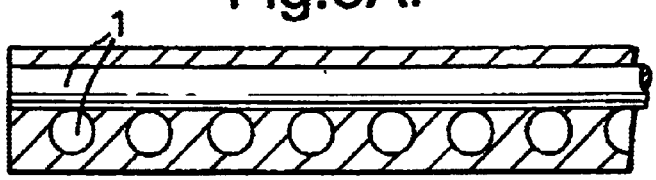
FIG. 6A shows part of an article with thickness of only 216 mm reinforced with two layers of straight ultra-strong cables 1 of diameter 60 mm.

FIG. 6 shows examples of articles according to the invention.

A shows part of an article with a thickness of only 216 mm reinforced wih two layers of straight ultra-strong cables 1 of diameter 60 mm, B shows part of an article with thickness 2000 mm reinforced with layers of ultra-strong steel 2, diameter 250 mm, C shows part of a huge 20 meter thick article reinforced with 5 layers of composite reinforcement 3, diameter 2.5 meters.

A shows an example of the unique bodies which are very thin in view of the dimensions of the reinforcement, the ratio between thickness h and reinforcement diameter being only $$\frac{h}{d} \approx 3.6.$$

By way of example, there are plate-shaped bodies of the above type, with a strong steel reinforcement and a strong, hard, very fracture-tough matrix which are able to resist very heavy concentrated impact loading, acting elastically like a membrane. Relevant figures are shown in Table 2

| L<br>m | D<br>mm | h<br>mm | d<br>mm | M<br>kg |
|---|---|---|---|---|
| 12 | 0.6 | 216 | 60 | $60*10^3$ |
| 120 | 6 | 2160 | 600 | $60*10^6$ |
| 1200 | 60 | 2160 | 6000 | $60*10^8$ |

Table 2. Panel systems according to the invention capable of throwing back solid steel bodies—with mass M—impacting the panels at velocity 10 m/sec. The impact bodies have a flat circular contact surface of diameter D, h is the panel thickness, d is the reinforcement diameter. The behavior refers to panels L*L, simply supported at their rims.

Figure 6B:
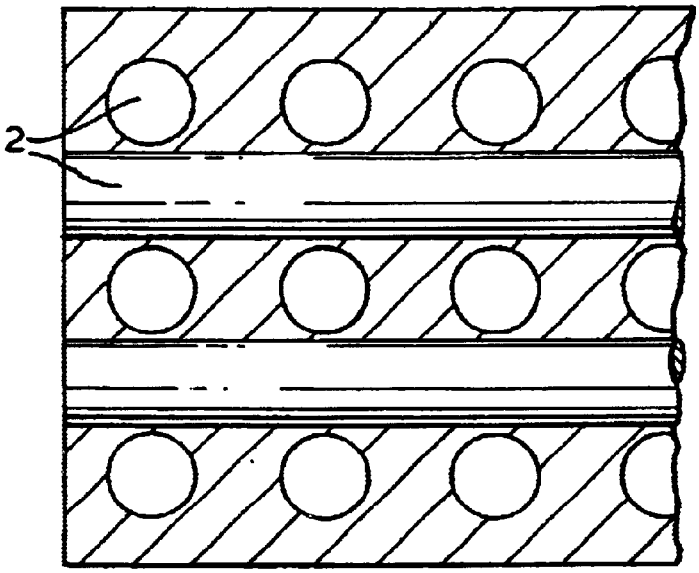
FIG. 6B shows part of an article with thickness of only 2000 mm reinforced with 5 layers of ultra-strong steel 2, diameter 250 mm.
Figure 6C:
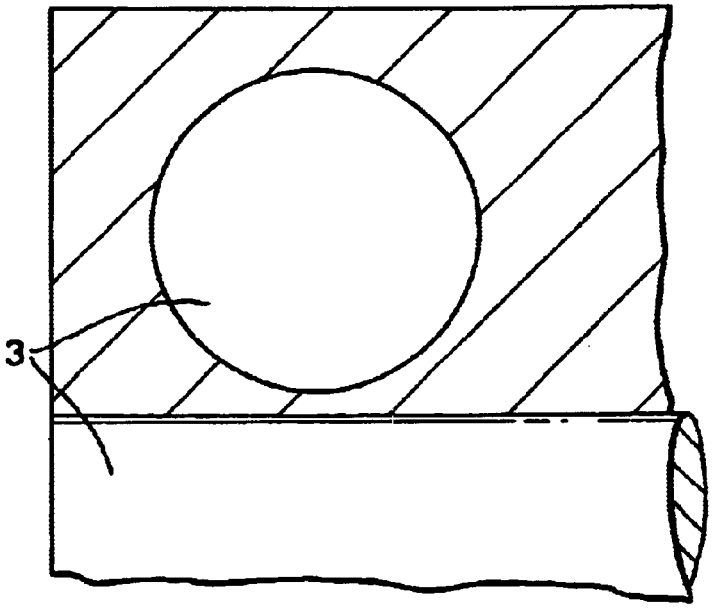
FIG. 6C shows part of a huge 20 meter thick article reinforce with 5 layers of composite reinforcement 3, diameter 2.5 meters.

FIG. 6B shows part of a panel system with 5 layers of reinforcement with ratio between thickness h and reinforcement diameter $$\frac{h}{d} = 8,$$

and FIG. 6C shows a detail referring to giant reinforcement d=2.5 meters in a 20 meters thick solid structure according to the invention As indicated above, the work in connection with the present invention has given rise to the surprising insight that most large structures created by mankind are in fact very brittle if subjected to major physical influences such as earthquakes, explosions, etc.

Most of the structures that have survived have done so only because they have not been subjected to any major physical influence apart from gravity (have only been challenged with carrying their own weight). It could perhaps be said that there is a false feeling of safety about these large structures. Apart from natural disasters such as major earthquakes, which may occur with large time intervals, perhaps of the order of 100 years, problems associated with modem civilization, such as the danger of collisions between large ships and bridges or offshore structures or between airplanes and buildings, make it relevant to consider the security of conventional large structures. New threats from criminals and/or terrorists using powerful explosives and efficient modern destruction weapon, aggravate the problem.

The present invention provides large composite structures having uniquely advantageous fracture behavior compared to known structures. Using the principles of the present invention, it becomes possible to provide structures which, in contrast to known large structures, are not extremely brittle under impact or other traumatic influences such as earthquakes and large explosions. Structures according to the invention can be designed to provide a high degree of protection and resistance against impact and other destructive influences and to show a tough behavior—yielding rather than crashing—when an influence is so large that it causes matrix fracture. This is highly advantageous in connection with the design of a number of structures for which this was previously not possible, such as for bridges, dams, large buildings, shelters, armaments, fortifications, bank vaults, tunnel walls, offshore structures and encapsulations of nuclear power plants.

One particular aspect of the invention relates to a modelling method for use in designing the structures according to the invention and other structures. Other particular aspects comprise structures containing reinforcement which is in itself a composite structure.

One aspect of the invention relates to a shaped article at least part of which is constituted by a composite structure built up of plate-shaped reinforcement in a dense, rigid, fracture-tough matrix which shows high compressive strength, high stiffness in all directions and at the same time a high fracture toughness. Another aspect of the invention relates to a shaped article at least part of which is constituted by a composite structure built up of rod-shaped elongated reinforcement bodies in a dense, rigid, fracture-tough matrix which shows high compressive strength, high stiffness in all directions and at the same time high fracture toughness. These two aspects, may, of course, be combined in one and the same article.

While there is, in relation to the present invention, no particular lower limit with respect to the dimensions of plate-shaped reinforcement, the rod-shaped elongated reinforcement bodies contemplated herein have a minimum transverse dimension (such as typically a minimum diameter) of 60 mm.

Shaped articles according to the present invention are capable of resisting large concentrated loads, especially large impact loads, such as high velocity impact, and large repeated loads. Especially, they show unique combinations of high strength, high stiffness and very large fracture toughness, also in large and very large articles.

Special designs of articles according to the invention permit an efficient utilization of high strength/ultra high strength plate, rod, and thread materials, such as UHS steel with tensile strengths of 1000–1500 MPa or higher, e.g. strengths in the range of 1500–2500 MPa.

It is known to produce composite bodies based on reinforcement in the form of plates in parallel arrangement, confer conventional laminate technique found, e.g., in laminate wood products.

Conventional laminates provide effective utilization of reinforcement plates in tension, but they are typically less suitable or unsuitable for functioning under compression loads and shear and less suitable or unsuitable for resisting large concentrated transverse loads.

Articles according to embodiments of the present invention combine the capability of utilizing reinforcing components—whether plates or rods—effectively in tension with the suitability of performing also under compression loads and shear, and to resist large concentrated transverse loads.

This is obtained through the use of very hard, stiff matrix materials which have a modulus of elasticity of at least 40 GPa, which have high compressive strength of at least 60 MPa and a high fracture toughness of at least 0.5 kN/m.

The two above-mentioned aspects of the invention comprising plate-shaped and elongated rod-shaped reinforcement, respectively, or both can be defined as a shaped article at least part of which is constituted by a composite structure comprising a matrix and a plurality of reinforcement components in intimate contact with and wholly or partly embedded in the matrix, such reinforcement components having an at least 1.5 times higher tensile strength than the matrix, the reinforcement components being (i) plate-shaped components which are orientated with their planes substantially parallel to each other, such that the minimum volume per cent concentration ($\phi$) of the plate-shaped components in the composite structure is dependent on the tensile strength ($\sigma_a$) of the plate-shaped components in a direction in the plane of the plate-shaped components in accordance with the following table

| $\sigma_a$ MPa | 300 or less | 500 | 700 | 1000 | 1500 | 2000 or more |
|---|---|---|---|---|---|---|
| $\phi$ % | 8 | 6 | 4 | 3 | 2 | 1.5 |

intermediate values for the minimum volume percentage of the plate-shaped components being being calculatable by linear interpolation where both the tensile strength and the volume concentration are depicted in logarithmic scale, and/or (ii) elongated components with a transverse dimension of at least 60 mm, such that the minimum requirements with respect to volume concentration of the elongated reinforcement components ($\phi$), tensile strength of the elongated reinforcement components ($\sigma_a$), compressive strength of the matrix ($\sigma_c$), and modulus of elasticity of the matrix (E) are adapted in accordance with the minimum transverse dimension (d) of the elongated reinforcement components in accordance with the following table:

| d (mm) | 60 | 100 | 250 | 600 | 1200 | 3000 or more |
|---|---|---|---|---|---|---|
| $\phi$ (vol %) | 1.8 | 1.5 | 1.0 | 0.7 | 0.5 | 0.3 |
| $\sigma_a$ (MPa) | 190 | 180 | 150 | 100 | 75 | 50 |
| $\sigma_c$ (MPa) | 55 | 50 | 40 | 30 | 20 | 15 |
| E (GPa) | 40 | 30 | 25 | 20 | 15 | 10 |

intermediate values for the minimum requirements for each of the properties being calculatable by linear interpolation where both the transverse dimension (d) and the value for the property in question are depicted in logarithmic scale, the reinforcement components, whether plate shaped or elongated, being constituted by monolithic components and/or being built up of discrete subcomponents, the subcomponents being in intimate contact with each other, and/or spaced from each other and embedded in a solid embedment, the geometry of any reinforcement element which is built up of discrete subcomponents being defined by the envelope of the reinforcement component.

When the composite structure contains the plate-shaped components important embodiments of the articles of the invention are articles wherein the matrix has a compressive strength of at least 60 MPa, a modulus of elasticity of at least 40 GPa, and a fracture energy of at least 0.5 kN/m. These embodiments are interesting both when when the plate-shaped components are "small" that is, have thicknesses below 60 mm, and when they are of larger thicknesses.

This way of designing reinforced structures (where the reinforcement components are plates, or are rods or bars or columns having a minimum transverse dimension of at least 60 mm) is believed to be novel. Thus, for example, in the design of laminates, the person skilled in the art will normally select glues and matrix materials which are soft and yielding and capable of following the strains of the reinforcement, typically plastic and plastic-like materials. On this background, laminates have been accepted as they are—with the above-mentioned relatively low strengths and unavoidable weaknesses/limitations. This is in contrast to laminates with the stiff, strong matrix defined for the above important embodiments of the plate-shaped articles of the invention. In laminate articles according to the present invention, the above-mentioned weaknesses or limitations have been substantially eliminated—without loosing the primary laminate function or the primary function as a reinforced structure.

According to embodiments of the invention, very hard matrix materials with high compressive strength are utilized, but at the same time, the essential high yielding capacity has been secured. This is done by providing the otherwise very brittle matrix materials with high fracture energy, combined with an effective fixation to the reinforcement.

Thus, an embodiment of the invention relates to shaped article at least part of which is constituted by a composite structure comprising a matrix and a reinforcement embedded in the matrix, the reinforcement having an at least 1.5 times higher tensile strength than the matrix, the composite structure showing the following properties:

the matrix has a compressive strength of at least 60 MPa, a modulus of elasticity of at least 40 GPa, and a fracture energy of at least 0.5 kN/m, and the reinforcement is in the form of plate-shaped components with a tensile strength of at least 300 MPa, in which case the plate-shaped components constitute at least 8% by volume of the composite structure, or a tensile strength of at least 500 MPa, in which case the plate-shaped components constitute at least 6% by volume of the composite structure, or a tensile strength of at least 700 MPa, in which case the plate-shaped components constitute at least 4% by volume of the composite structure, or a tensile strength of at least 1000 MPa, in which case the plate-shaped components constitute at least 3% by volume of the composite structure, or a tensile strength of at least 1500 MPa, in which case the plate-shaped components constitute at least 2% by volume of the composite structure, or a tensile strength of at least 2000 MPa, in which case the plate-shaped components constitute at least 1.5% by volume of the composite structure, intermediate values for the minimum volume percentage of the plate-shaped components being being calculatable by linear interpolation where both the tensile strength and the volume concentration are depicted in logarithmic scale, the reinforcement components being constituted by monolithic components and/or being built up of discrete subcomponents, the subcomponents being in intimate contact with each other, and/or spaced from each other and embedded in a solid embedment, the geometry of any reinforcement component which is built up of discrete subcomponents being defined by the envelope of the reinforcement component.

Also, it will be noted that according to the invention, very large (that is, very large transverse dimension, or very large diameter) rod-shaped or elongated reinforcement components are used according to the invention, contrary to conventional design principles, where even where large structures are normally reinforced with relatively thin reinforcing components, typically at the most 25 mm.

The transverse compressive strength of reinforcement components should not be too small, and as a general principle, the transverse compressive strength of any reinforcement component in the relevant part of the shaped article should be at least 10 MPa.

In many valuable embodiments of the invention, the plate-shaped reinforcement is constituted by components having thicknesses of between 0.5 and 40 mm, such as components of the following characteristics:

components having thicknesses between 0.5 and 1 mm, and/or components having thicknesses between 1 and 2.5 mm, and/or components having thicknesses between 2.5 and 5 mm, and/or components having thicknesses between 5 and 10 mm, and/or components having thicknesses between 10 and 20 mm, and/or 20 components having thicknesses between 20 and 40 mm.

The individual components of the plurality of plate-shaped components in a shaped article may be of the same thickness or of different thicknesses. The plurality of plate-shaped components will comprise at least two plate-shaped components with matrix therebetween, but in many valuable embodiments of this aspect of the invention, there will be more than two plate-shaped components, such as, e.g., at least 3, at least 5, at least 7, at least 10, at least 20, at least 50, at least 100, or more. The matrix between layers of plate-shaped components will normally be a matrix which itself is reinforced by means of fibers and optionally rods or bars so as to confer toughness to the matrix. Plate-shaped components may be plane or curved, and the individual components of the plurality of plate-shaped components may be of the same three-dimensional conformation, or they may have different three-dimensional conformations. The plate-shaped members of the same or different conformation may be arranged so that they are substantially "parallel" to each other or they may be arranged at angles to each other, thereby defining domains of matrix therebetween with varying three-dimensional conformation.

The minimum requirements with respect to tensile strengths of the reinforcement components are stated above. In preferred embodiments, the reinforcement is reinforcement having tensile strengths between 500 MPa and 2500 MPa or even higher, such as reinforcement components of one of the following characteristics:

reinforcement having tensile strength between 500 and 700 MPa, and/or reinforcement having tensile strength between 700 and 1000 MPa, and/or reinforcement having tensile strength between 1000 and 1500 MPa, and/or reinforcement having tensile strength between 1500 and 2000 MPa, and/or reinforcement having tensile strength between 2000 and 2500 MPa, and/or reinforcement having tensile strength larger than 2500 MPa.

While the minimum requirements as to the properties of the matrix are stated above, it is, in accordance with the principles of the present invention, strongly preferred to use a strong, stiff, and tough matrix. Thus, preferred matrix materials are materials having a compressive strength between 90 and 400 MPa or higher than 400 MPa. Thus, in this regard, interesting matrix materials are materials having a compressive strength between 90 and 120 MPa, or between 120 and 160 MPa, or between 160 and 220 MPa, or between 220 and 280 MPa, or between 280 and 400 MPa, or larger than 400 MPa.

The matrix materials should also, as mentioned above, be stiff, as expressed by a high modulus of elasticity. Thus, preferred matrix materials are materials having a modulus of elasticity between 60 and 200 GPa or higher, such as a modulus of elasticty between 60 and 80 GPa, or between 80 and 100 GPa, or between 100 and 140 GPa, or between 140 and 200 GPa, or larger than 200 GPa, The toughness of the matrix material is also a very important property and should preferably be higher than the minimum values stated above. Thus, preferred matrix materials are materials having a fracture energy between 2 kN/m and 1000 kN/m or even higher than 1000 kN/m, such as materials having a fracture energy between 2 and 5 kN/m, or between 5 and 20 kN/m, or between 20 and 50 kN/m, or between 50 and 200 kN/m, or between 200 and 1000 kN/m, or larger than 1000 kN/m.

The minimum volume of plate-shaped reinforcement components is stated above. Subject to this, preferred volume concentrations of reinforcement is often between 4 vol % and in certain cases very high values, such as up to 70 vol % or higher, examples of ranges being between 4 and 6 vol %, or between 6 and 10 vol %, or between 10 and 20 vol %, or between 20 and 30 vol %, or between 30 and 50 vol %, or between 50 and 70 vol %, or larger than 70 vol %.

The matrix may be a substantially continuous matrix, that is, the composition of the matrix is substantially the same throughout, or, which constitutes very interesting embodiments, at least part of the matrix may be built up of discrete domains with discernible boundary zones, the discrete domains being in contact with each other, either directly or via intermediate material.

Thus, at least some of the discrete domains of such a matrix built up with discrete domains may be constituted by matrix components fabricated separately and mechanically interconnected via reinforcement components surrounding or transversing the reinforcement components, and/or mechanically interconnected via interconnecting matrix domains.

The material which constitutes the matrix or part of the matrix of the articles according to the invention may be selected from a number of suitable matrix materials, such as metals, metal alloys, or plastics, which may be substantially continuous materials made from a continuous phase or materials made from particles, such as by sintering or other techniques for making matrix-materials base on a particle system or particle systems. Other, important examples of matrix materials are mineral particle-based materials such as ceramics, plastics materials or cement-based materials or materials based or cement materials or cement-like materials. Some or all of these types of matrix materials may contain materials conferring toughness, such as fiber materials adapted to the particular matrix materials in question. As will appear from the discussion herein, fiber materials or fine reinforcement may be provided in more than one "dimension", such as a fine fiber reinforcement combined with a coarser toughness-conferring reinforcement.

One particular example of matrix materials can be used which are the so-called DSP materials binders based on cement, ultrafine silica and a superplasticizer. Such materials are disclosed, e.g., in U.S. Pat. Nos. 5,234,754 and 4,588,443. A particularly interesting use of these matrix materials to provide highly reinforced articles having superb strength and toughness is disclosed in the above-mentioned U.S. Pat. No. 4,979,992, and WO 98/30769 discloses structures where such matrix materials are combined with particular reinforcement with tension interlocking, conferring very high impact resistance.

Thus, one examples of matrix materials suitable for articles according to the invention are the above-mentioned DSP material, for exemple, DSP materials with hard stiff particles and about 2% by volume of fine fibers, with compressive strength about 200 MPa tensile strength ($\sigma_0$) about 20 MPa modulus of elasticity (E) about 50 GPa and fracture energy (G) about 3 kN/m.

Such bodies according to the invention based on these matrix materials show excellent mechanical behavior, including a very high fracture toughness.

In large articles/bodies according to the invention, DSP-based matrix materials with substantially the same strength ($\sigma_0$) and stiffness (E) can be used, but with fracture energy (G) scaled up according to the model $$\frac{EG}{\sigma_0^2 d} = constant.$$

In 100 times larger bodies—with 100 times larger transverse dimension of reinforcement (d) matrix materials with 100 times larger fracture energy are required; G=100*3=300 kN/m.

The articles and bodies according to the invention may vary over a very wide size range. Thus, they may, for example, be 1. Strong, hard composite bodies with very high fracture toughness based on reinforcement of 5 mm d plates or with rods of, for instance UHS steel, or with a combination of UHS steel plates and UHS steel threads or wires.
2. Unique giant bodies based on 500 mm d or larger composite plates or rods as reinforcement—the composite plates or rods in themselves being based on thinner plates or rods of, e.g., UHS steel combined with matrix material—the giant bodies showing unique mechanical behavior, including a very high fracture toughness.

An interesting embodiment of the invention comprises articles in which the reinforcement components are in themselves components having a composite structure.

Such a reinforcement component may be defined as a reinforcement component having a composite structure comprising one or several discrete reinforcement subcomponents embedded in a matrix having a compressive strength of at least 60 MPa, a modulus of elasticity of at least 20 GPa, and a fracture energy of at least 0.5 kN/m.

The reinforcement subcomponents are preferably components of a high tensile strength, such as UHS steel, or components of a more moderate tensile strength present in a high volume concentration. Thus, interesting reinforcement components of this type are components in which the reinforcement subcomponents have a tensile strength of at least 300 MPa, in which case the subcomponents constitute at least 8% by volume of the composite structure, or a tensile strength of at least 500 MPa, in which case the subcomponents constitute at least 6% by volume of the composite structure, or a tensile strength of at least 700 MPa, in which case the subcomponents constitute at least 4% by volume of the composite structure, or a tensile strength of at least 1000 MPa, in which case the subcomponents constitute at least 3% by volume of the composite structure, or a tensile strength of at least 1500 MPa, in which case the subcomponents constitute at least 2% by volume of the composite structure, or a tensile strength of at least 2000 MPa, in which case the subcomponents constitute at least 1.5% by volume of the composite structure.

the geometry of the reinforcement component is defined by the envelope of the reinforcement component, and when the minimum transverse dimension of the envelope is at least 60 mm, then the minimum requirements with respect to volume concentration of reinforcement subcomponents, ($\phi$), tensile strength of the reinforcement subcomponents, ($\sigma_a$), compressive strength of the matrix ($\sigma_c$), and modulus of elasticity (E) being adapted in accordance with the minimum transverse dimension (d) of the envelope in accordance with the following table:

| d (mm) | 60 | 100 | 250 | 600 | 1200 | 3000 or more |
|---|---|---|---|---|---|---|
| $\phi$ (vol %) | 1.8 | 1.5 | 1.0 | 0.7 | 0.5 | 0.3 |
| $\sigma_a$ (MPa) | 190 | 180 | 150 | 100 | 75 | 50 |
| $\sigma_c$ (MPa) | 55 | 50 | 40 | 30 | 20 | 15 |
| E (Gpa) | 40 | 30 | 25 | 20 | 15 | 10 |

intermediate values for the minimum requirements for each of the properties being calculatable by linear interpolation where both the transverse dimension (d) and the value for the property in question are depicted in logarithmic scale.

It is preferred that the matrix of the reinforcement component in any case has a modulus of elasticity of at least 30 GPa, more preferably at least 40 GPa.

The arrangement of the reinforcement subcomponents will depend on the intended use of the reinforcement component. One advantage of this embodiment of a reinforcement component is that it can be adapted, by suitable arrangement of its reinforcement subcomponents and adaption of the matrix, to fulfil special requirements in connection with special reinforcement tasks.

Thus, interesting embodiments of the shaped articles according to the invention are articles at least part of which is constituted by a composite structure comprising a matrix and reinforcement components which in themselves have a composite structure as explained above, embedded in the matrix.

The reinforcement components are preferably components produced separately from the matrix of the article, as assessible by a difference in structure and/or properties between the matrix of the article and the matrix of the individual reinforcement components, and/or by a distinct boundary between the matrix of the article and the matrix of the reinforcement component. The separate production of the composite reinforcement components makes it possible to confer valuable properties to the subcomponents which could not easily be achieved if the reinforcement subcomponents were incorporated in situ; thus, as an example, the matrix of a composite reinforcement component could be a high strength matrix consisting of a heat-treated material such as a ceramic material.

As indicated above, one possible matrix material of the shaped article is a cement material, and this also applies when the article is reinforced with a composite reinforcement components. Examples of cement-based matrix materials are Portland cement such as normal Portland cement, high early strength Portland cement, sulphate resistant cement, low alkali cement, low heat cement, white Portland cement, Portland blast furnace cement, Portland pozzolana cement, Portland fly ash cement, or of an aluminate cement (high alumina cement).

While it may be advantageous, as mentioned above, to produce a composite reinforcement component separately from the structure in which it is to be used, there will also be situtations where it is advantageous to make the reinforcement component in situ by casting at least part of its matrix material around one or several reinforcement subcomponents which are optionally embedded in a matrix material.

As mentioned above, small bodies according to the invention, based on plate-shaped reinforcement, show very interesting properties. Large bodies according to the invention are even more remarkable and would not be derivable from knowledge about the behavior and structure of small bodies according to the invention.

Conventional design would lead to large, very brittle bodies/articles. That is because the known art will tend in "optimal design" to use substantially the same materials (5 mm plates or rods and matrix) in the large bodies as were successfully used in the small, fracture-tough bodies. However, in large configurations, for instance for giant containers having walls of thickness 2–3 meter, such materials would be extremely brittle. In contrast, large bodies made according to the principles of the present invention, with large reinforcement components and suitably adapted matrix fracture energies, show excellent properties.

It is also a generally acknowledged principle in the prior art that ultra-strong plate, thread, wire or rod materials canned be effectively utilized in bending and shear in the plane or direction of the plates, threads, wires or rods, or in bending, because of buckling problems where typically stiffness—and not strength—is dimension-determining.

It is also generally acknowledged in the conventional art that joints between strong panels or other reinforcement components make it difficult or impossible to effectively utilize strong panel materials. This applies to all types of joints—such as, e.g., between parallel plates, but in particular for complex joints between non-parallel plates.

With the plate/matrix or, quite generally, reinforcement component/matrix structure according to the present invention, these limitations can be eliminated/minimized to secure total effective utilization of high strength reinforcement components in tension, bending, shear and under compression loads, statically and under repeated loads—also where there are local cracks and internal tensions in the reinforcement components.

This is obtained by effective co-operation between the very strong reinforcement components and the surrounding stiff, hard, strong and fracture-tough matrix materials. Local cracks in individual reinforcement components such as individual plates or rods will not spread to neighboring components. At local failure, forces are distributed to neighboring reinforcement components via the matrix material. The matrix material can distribute large forces in all directions under moderate deformation. The high matrix stiffness effectively counteracts local buckling, so that panels and other reinforcement bodies can be effectively utilized in bending and shear in the plan or direction of the plates or other bodies and under compression load.

Preferred articles and bodies are articles and bodies in which very strong reinforcement materials are effectively utilized—both for securing extremely good mechanical performance with high concentrations of reinforcement and for obtaining, with lower concentration of reinforcement, "the same performance" as in corresponding articles according to the invention with less strong reinforcement.

An aspect of the invention relates to composite structures with large discrete bodies in matrix materials having high fracture toughness. These composite materials are characterized in that 1) the matrix materials show fracture toughness, having tensile fracture energy of at least 0.5 kN/m and up to above 1000 kN/m, 2) the discrete bodies are large—with a transverse dimension of at least 10 mm.

Average sizes may, e.g., be in the ranges of

15–12 mm, or 2040 mm, or

40–100 mm, or

100–300 mm, or

300–1000 mm, or larger than 1000 mm.

3) they are stronger than the matrix, with a ratio between their tensile strength of at least 1.5 and up to more than 100, 4) and the discrete bodies constitute a large proportion by volume of at least 30% by volume of the total volume of bodies and matrix.

As mentioned above, the composite structures have high fracture toughness and in many cases also very high strengths. The composite structures—especially materials with very high strengths, are especially focused towards very large articles. Thus, the invention constitutes a basis for new articles with unique combinations of large sizes, high strengths and very large fracture toughnesses.

It is generally acknowledged that larger strength for the same category of materials results in higher brittleness. It is also generally acknowledged that larger size results in higher brittleness. Likewise, it is generally acknowledged that materials built up of, or with, larger particles are weaker than corresponding materials built up of, or with, small particles.

Thus, sinter materials based on sintering of 5–10 $\mu$m particles are considerably stronger than sinter materials of the same basic material and geometrically shaped similarly therewith, but based on 50–100 $\mu$m particles. Likewise, it is acknowledged that cement mortar is normally markedly stronger than corresponding concrete with identical cement binder, in other words that the materials with up to 1–2 mm sand particles are considerably stronger than corresponding material with 10–20 mm stone.

The smaller strengths with the larger particles are related to the above-mentioned size effect: with increased size, the brittleness increases.

With the present invention, including the design principles used in connection with the present invention, it has become possible to turn these "laws of nature" upside down.

Thus, utilizing the principles of the invention, it is possible to create huge articles built up of composite materials with huge"particles", e.g., sizes of 300–1000 mm, which composite materials have very high strengths and show extremely tough fracture behavior.

(In the present part of this description, the designation "bodies" is preferred over "particles", because of the size of the "particles").

Based on the principles, according to the invention, of similarity, including similarity with regard to fracture behavior, it is possible to create or design 1) large articles of composite materials, with large bodies in fracture-tough matrices, which have the same strength as the strong, tough, geometrically similarly shaped small bodies of composite materials based on small particles (small bodies) and which show similarity with regard to fracture behavior, 2) these larger bodies showing far superior fracture behavior than predicted by simple scaling.

To illustrate the principle discussed, reference is first made to the principles of "similarity". The principles appear from FIG. 7.

Figure 7:
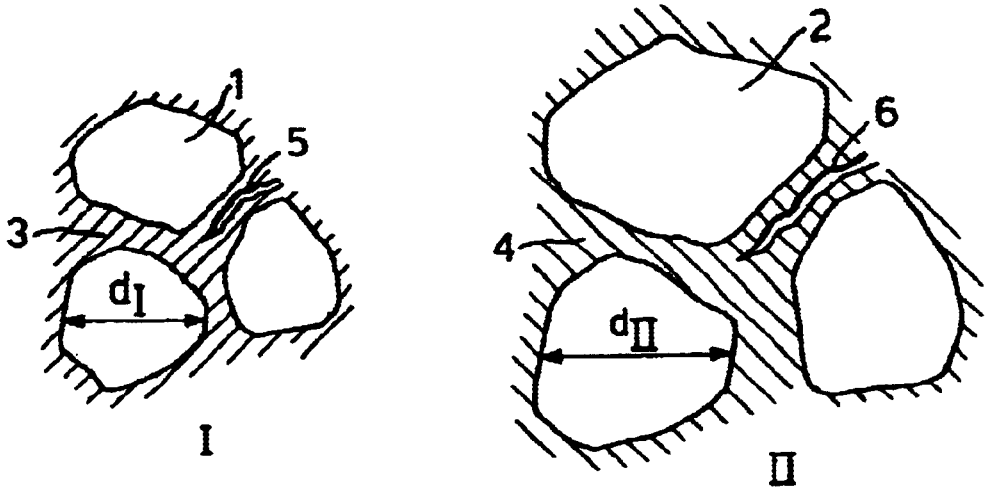
FIG. 7 shows sections of geometrically similarly shaped composite materials.

One of the conditions for "similar fracture behavior" is that the systems in question have the same local toughness, as expressed by a requirement of equal local toughness number for small domains of matrix material between—and around—the individual discrete bodies $$\frac{EG}{\sigma_1^2 d}$$

wherein EG and at refer to the matrix, and d is a characteristic length—in this case d is chosen as the size of the bodies (see FIG. 7).

The above requirement as to equal toughness number may, e.g., constitute the background for design of large articles of composite materials with large bodies ("system 2") based on similarly shaped small articles of composite materials with corresponding small bodies (particles) ("system 1").

Thus, for example, the expression for toughness number tells us what must be required with respect to fracture energy $G_2$ of the matrix in the "large" composite material:

$$G_2 = \left(\frac{\sigma_2}{\sigma_1}\right)^2 \left(\frac{E_1}{E_2}\right)\left(\frac{d_2}{d_1}\right) * G_1$$

This means, for example, that for systems having the same strengths σ and the same stiffnesses E, it is possible to establish the same/similar fracture behavior for 100 times larger articles using 100 timer larger bodies (d) by providing the surrounding matrix with 100 timer larger fracture energy (G).

EXAMPLE

This is an example of scaling up according to the principles of the present invention.

As reference, results/data for strong, hard matrix materials may be used, for example the so-called DSP mortars disclosed in U.S. Pat. No. 4,588,443, with hard and strong about 1 mm particles in a strong matrix based on cement and microsilica, with a particle concentration, referring to the above-mentioned 1 mm particles, of 30–40% by volume. The compressive strength, modulus of elasticity and fracture energy of the mortar is 200 MPa (σ), 60 GPa (E) and 0.2 kN/m, respectively, and the corresponding values for the binder/matrix are about 200 MPa (σ), 20 GPa (E) and 0.02 kN/m (G). Small articles of this DSP mortar—such as panels of thickness 10 mm reinforced with 2–3% by volume of strong 1.5 mm diameter steel rods are very strong and relatively tough.

It is desired to design"similarly shaped" larger articles which are as strong and stiff and show the same tough failure/fracture behavior. Examples are 10 and 100 times larger, respectively, systems, in other words, panels of thickness 100 mm (large LA)

panels of thickness 1000 mm (very large VLA)

If there were used, for the large articles a) the same fine composite material and the same fine 1.5 mm reinforcement as in the reference, or b) the above-mentioned fine reference material, but with the reinforcement upscaled (to diameter 15 mm and 150 mm, respectively)

it would be found, in both cases, that the large articles would have lower strengths than intended and would show a much more brittle fracture behavior than the reference.

The difference between real behavior and intended behavior will be especially large where the articles are subject to heavy impact resulting in heavy damage.

On the other hand, in accordance with the principles of the present invention, the same strengths and "similarity-based" good, tough fracture behavior can be obtained by scaling up as shown in the following table:

| Article Size | H mm | $d_r$ mm | $d_B$ mm | $G_A$ kN/m | G kN/m | $\sigma_c$ MPa | E GPa |
|---|---|---|---|---|---|---|---|
| R | 10 | 1.5 | 1 | 0.02 | 0.2 | 200 | 60 |
| LA | 100 | 15 | 10 | 0.2 | 2 | 200 | 60 |
| VLA | 1000 | 150 | 100 | 2 | 20 | 200 | 60 |

Predicted vales of fracture energy (G) for composite materials for large panel-shaped articles (LA and VLA designed by scaling up from an similarly shaped small reference article (R). H is the panel thickness, $d_r$ is the reinforcement diameter, $d_B$ is the size of bodies (particles), $G_A$ is the required fracture energy of the matrix (A) embedding the bodies (B). $\sigma_c$ is the compressive strength of the composite material, and E is the modulus of elasticity of the composite material.

In the scaling illustrated, it has been chosen, to simplify matters, to presume the same strengths ($\sigma$) and the same stiffnesses (E). In addition, it is presumed that there is proportionality between the compressive strength and the tensile strength of the composite material. As it will be seen, similar fracture behavior is obtained with 10 and 100 times, respectively, larger bodies ($d_B$) and 10–100 times larger reinforcement (diameter $d_r$ and with matrices which also have 10 and 100 times, respectively, larger fracture energy $G_A$.

That we have similar fracture behavior is indicated by the fact that the corresponding respective global toughness numbers $$\frac{EG}{\sigma_t^2 H}$$

are equal, and that this also applies to the local toughness numbers $$\frac{EG}{\sigma_t^2 d_r}, \frac{EG}{\sigma_t^2 d_B}$$

The desired matrices (A) with fracture energies of 0.2 and 2 kN/m, respectively, can be created in many ways. Thus, e.g., for the composite material LA, the reference composite material (R) can be selected as matrix. This material has exactly the desired fracture energy (0.2 kN/m) and is geometrically harmoniously suited, having its 1 mm particles, to be arranged between the densely arranged larger 10 mm bodies.

For the matrix in VLA, a fracture energy ($G_A$) of 2 kN/m is required. This may be obtained, e.g., with the above-mentioned strong DSP mortar provided with additional toughness (from 0.2 to 2 kN/m) with, e.g., about 0.6 vol % fine, strong steel fibers 0.15 mm*6 mm.

The required fracture energy can also be obtained without fibers, for example, by using, together with the larger 100 mm bodies (B), the above-described composite material LA with 10 mm bodies as matrix, this being based on the same considerations as were used in the design of the LA composite materials from DSP mortar with 1 mm particles.

In the above example, confer the table, large and very large articles were discussed with composite materials—with large bodies B—showing good fracture-tough behavior.

However, in accordance with the principles of the present invention, it is possible to create or design large articles with the same and even higher strengths than in the above example, and with fracture toughness which is orders of magnitude larger.

Large panel-shaped articles of the same dimensions as shown in table and also an article of thickness 10,000 mm will be built up with composite materials with strong rigid matrix and large (thick) reinforcement (adapted to article size), but additionally provided with a very high fracture energy by incorporation of 9 vol % of large, strong bars having the dimensions 60 mm*1.5 mm for panels of thickness 1000 mm and 60*15 mm for panels of thickness 10,000 mm.

Through this, the respective fracture energies (G) for the composite materials have been increased from 2 kN/m to 300 kN/m (H=1000 mm) and from 20 kN/m to 3000 kN/m (H=10,000 mm), respectively.

Such a unique behavior, where 9 vol % of rod-shaped bodies increase the fracture energy by a factor of 150, illustrates essential aspects of the present invention, combining 1) bodies of an elongated shape—such as rod-shaped (constituting part of the bodies B in the example with 15 mm diameter rods)
2) bodies with tensile strengths which are much higher than the tensile strengths of the matrices (in this case about 100–200 times larger) for example, with tensile strength ratios $\sigma_{reinforcement}/\sigma_{matrix}$ in the range between 10 and 30, or in the range between 30 and 100, or in ranges as high as between 100 and 300 or even between 300 and 1000, or higher than 1000,
3) having very large local fracture toughness with very high local toughness number $$\frac{EG}{\sigma_t^2 d}$$

related to a behavior around the reinforcement. Thus, for example, values in the range from 100 to 1000, or from 1000 to 10000, or even higher than 10000 are contemplated.

This aspect of the present invention is characterized in that the the matrix materials (A) surrounding or embedding the bodies B have a high fracture energy of at least 0.5 kN/m, with characteristic/desired ranges of increasing fracture energy being 0.5–2
2–10
10–30
30–100
100–300
300–1000
and larger than 1000.

with the proviso that when the average body size is at the most 20 mm, then the minimum fracture energy can be as low as 0.15 kN/m, and correspondingly 0.3 kN/m when the body size is at the most 40 mm.

An important aspect of the present invention is to ensure that fracture of the composite materials will to a substantial extent proceed solely through the matrix materials—outside the discrete bodies.

According to the invention, this is ensured by adapting the bodies and the matrix so that the strength of the discrete bodies is at least 1.5 times larger than the strength of the matrix, referring to compressive strength and/or tensile strength.

In very interesting composite structures according to the invention, the discrete bodies are much stronger—with strength ratios between the bodies and the matrix of about 2.5–5, or, preferred, 5–10, or more preferred 10–30 or higher, such as 30–100, 100–300 or even as high as 300–1000 or larger than 1000.

The relatively very strong bodies, e.g., with 30–300 times higher strength than the corresponding matrices—are typically used in the form of rods, which puts much higher requirements to the relative strength of the bodies than in composite structures with compact-shaped discrete bodies.

Another essential aspect of the present invention is to ensure high shear resistance, including high shear fracture energy. This may be obtained by 1. using, in the composite structures, strong, stiff discrete bodies which ensure that fracture takes places substantially only in the matrix,
2. arranging the discrete bodies very densely so that shear failure in a plane will, at the same time, force the surfaces to move away from each other, in a movement directed obliquely upwardly, whereby the resistance against shear is increased,
3. to use very large discrete bodies, which results in very large upwardly directed displacements upon failure, which on its side, in view of the high shear forces, will result in correspondly large work of shear (force multiplied by path)

In the present description, this is expressed as establishing large shear fracture energy.

To ensure a large shear fracture energy, composite materials or structures are used in which there are high concentrations of the above-mentioned large, strong, stiff, discrete bodies, such as the bodies constituting a volume proportion of the composite materials or structures of between 30 and 40% or between 40 and 50% or between 50 and 60% or between 60 and 70% or between 70 and 75% or between 75 and 80% or higher than 80%.

A particularly effective shear locking is obtained by arranging the large bodies, in the form of bodies with substantially the same size—very densely. For this reason, particularly interesting composite materials are materials in which, for 90% by volume of the discrete bodies, the ratio between the largest and the smallest size is between 5 and 1, such as in one of the ranges between 5 and 3, or better between 3 and 2, or between 2 and 1.5, or between 1.5 and 1.

FIG. 7 shows sections of geometrically similarly shaped composite materials showing "similar" or "similarity-based" fracture behavior. (1) and (2) are discrete bodies in composite materials I and II, respectively, (3) and (4) are the corresponding matrix materials. Situations are shown which have similar fracture behavior—illustrated by the geometrically similarly shaped fractures (5) and (6).

A necessary, but not in itself sufficient, condition for similar fracture behavior is that the local toughness number for the respective matrix materials in the respective geometric configurations are substantially the same $$\frac{E_I G_I}{\sigma_I^2 d_I} = \frac{E_{II} G_{II}}{\sigma_{II}^2 d_{II}}$$

in which E, G and a are modulus of elasticity, fracture energy and tensile strength, respectively, for the respective matrix materials, and d is a respective characteristic length, such as minimum size of the respective discrete bodies.

The use of ultra-strong very thin panels or other reinforcement bodies instead of thicker reinforcement bodies with the same tensile strength—for instance, the use of 5–10 mm UHS steel plates with yield stress ≈1500 MPa instead of 25–50 mm steel panels with yield stress 300 MPa gives a number of potential advantages, inter alia 1. Simplified production
2. Weight saving
3. Larger freedom with respect to design
4. Larger freedom with respect to building in specific surface properties (for plates in the surfaces of the bodies and for internal plates, for instance, with respect to fixing to the matrix materials).

Articles according to the invention are characterized by containing/being built of of composite structures with high tensile strength and high stiffness, to a large extent obtained by providing the matrix materials with high compression strengths of at least 60 MPa and a large modulus of elasticity of at least 40 GPa.

Compression strength and stiffness are of importance for a number of properties, as exemplified in the following:

1. The load-bearing capacity of bodies functioning in tension and bending is dependent on the compressive strength of the materials. For short columns and plates, the load-bearing capacity will often increase proportionally with the compressive strength.
2. With slender bodies, where failure is more likely to take place by buckling/stability failure, the load-bearing capacity is primarily determined by the stiffness, and thus by the modulus of elasticity of the materials. For slender columns, the load-bearing capacity is directly proportional to the modulus of elasticity.
3. Resistance to penetration perpendicular to the plane of the reinforcement—e.g., penetration of projectiles or penetration missiles—is increased with increased compressive strength and increased stiffness of the matrix material.
4. Local fracture toughness for the matrix material is dependent on the product of the fracture energy (G) and the modulus of elasticity (E)—as is expressed, e.g., in the classical expressions for strength (σ) of elastic bodies with an initial crack $$(a):\ \sigma \approx \sqrt{\frac{EG}{a}}\ .$$

On the background of the above examples, preferred articles according to the invention are characterized by containing matrix materials with high compressive strength, such as the compressive strengths claimed in the claims.

Also, articles having matrix materials with high stiffness are highly preferred, such as with the data claimed in the claims.

As mentioned above, the unique mechanical behavior of the articles according to the invention are conditioned by the matrix materials having a unique combination of high compressive strength, high hardness, and stiffness and very high fracture toughness, with a fracture energy (G) of at least 0.5 kN/m.

The fracture energy (G) of the matrix materials constitutes part of a larger complex with respect to characterizing the degree of toughness:

the toughness number $$\frac{E_m G_m}{\sigma_m^2 d}$$

where $E_m$ and $\sigma_m$ are the modulus of elasticity and the tensile strength, respectively, of the matrix material, and d is a characteristic length, for instance, the thickness of the reinforcement.

As it appears from the expression for the toughness number, larger systems—d is large—require large material toughnesses $$E_m G_m / \sigma_m^2$$

to secure large toughness. This is primarily secured by providing the matrix materials with high fracture energy, typically by incorporating particles and, especially, fibers, threads and rods.

With increased toughness—toughness number—a number of advantages/improvements are obtained, such as, e.g., 1. increased load-carrying capacity
2. higher internal coherence, and through this
3. higher density against internal mass transport, of, e.g., liquid, gas, ions, etc.

The effect of increased toughness is significant for slowly loaded bodies. Thus, e.g., a 10-fold increase of the toughness number will often lead to 20–50% increase of the load-bearing capacity or more.

In connection with bodies which are subject to high impact, such as from explosives or attack with penetration shells/missiles, the effect is often for greater.

While a body having a brittle matrix material, such as a rod-reinforced block of dimension 1.5*1.5*1 meter, will be crushed like glass by attack with a penetration shell, the corresponding tough body will catch the shell as the dart disc catches the arrow, without major damage.

On this background, preferred articles according to the invention are characterized in that their matrix materials show high fracture energies, such as claimed in the claims.

Matrix materials having very large fracture energies, such as 500–2000 kN/m, will typically be materials built up with fine particles, larger particles, fine and larger fibers and rods, kept together through strong binders.

This will also typically be in good accordance with the general design principles which, confer the expression for toughness, indicate that it is exactly for very large bodies—with correspondingly large space between the large reinforcement components, that these space-requiring extremely fracture-tough matrix materials are needed.

According to the design principles of the present invention, it is also possible to build in high fracture toughness by means of fine components which do not require much space.

Thus, e.g., it is possible to produce materials (based on binders, fine particles up to 1 mm and fine steel fibers, such as 46% by volume of steel fibers of dimension 0.15 mm×6 mm) which are suitable for casting between 5 mm panels arranged at a mutual distance of about 4–6 mm and with fracture energies about 10–20 kN/m.

The adaptation between fracture energy and size of article/detail manifests itself in preferred articles according to the present invention which are characterized by high local toughness as expressed by a high ratio between fracture energy (in $G_m$) for the matrix material and cross-sectional dimension of reinforcement (d), with $G_m$/d between 100 and 200 kN/m$^2$
or between 200 and 500 kN/m$^2$
or between 500 and 2000 kN/m$^2$
or between 2000 and 5000 kN/m$^2$
or larger than 5000 kN/m$^2$.

The adaptation can also be expressed by means of the toughness number $$\frac{E_m G_m}{\sigma_m^2 d}.$$

Thus, preferred articles according to the invention are characterized by high ratios between the material toughness of the matrix materials $$\frac{E_m G_m}{\sigma_m^2}$$

and the transverse dimension (d) with $$\frac{E_m G_m}{\sigma_m^2 d}$$

between 1 and 2
or between 2 and 5
or between 5 and 20
or between 20 and 50
or larger than 50.

A good, intimate mechanical connection between the reinforcement panels and the matrix material is an essential feature of the composite structures according to the present invention.

Figure 8:
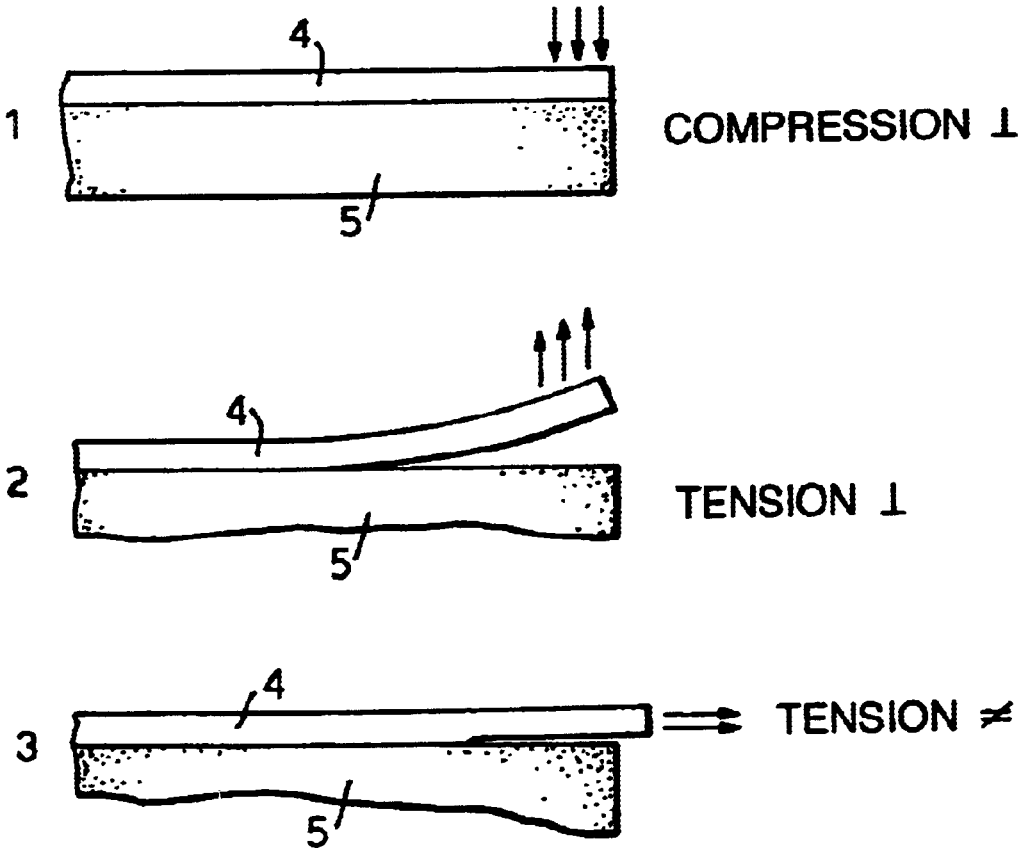
FIG. 8 shows parts of composite bodies each having an exterior reinforcement panel in connection with matrix material, under influence from various forces acting on the reinforcement panels close to the end part.

In FIG. 8, the problems concerning the connection are illustrated in a simplified form. FIG. 8 shows parts of composite bodies 1, 2 and 3, each having an exterior reinforcement panel 4 in connection with matrix material 5, under influence from various forces acting on the reinforcement panels close to the end part. In body 1, the forces are pressure forces perpendicular to the panel. In body 2, the forces are tension perpendicular to the panel. In body 3, the forces are tension in the plane of the panel.

Body 1: Pressure perpendicular to the panel, 1, is transmitted to the matrix material, often without any particular requirements as to the connection between panel and matrix. (This overall statement is, however, not absolute. Thus, there are preferred structures in which intimate connection between panel and matrix increase the pressure capacity of the matrix material by counteracting transverse expansion.)

Body 2: At tension perpendicular to the panel, there is a risk of the panel being partially torn off, typically by peeling.

Body 3: Under the influence of tension in the plane of the panels a the end part there is a risk of shear failure in the interface, typically by a peeling-like behavior.

For known art laminate bodies, the capacity of resisting transverse loads in compression (body 1) and in tension (body 2) is generally low, and the known art laminate bodies are not well suited for transferring large shear forces in the plane of the panel (body 3).

This is different with articles according to the present invention. With stiff matrix materials having a high compression strength, for instance, with modulus of elasticity of 40–60 GPa
or 80–100 GPa
or 100–140 GPa
or 140–200 GPa
or larger than 200 GPa
and compression strengths
between 60 and 90 MPa
or between 90 and 120 MPa
or between 120 and 160 MPa
or between 160 and 220 MPa
or between 220 and 280 MPa
or between 280 and 400 MPa
or larger than 400 MPa
the articles of the invention are excellently suited for absorbing large transverse loads in compression, and to do this while having a stiff performance, showing only small deformations.

However, the principles according to the present invention also comprise a number of measures for ensuring/improving the connection between reinforcing panels and matrix materials with respect to ensuring/improving the capability of ensuring/improving the connection between reinforcement panels and matrix materials and with respect to ensuring/improving the capability of absorbing tension perpendicular to the plane of the reinforcement panels and to absorb shear, cf. bodies 2 and 3 in FIG. 8.

Some of these measures are believed to be generally novel, inventive and unique per se and thus not necessarily limited use in connection with the articles of the invention as defined herein.

The measures are as follows:

1. Measures to create better contact between reinforcement panels and matrix materials on an atomar/molecular level, primarily through chemical measures such as using adhesives.
2. Measures to create better contact by establishing suitable structures of the surfaces of the reinforcement panels on a micro level or meso level, such as suitable coarseness and/or a fluted, channelled, rifled, knurled or ribbed structure.
3. Measures based on providing mechanical anchoring, stops etc., fixed to the reinforcement panels and embedded in surrounding matrix material.
4. Measures for conferring higher stiffness to the panels, primarily to increase the resistance against peeling.
5. Measures to confer particularly high resistance against shear, based on creating special frictional resistance, where the shear results in the building up of pressure in the matrix and hereby increased resistance against sliding.

Typically, the articles of the invention will show combinations of two or more of the above measures, such as appears, i.a., from the following. In the present discussion, especially measures for conferring higher stiffness to the panels (item 4 above) and measures for conferring/creating special friction resistance (item 5 above) will be discussed, i.a. because these are new aspects believed to be novel and inventive per se.

Figure 9:
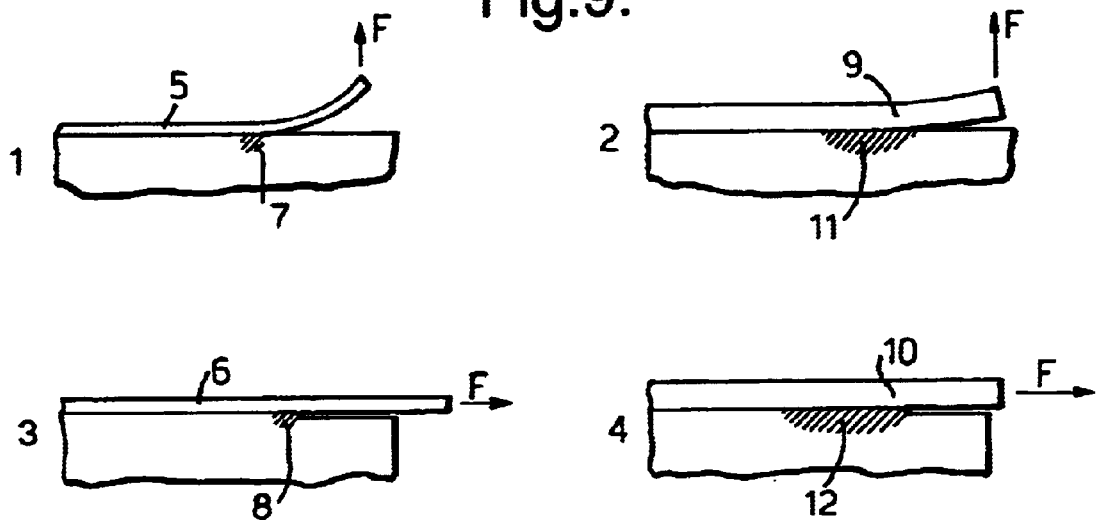
FIG. 9 illustrates tearing off of panels from substrate in tension perpendicular to the plane of the panels and in shear.

Resistance against peeling depends on the stiffness of the panels, as shown in FIG. 9, which illustrates tearing off of panels from substrate in tension perpendicular to the plane of the panels (details 1 and 2 of FIG. 9) and in shear (details 3 and 4 of FIG. 9. The thin panels 5 and 6 are deformed to a high extent, and the tearing off forces F are small, with the resistance concentrated in small active connection zones 7 and 8. With the thicker, stiffer panels 9 and 10, the active connection zones 11 and 12 are larger, and the forces necessary for tearing off correspondingly larger.

The resistance against peeling on bending (details 1 and 2) and against peeling on shear (details 3 and 4) depends on the stiffness of the panels, that is, on the bending stiffness EI and the tension stiffness EA, where E is the modulus of elasticity of the panel material and I and A are the cross-sectional moment of inertia and the cross section area, respectively.

For massive panels with constant thickness h, the respective values (per m of panel breadth) are $$I = \frac{1}{12}h^3,\ A = h$$

As it will be appreciated, very thin panels, e.g. of UHS steel with yield stress ≈1500 MPa are extremely sensitive to peeling.

As emphasized above, exactly panels of extremely strong materials, such as UHS steel, are highly preferred in articles according to the present invention. The apparent paradox residing in the fact that preferred ultra-strong panels appear to be extremely sensitive to peeling is solved by a novel design of composite structures which not only overcomes this paradox, but at the same time opens up the possibility for a new class of large or even huge articles having extreme mechanical performance, combining extremely high strength and stiffness with extremely high fracture toughness and thus being especially well suited for resisting high concentrated loads, especially high impact load, such as loads from high velocity penetration missiles and large loads of explosives.

First, the principles using design according to the invention to secure high peeling resistance will be described, and then, on this basis, the novel unique structure designs which are one of the backgrounds of the novel high performance very large articles according to the invention.

Figure 10:
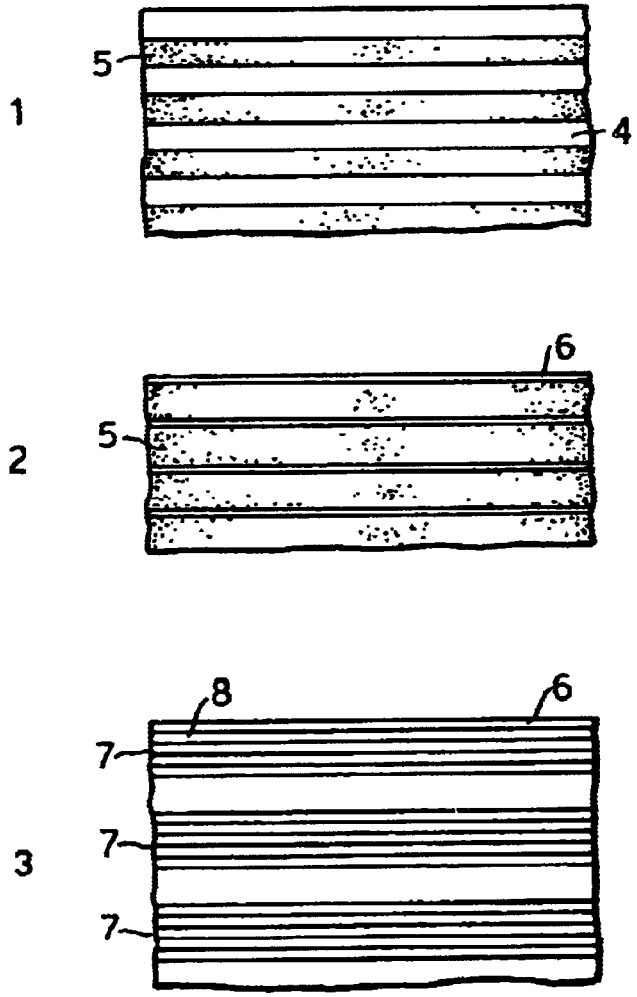
FIG. 10 shows three different composite structures arranged substantially parallel and kept together by means of matrix material.
Figure 10A:
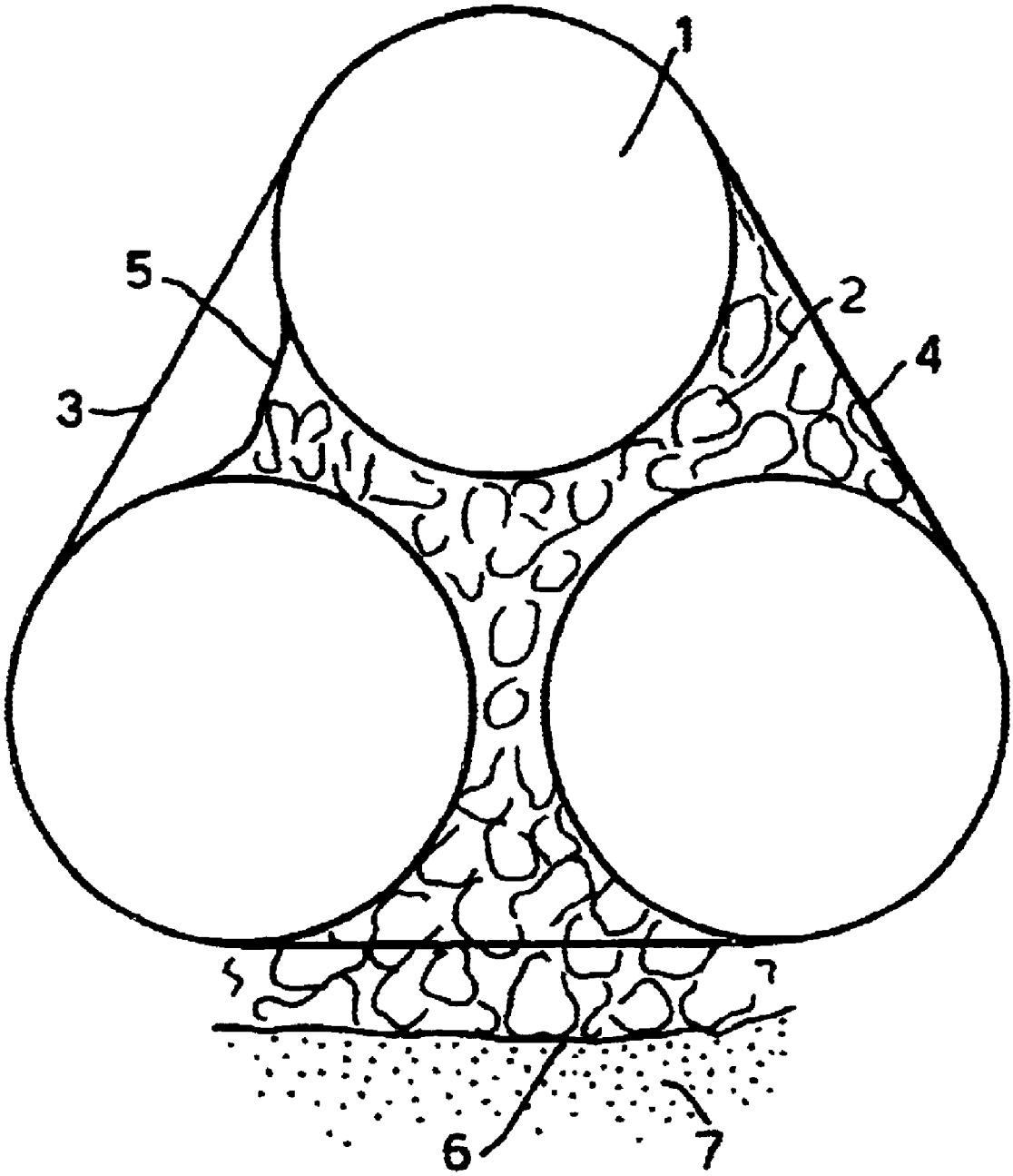
FIG. 10A shows an end view of a composite structure.

FIG. 10 shows tre different composite structures, 1, 2 and 3, all based on panels, such as steel panels, arranged substantially parallel and kept together by means of matrix material. Structure 1 has relatively thick panels 4 of moderate strength with matrix material 5 between the panels. In structure 2, the panels are replaced with much stiffer, thinner panels 6, the matrix material 5 being the same as in structure 1. In structure 3, strong, thin panels 6 like those used in structure 2 are assembled in bundles as composite panels 7. The panels of the individual bundles/composite panels are kept more strongly together than in structure 2, for instance, with a different matrix material, whereas the matrix material 5 between the composite panels is substantially as in structures 1 and 2.

Structure 1 may, for instance, be a composite structure with thick steel panels, thickness 25 mm, yield stress 300 MPa, and structure 2 may be a structure in which the thick panels have been replaced with much stronger, much thinner panels, such UHS steel panels of yield stress 1500 MPa.

Articles having structure 2 would appear to have evident advantages compared to articles with more conventional steel qualities: With the same amount by volume of steel panels there are evident possibilities of making about 5 times stronger articles, with a capability of absorbing about 25 times more energy. However, the fine plate structure 2 is much more sensitive to failure by delamination forces in the form of shear and/or tension (by shear and/or bending peeling). Thus, e.g., the resistance against bending peeling at tearing off of a single panel i tension perpendicular to the plane of the panel is reduced to only about 9% at the panel thickness reduced by 5 times (the force is proportional with $\sqrt{I} \propto h^{3/2}$).

In structure 3, the strong panels are assembled in groups in the form of "composite panels" 7. By ensuring a high resistance against local failure by peeling/shear within the individual composite panel, so that failure at overload will take place between the composite panels, the resistance against peeling failure is very considerably increased. Thus, e.g., by combining three thin panels into one composite panel having a five times greater thickness, the resistance against bending peeling is increased by a factor of more than 10, corresponding to the moment of inertia becoming more than 100 times larger.

Designing against local failure in the individual composite panels may be done using a number of measures, cf. measures 1, 2, 3, 4 and 5 above.

Typically, and often preferred, the production of articles based on the above design principles with structures based on composite panels will take place in separate processes, for instance, combining the individual thin panels into thicker composite panels in special plants adapted thereto, for instance, with respect to pressure, temperature, fixing of local locking, etc. Here, bodies based on think panels will also have evident advantages compared to corresponding bodies based on thick solid panels where processing is much more difficult.

PART B

In this part B, there is described principles and methods useful not only in implementing the aspect of the invention described herein, but also some of the teachings of part A, including the shaped articles described therein. Some of the teachings of the following part C, and the methods and shaped articles described therein, are relevant in the context of the present aspect of the invention. Such relevant material should be referred to where appropriate in putting into practice the teachings of this part B.

The present aspect of the invention relates to a method for predicting mechanical behaviour of a complex system comprising a body subjected to physical influence, including physical influence, such as impact, resulting in fracturing occurring in the body, and a method for designing complex systems comprising bodies which are to be subjected to physical influence, including bodies which are to resist disastrous destruction, such as destruction which is a result of impact events.

The method of the invention constitutes a valuable tool for predicting the fracture behaviour of bodies which are wholly or partially built up of composite structures, and/or bodies which show a complex mechanical behaviour, including a complex fracture behaviour, when subjected to physical influence such as impact.

The principles of the invention can be advantageously utilised for basing design of critical bodies and systems on modelling, including mechanical modelling using small models, such as models in length ratios of, e.g., 1:10, 1:100 or even smaller ratios, such as 1:1000, between model and the system to be designed. This makes it possible to establish a much more realistic prediction of mechanical behaviour, including a realistic prediction of fracture behaviour under impact, than was hitherto possible. Thereby, it becomes much more realistic to take fracture behaviour under impact or similar traumatic influences such as earthquakes and influences from large explosions into consideration in the design of a number of structures for which this was previously not feasible, such as for bridges, dams, large buildings, shelters, armaments, fortifications, bank vaults, tunnel walls, offshore structures, encapsulations of nuclear power plants, etc. As will appear from the present description, large structures having uniquely advantageous fracture behaviour compared to known structures can, most advantageously, be designed using the principles of the present invention.

Likewise, the behaviour, including the fracture behaviour, of existing large bodies or structures under various physical influences, including impact and earthquakes, can be predicted, this including prediction of fracture behaviour under such influences when they result in disastrous destruction, by the use of small scale models, such as models of, say, 100 to 1000 times smaller scale than the prototype, a prediction which is believed not to have been possible prior to the present invention.

Quite generally, the above-mentioned invention of novel technologies providing large structures with improved fracture behaviour and the prediction principles according to the present invention demonstrate that most large structures created by mankind are in fact very brittle if subjected to major physical influences and have survived only because they have not been subjected to any major physical influence apart from gravity (have only been challenged with carrying their own weight). It could perhaps be said that there is a false feeling of safety about these large structures. Apart from natural disasters such as major earthquakes, which may occur with large time intervals, perhaps of the order of 100 years, problems associated with modern civilisation, such as the danger of collisions between large ships and bridges or offshore structures or between aeroplanes and buildings, make it relevant to consider the security of conventional large structures. New threats from criminals and/or terrorists using efficient modern destruction weapon, aggravate the problem. The predictions, made possible through the present invention, about fracture behaviour of important existing structures, like bridges, dams, towers, etc., can not only provide valuable information for use in possible disaster situation, but can also be used in connection with considerations about how such structures could be modified, using the above-mentioned novel technology, to confer improved fracture behaviour to them.

Likewise, the design tools provided through the present invention make it possible to design against such natural or man-caused disasters in connection with the building of new large structures, typically utilising principles involving the incorporation of panels and reinforcement bodies into hard and tough matrices.

The principles of the present design/modelling invention can also be used in the opposite way, that is, by mechanical modelling using large models for predicting the mechanical behaviour of prototype systems that are smaller. This can be of great value in connection with predictions of fracture behaviour of bodies of such small dimensions that accurate recording of the fracture behaviour of the actual size prototype bodies would be difficult or impossible.

It is believed that it has not been realised in the prior art that design against major or disastrous failure of complex bodies can be rationally based on modelling, including computer modelling utilising the mathematical principles described herein, and mechanical modelling with small models, as well as combinations of computer modelling and mechanical modelling.

In the following, the problems involved in design against major or disastrous failure are discussed with reference to geometrically similarly shaped bodies subjected to loads from zero up to maximum load and further until total separation.

The behaviour can largely be divided in to stages:

1) where the total body is deformed with building up of increasing stresses without any substantial internal failure of the material, and
2) where local fracture and separation occurs under decreasing load, and, at the same time, release of stresses and contraction of the material in the total body outside the zone(s) of fracture—until total separation occurs.

In conventional design with respect to load-bearing capacity—e.g., in the design of reinforced concrete structures, only the first stage is taken into consideration.

The load-bearing capacity is typically determined on the basis of determinations of stresses in the body (based on specified presumptions concerning relations between stresses and strains).

The tools are typically theory of elasticity, theory of plasticity and—for the practical work—various calculation techniques such as, e.g., finite element calculations.

In general this results in expressions for the load-bearing capacity on the forms $$F \propto \sigma_0 L^2 \text{ (force)}$$

$$W \propto \sigma_0^2 E^{-1} L^3 \text{ (energy)}$$

$$\delta \propto \sigma_0 E^{-1} L \text{ (deformation)}$$

referring to load in the form of applied force, energy and displacement/deformation, respectively.

In these expressions "are hidden" model laws on the forms $$\frac{F}{\sigma_0 L^2} = constant \text{ (force)}$$

$$\frac{WE}{\sigma_0^2 L^3} = constant \text{ (energy)}$$

$$\frac{\delta E}{\sigma_0 L} = constant \text{ (displacement)}$$

These "hidden" model laws tell us that the load-bearing capacity of geometrically similarly shaped bodies of the same materials increase proportionally with the second power of the length (L)

$$F \propto L^2$$

and for displacement with the length in the first power $$\delta \propto L$$

and, for energy, with the third power of the length $$W \propto L^3$$

provided that the models provide a reasonably true picture of the realities.

However, practical experience often gives a completely different picture. The specific load capacities for geometrically similarly shaped bodies of the same material ($F/L^2$ and $W/L^3$) are not constant, but rather decrease with increasing body size (L).

Thus, in contrast to what is conventionally indicated for the conventional models, they will not be useful for scaling up, e.g., good impact resistance of 10 mm tough ceramic panels under impact from 5 g projectiles to a similar behaviour of 1 m thick giant panels of the same material under impact from 5000 kg penetration missiles.

With similarly shaped projectiles/missiles of similar material attacking at the same velocity, the length scale has become 100 times larger (the mass$\propto L^3$). This means that according to the conventional models, the panels should also be 100 times thicker, that is, about 1 meter.

Such large 1 meter thick panels made of the same ceramic material as the 10 mm panels would be crushed by the 5 tons missile, without having slowed down the missile to any particular extent.

FIG. 11 illustrates failure behaviour of geometrically similar bodies of identical material under loading by rigid, strong penetrating bodies with identical shapes and sizes proportional with the respective bodies. The subfigures show situations where the penetration bodies are pressed down into the respective bodies with the same penetration depth relative to the body size.

Figure 11A:
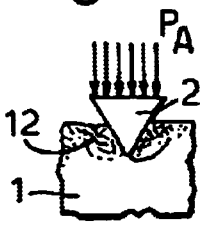
FIG. 11A–C illustrate failure behavior of geometrically similiar bodies of identical meterial under loading by rigid, strong penetrating bodies with identical shapes and sizes proportional with the respective bodies.

FIG. 11A shows a small system with a small body 1 and a small penetration body 2.

Figure 11B:
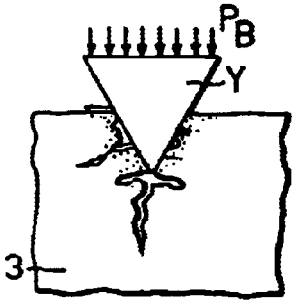
Figure 11C:
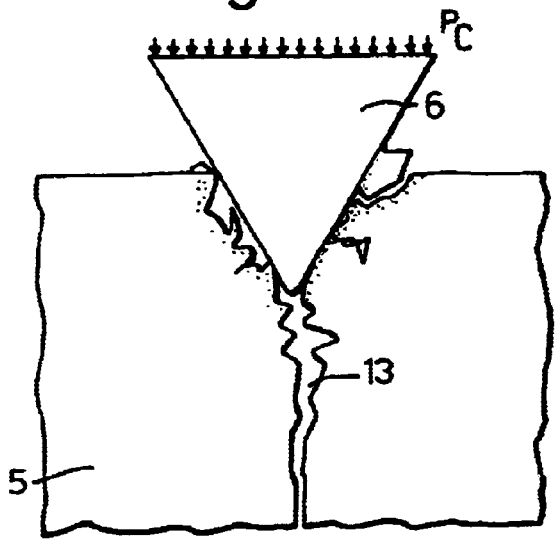

FIG. 11B shows a medium size system with a medium size body 3 and a medium size penetration body. FIG. 11C illustrates a large system with a large body 5 and a large penetration body 6.

Figure 11D:
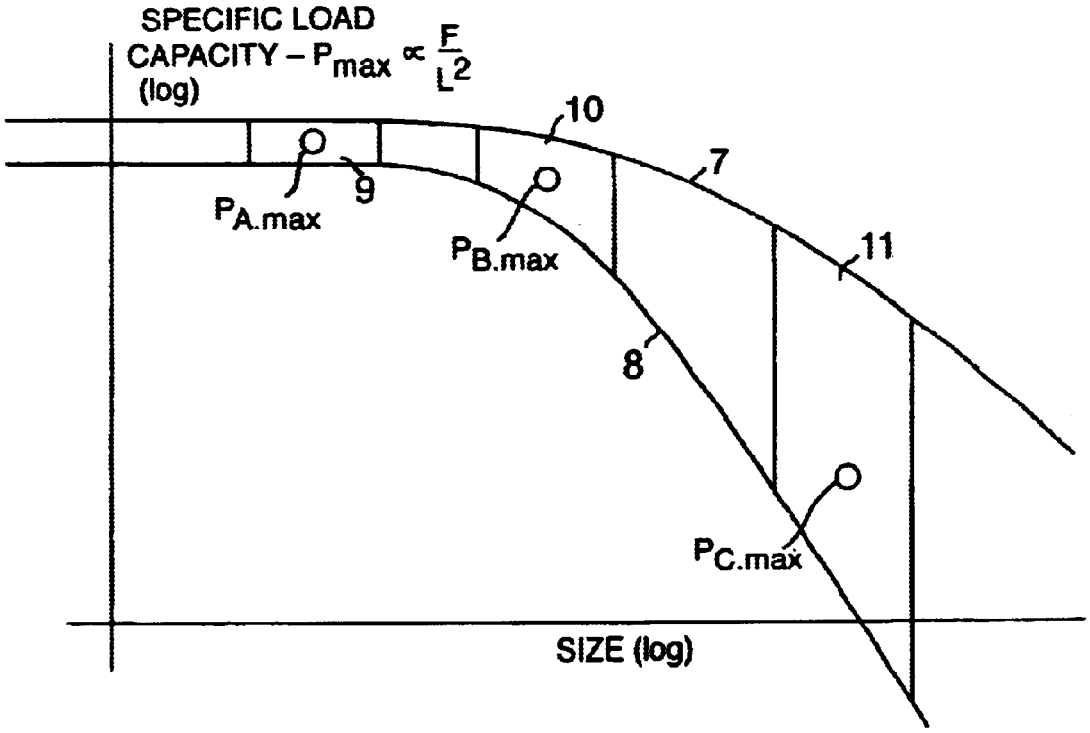
FIG. 11D illustrates the relationship between specific load-carrying capacity and size of body/system.
Figure 12A:
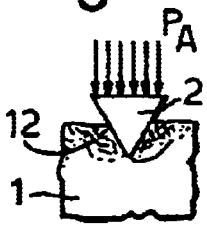
FIGS. 12A–C illustrate failure behavior of geometrically similar bodies of identical material under loading by rigid, strong penetrating bodies with identical shapes and sizes proportional with the respective bodies.
Figure 12B:
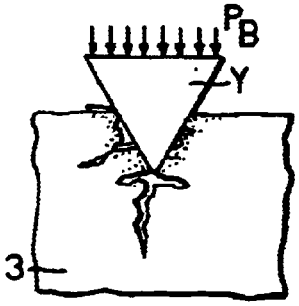
Figure 12C:
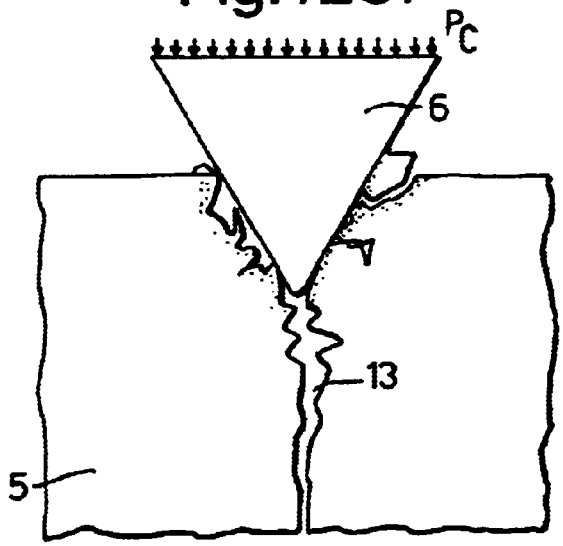
Figure 12D:
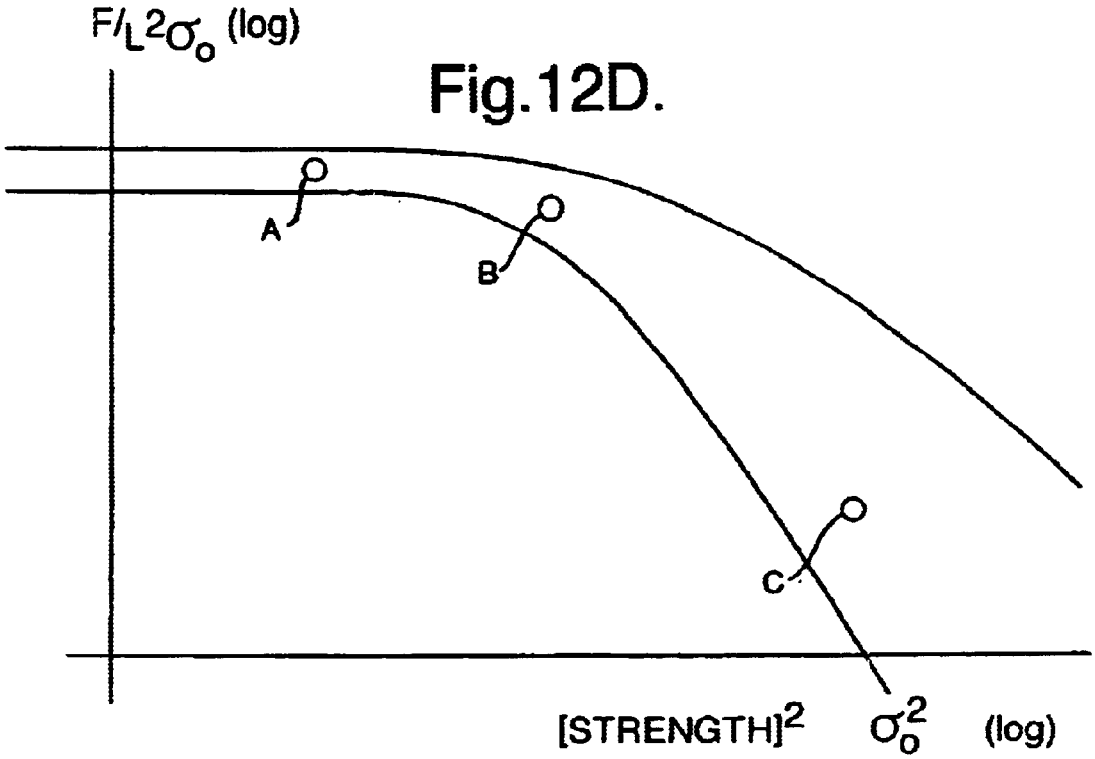
FIG. 12D illustrates the relationship between $F/L^2$ $O_o$ (log) and strength of body/system.
Figure 13A:
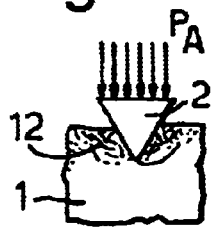
FIGS. 13A–C illustrate failure behavior of geometrically similiar bodies of identical material under loading by rigid, strong penetrating bodies with identical shapes and sizes proportional with the respective bodies.
Figure 13B:
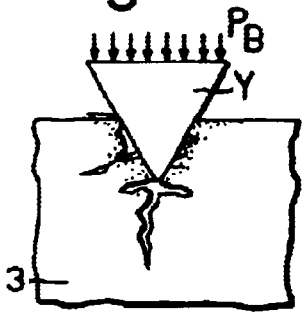
Figure 13C:
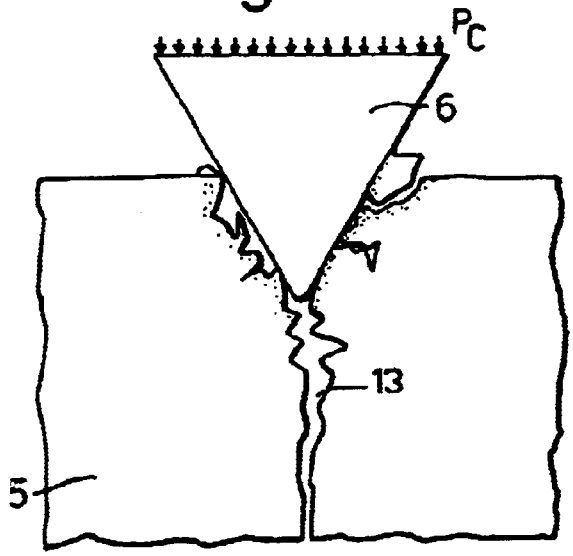
Figure 13D:
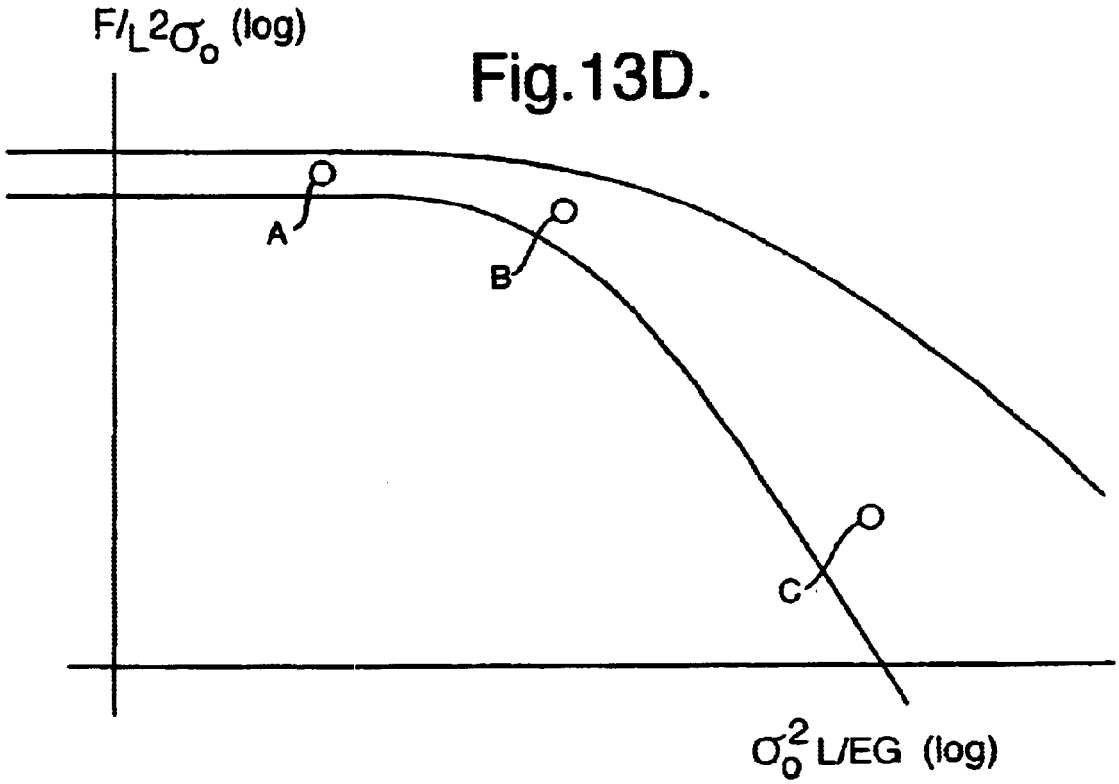
FIG. 13D illustrates the relationship between $F/LO_o$ (log) and $O_o^2$ L/EG (log)

The conical penetration bodies 2, 4 and 6 are loaded with evenly distributed pressures $P_A$, $P_B$ and $P_C$, respectively. The respective maximum pressures are a measure of the respective specific load capacities. The respective maximum pressures/specific load capacities $P_{A.max}$, $P_{B.max}$ and $P_{C.max}$ are shown in the graph of FIG. 11D showing the relationship between specific load-carrying capacity $P_{max}$ and size of body/system for this type of geometrically similar systems with bodies of identical material. The curves 7 and 8 describe the lower and upper limits as described in FIG. 11 and the vertical distance between them is a measure of the relative variations.

In the small system A, the penetration occurs with substantial plastic flow. The specific load capacity $P_{A.max}$ is large. At many similar experiments within a limited size range area 9, the variations in specific load capacity are small, and the fracture behaviours are substantially similar.

In the intermediate system B, the penetration takes place in a much more brittle manner, with pronounced formation and propagation of cracks. The specific load capacity $P_{B.max}$ is substantially smaller than in A, and the variations in specific load capacity at repetitions within a limited size range, with the same relationship between maximum size and minimum size as in A, a much larger than in A. The size range area is shown at 10; there are pronounced variations in the fracture behaviour.

For the very large systems, illustrated as C, the specific load capacity is very much lower than in the small system A and the intermediate system B. The variations within the size range area 11, with the same relative size as the corresponding size range areas 9 and 10 are enormous and far larger than the corresponding variations in the areas 9 and 10. Typically, there are very large variations in the fracture behaviour; the fracture behaviour is markedly brittle.

FIG. 11 also illustrates pronounced difference in failure mode with

A: pronounced failure by plastic flow in a flow zone 12 close to the penetration body 2.

C: pronounced brittle fracture with cleavage, with formation and propagation of a large through-going crack 13, and B showing a behaviour between A and C.

In the known art, it has not been possible to predict/calculate these behaviours in a satisfactory way, at least not for B and C. Generally, as far as these behaviours are concerned, the known art is limited to experience/experiments with bodies of substantially identical material and substantially the same sizes. The known art does not make it possible to easily transfer experience to much larger or much smaller bodies, or to bodies of other materials, such as much stronger materials. However, in the example illustrated in FIG. 11, with the small tough body A, it would, presuming an ideal plastic behaviour, often be possible to calculate the load capacity using known art plasticity theory. As far as the larger bodies are concerned, very little valuable prediction can be derived from experiments in one scale, e.g. A, with respect to predicting behaviour for geometrically similar systems in a scale which is substantially different, such as B or C.

Conventional known art principles for structural design, indicating, e.g. that the specific load capacity, $$\frac{F}{L^2},$$

is proportional to a characteristic material strength $\sigma_0$ $$\frac{F}{L^2} \propto \sigma_0$$

cannot be used, this being, in this case, clearly illustrated by the markedly decreasing values of specific load capacity at increased body size.

Known art design principles, such as the above-mentioned modelling of load capacity for geometrically similar bodies $$\frac{F}{L^2} \propto \sigma_0$$

indicate that the known art presumes behaviours with substantially the same dimensionless load capacity $$\frac{F}{L\sigma_0}$$

for similarly shaped bodies, irrespective of the size L and the material properties of the bodies.

This indicates, e.g., that with 5 times stronger material $\sigma_0$, an also 5 times larger load capacity F is obtained for a body of the same size L. It also indicates that the load capacity is independent of the stiffness E of the materials, as long as the shape deformations are so small that their importance to the total load distribution is moderate. It has been shown above, illustrated by FIG. 11, that his is not the case when the body size L is changed.

We shall now consider failure/fracture behaviour when, with otherwise identical body geometry, size, shape, etc., the strength $\sigma_0$ of the materials is changed, maintaining anything else unchanged. This is illustrated in FIG. 12, in which dimensionless load capacity, $$\frac{F}{L^2\sigma_0},$$

is shown as a function of strength, $\sigma$. By plotting $\log(\sigma_0^2)=2\log\sigma_0$ in the same scale as was used for plotting log L in FIG. 11, we obtain (subject to specific presumptions) curves substantially identical to the curves in FIG. 11.

Let us presume, as an illustration, that the bodies in the above FIG. 11 had the relative sizes:

$L_A$: 1

$L_B$: 9

$L_C$; 100 and that the corresponding specific load capacities had relative values:

$\sigma_A=1$ $\sigma_B=0.5$ $\sigma_C=0.05$

In the example with effect of strength, here in FIG. 12, we presume as a starting point the behaviour of body A from FIG. 11. This body has a plastic fracture behaviour and high relative specific load capacity.

Let us presume that the material in body A has a characteristic strength $\sigma_A$. Body B, of the same size as body A, is made of 3 times stronger material $\sigma_B=3\sigma_A$. According to known art design models, this should result in an also 3 times larger load capacity–$F_B=3F_A$, but as it is seen from the fact that the relative specific load capacity is only 0.5, the load capacity will be smaller, only half of the predicted value $$F_B=1.5F_A;\ (F_A=(3F_A)\cdot 0.5)$$

In this case, the behaviour at fracture is extremely brittle, and very different from the behaviour of body A.

In body C, extremely strong material has been used $$\sigma_C=10\sigma_A$$

with a dream of creating, correspondingly, 10 times larger load capacity, $F_C\approx 10F_A$.

However, the body shows an extremely brittle behaviour and the load capacity becomes disastrously low $$F_C=(10F_A)\cdot 0.05=0.5F_A,$$

in other words, not as intended 10 times $F_A$, but rather markedly smaller than $F_A$.

Under specific presumptions, e.g., about the same ratio between the strength of the materials in under tensile load and in compression, $$\frac{\sigma_t}{\sigma_c} = const.$$

and about identical relation between relative stresses $$\frac{\sigma}{\sigma_{\max}}$$

and absolute strains (to be discussed in the following), the relations shown in FIGS. 2 and 3 may be summarised in a master graph with the dimensionless expression $$\frac{\sigma_0^2 L}{EG}$$

as the governing parameter.

Such a summation is shown in FIG. 13. FIG. 13 illustrates a dimensionless load capacity, proportional to $$\frac{F}{L^2\sigma_0}$$

versus $$\frac{\sigma_0^2 L}{EG}$$

in a double logarithmic representation.

The reciprocal value $$\frac{EG}{\sigma_0^2 L}$$

is a measure of the fracture toughness of the body. This value is dimensionless, and, in the present specification and claims, is called ductility number or toughness number.

L is a characteristic body size (unit m)

E is the modulus of elasticity of the material (unit $N/m^2$)

$\sigma_0$ is a characteristic material strength (unit $N/m^2$)

G is the fracture energy (unit $J/m^2=N/m$).

Graphs like the one in FIG. 13 will often form the basis for Design for/prediction of structural behaviour including failure/fracture, local or global, according to the present invention. Such graphs are also unique tools for creating unique, especially very large, hard and very strong structures showing extremely high fracture toughness.

These aspects will be discussed in detail in the following. Here, an introduction will be given via two examples directly related to the FIGS. 11, 12, and 13.

Example 1

Starting with a small fracture-tough body A, let us presume that it has a thickness L of 10 mm and is made of a material having a compressive strength $\sigma_0$=100 MP, it is desired to design a) a 100 times larger geometrically similar body—L=1000 mm, of a material of the same strength $\sigma_0$ and the same stiffness E b) a body of the same size as the reference body, L=10 mm—of 10 times stronger material, $\sigma_0$=1000 MPa where both bodies are intended to show the same fracture toughness as the reference body A.

The large body a) is intended to show a 100×100=10,000 times larger load capacity $$F\ \left(\text{the same specific load capacity } \frac{F}{L^2}\right).$$

The small strong body b) of a 10 times stronger material is to have a 10 times higher load capacity.

As illustrated in FIGS. 2 and 3, the behaviours will be disastrously inferior in both cases if no other changes were made than in a), to increase the size by a factor 100 in b), to increase the strength by a factor 10 ($\sigma^2$ by a factor of 100).

In both cases, a behaviour like the one shown in FIG. 11C will result, with brittle fracture behaviour and load capacities of only 5% of what was intended.

According to the principles illustrated in FIG. 13, the requirement is that for a) and b), a structure should be established so that there is the same "toughness number"

$$\frac{EG}{\sigma_i^2 L}$$

(see further below) as in the reference body, indicated at A in the figure. This means that in a), where $\sigma_0$ and E are the same as in the reference body, the fracture energy G should be increased proportionally to the increase of the size L $$G = G_{ref}\frac{L}{L_{ref}} = 100G_{ref}.$$

in b), where the size is unchanged and the material strength $\sigma_0$ is increased by a factor 10, it is required that the product EG is changed:

$$EG = (EG)_{ref}\left(\frac{\sigma_0}{\sigma_{ref}}\right)^2 = 100(EG)_{ref}.$$

in b), it will "perhaps" be possible to double the modulus of elasticity using stronger and stiffer particles, and "perhaps" be possible to increase the fracture energy by a factor of 50 with fibres with a combination of higher fibre concentration and stronger fibres.

For example b), a goal which it is difficult in practice to obtain has been chosen intentionally, and the description uses the term "perhaps". An important result of predictions designs performed according to the present invention is to find logical/consistent ways to obtain what is desired, not only to obtain easy, complete solutions.

Once there is a clear identification of the goal—here the "super" body b), and a clear indication of a route to reach the goal, the technical problems to be solved to reach the goal, e.g., the requirement of creating 10 times stronger ceram matrerials and acquire/create 10 times stronger reinforcement, etc.

Example 2

Let us presume that we have succeeded in creating the above-mentioned unique bodies a) 1 giant body (thickness 100 mm)

b) 1 ultra-strong body ($\sigma_0$=1000 MPa)

having the desired load capacity and the desired high fracture toughnesses.

Starting from this, it is desired to make, for each of the categories, larger or smaller modification, e.g., 1) to fulfil special requirements, e.g. with respect to resisting specific impact loads, 2) for ensure a better economy 3) to ensure a simpler/cheaper production, etc.

It will typically be very difficult/impossible/extremely expensive to make such changes in design based on full-scale experiments with the very large or very strong bodies, respectively. Using the design principles of the present invention, there now is a tool for designing rationally and physically consistently via realistic model testing in a scale selected suitably with respect to body size L and materials.

It also gives a large spectrum of possibilities for model design with much smaller or much larger models, with much weaker or much stronger materials, etc., all this governed by the requirements to the toughness numbers.

As mentioned above, practical experience shows that it is not generally possible, by use of conventional models, to perform realistic scaling up for fracture and failure of bodies, in particular, this is not possible for complex systems, that is, systems containing large reinforcement, systems showing anisotropic properties, systems showing direction-dependent properties, systems showing mechanical properties that are not homogeneously distributed, systems showing a complex failure behaviour including fracture which goes beyond pure tensile fracture, systems showing major shape changes as a result of physical interaction, and systems having higher degrees of complexity in that they combine two or more of these elements of complexity.

However, the present invention provides a new method of predicting mechanical behaviour of a complex system which method can be used also for designing large to very large bodies which show extremely high impact resistance.

The modelling and design tools according to the present invention are to a great extent based on the resources available for establishing resistance to fracture separation.

Typically, the separation takes place in narrow zones. The local work of separation can often suitably be expressed as $$W_G \propto L^2 G$$

in which the fracture energy G (N/m) is the work of separation per area. When this is taken into consideration, model laws result which are on the form $$\frac{F}{GL} = const. \text{ (force);}$$

$$\frac{W}{GL^2} = const. \text{ (energy);}$$

$$\frac{\delta\sigma_0}{G} = const. \text{ (deformation).}$$

For large bodies, the separation work ($W_G$) is normally very small compared to the work applied to the body up to maximum load ($W_E$).

For a 10 times smaller body of the same material, the separation work is 100 times smaller, but at the same time, the work applied is $10^3$=1000 times smaller. This means that the separation work has become relatively larger, that is, by a factor of 10. The specific energy capacity $$\left(\frac{W}{L^3}\right)$$

has become about 10 times larger.

Thus, the present invention relates to a method for predicting mechanical behaviour, and/or the effect of mechanical behaviour, of a body B of a system A including the body and subjected to a physical influence P, the mechanical behaviour including fracture of the body B or of a part of the body B as a result of the physical influence, the system A being complex in that the body B is built up as a composite body, and the fracture of the body B or the part thereof is complex., i.e., includes tensile fracture and fracture other than pure tensile fracture, the method comprising providing a model M of the system A, the model M including a model, designated $B_{model}$, of the body B, or of the part thereof, the modelling including modelling based on parameters relating size and mechanical behaviour of the body B or the part thereof, the parameters including parameters related to fracture, at least one of these parameters related to fracture being a parameter which is not solely related to tensile fracture, performing, on the model system M, a modelling of the physical influence P, recording the behaviour of the model body $B_{model}$ resulting from the influence, including the complex fracture behaviour thereof and/or the effect of said complex fracture behaviour, and determining the predicted mechanical behaviour of the body B or the part thereof, including the complex fracture behaviour of the body B or the part thereof, and/or the effect of the complex fracture behaviour, by transferring the recorded behaviour of the model body $B_{model}$ to predicted behaviour of the body B or the part thereof by the use of one or more algorithms which include the above-mentioned parameters.

In many important embodiments, the model M is a physical model, and the model body $B_{model}$ is geometrically similar to the body B, or the part of the model body $B_{model}$ corresponding to the part of body B which is subjected to fracture is geometrically similar to the corresponding part of the body B which is subjected to fracture, but differs from the body B or the part thereof in that 1. the materials of the model body $B_{model}$ differ from the corresponding materials of the body B or the part thereof by having mechanical properties, including mechanical properties decisive for complex fracture, which are different from the mechanical properties of the body B, and
2. the size of the model body $B_{model}$ optionally differs from the size of the body C, the relationship between the size and the materials of the model body $B_{model}$ and the size and the materials of the body B or the part thereof being such that the ratio between at least two of the size/behaviour-related parameters decisive to complex fracture behaviour is identical or substantially identical in the model body $B_{model}$ and in the body B (or the part thereof), the at least two parameters including at least one parameter which is not a parameter solely related to pure tensile fracture, or the said ratio differs from being identical or substantially identical by a known or assessible correction function, in which case the method comprises subjecting the model system to a physical influence $P_{model}$ which is adapted so that it is geometrically and dynamically similar to the physical influence P, recording the behaviour of the model body $B_{model}$ resulting from the influence, including the complex fracture behaviour thereof and/or the effect of said complex fracture behaviour, and determining the predicted mechanical behaviour of the body B or the part thereof, including the complex fracture behaviour of the body B or the part thereof, and/or the effect of the complex fracture behaviour, by transferring the recorded behaviour of the model body $B_{model}$ to predicted geometrically similar behaviour of the body B or the part thereof by the use of one or more algorithms which include the above-mentioned at least two parameters and, if necessary, the above-mentioned correction function.

It will be understood that in most cases, there will be no correction function; the method will be performed so that the ratios are identical or substantially identical, but it is evident that a function, e.g. a factor, could be applied, and a corresponding adjustment correction could then be applied in the later processing, and this shall not bring the method outside the scope of the present invention.

When the model is an analytical model, the modelling and the determination of the predicted mechanical behaviour are performed using a suitably programmed computer system having suitable means for storing and retrieving the relevant data. One interesting aspect is that the building up of data based on sufficiently larger numbers of physical model experiments may be result in a database that in some cases can replace or supplement the information otherwise obtained by physical modelling. The modelling may also comprise a combination of a physical model and an analytical model, the physical modelling being performed as explained above, and information from the behaviour recorded in the physical modelling being used in the analytical modelling.

The design and modelling principles according to the present invention combine the existing (in themselves insufficient) model laws with models describing the second stage (post-fracture) behaviour into a unique complete model law complex.

It will be understood that in the present context, the prototype system is the system the properties of which are to be predicted, e.g. a system which is to be built or produced or an existing system, such as a building or a dam, which is to be analyzed for, e.g. safety, and the model system is the system which, subject to the relations and parameters to be used according to the invention, is made to represent the prototype system, but normally in a different physical size as represented, e.g., by a different length parameter.

In the following, a number of details and features of the method and other aspects of the invention will be discussed, but it should be noted that not all detailed embodiments of the invention are discussed here, as the contents of claims 41–130, which are believed to be self-explanatory, should be considered part of the present disclosure.

The analytical modelling according to the invention will normally include a parameter describing relationships between characteristic size L and material properties of the prototype system, including modulus of elasticity E, tensile strength at and fracture energy, such as a tensile fracture energy G.

It is preferred that the parameter describing relationships between characteristic size L and material properties of the prototype system is a dimensionless parameter. A most suitable dimensionless parameter is the parameter $$\frac{EG}{\sigma_f^2 L}$$

which can be considered the expression for toughness, the "toughness number", and is a preferred key for the novel predictive design.

The expression tells us what is required to obtain the same unique—up-scaled—behaviour of giant bodies as with the small tough 10 mm ceram panels A.

Let us assume that it is desired to maintain the high strength ($\sigma_0$) and the high stiffness (E) and is desired to make 100 times larger bodies (1 m thick panels). It is seen that this can, in principle, be obtained if materials are designed with largely the same strength and stiffness, but with 100 times larger fracture energy G.

The design of such materials is possible in practice. Composite materials/structures built up of hard, strong matrix materials with extreme fracture toughness and strong and high volume reinforcement are known, e.g., from the patent literature, for example, from U.S. Pat. No. 4,979,992.

An example of the scaling principles underlying the present invention is as follows:

1) In small 5 mm thick bodies is used, e.g., reinforcement in the form of 1 mm thread and a matrix with fine 0.01 mm fibres and fracture energy 1 kN/m.
2) In somewhat larger 50 mm thick bodies (factor 10), the reinforcement is 10 mm rods. The matrix is of the same type as before, but has been given additional toughness by means of 0.1 mm fibres; the fracture energy is 10 kN/m.
3) In large 500 mm thick bodies (factor 100) are used, e.g., rods of diameter 100 mm, and the matrix had been given additional toughness using fibres of diameter 1 mm. The fracture energy has now been increased to about 100 kN/m
4) In giant bodies of 5 m thickness (factor 1000) the reinforcement consists of composite reinforcement bodies of diameter 1000 mm. The toughness of the matrix has been further increased by incorporation of small rods of diameter 10 mm. The fracture energy has now been increased to about 1000 kN/m. It should be noted that the increase in fracture energy from 1 kN/m to 1000 kN/m is not obtained solely by up-scaling the toughening fibres of diameter 0.01 mm to 10 mm diameter rods; as an essential feature, the matrix is also given a corresponding 1000 times larger fracture energy, typically using fibres on several levels.

It will be seen that the design of the large bodies is strongly guided by design principles which are also used in another aspect of the invention to be discussed below—with scaling on several levels.

Using the design/modelling strategy of the present invention it has now become possible to design bodies and structures taking fracture and failure into consideration, based on model experiments performed in a scale which differs dramatically from the scale of the prototype, for instance with length scales $L_{prot}/L_{model}$ (or $L_{model/Lprot}$ in cases where the model is the larger) between 2 and 1000 or even higher than 1000, such as length scales between 3 and 5 between 5 and 10 between 10 and 30 between 30 and 100 between 100 and 1000 and larger than 1000.

This makes it possible to perform model experiments in small scale which will, nevertheless, give valid information relating to the design of unique very much larger bodies/structures capable of resisting enormous concentrated loads, including large high velocity impact loads.

Because of the possibilities which have been provided, according to the above-described structure aspects of the present invention, for designing very large structures having 1000 to 10000 times larger fracture energy than corresponding small bodies, the design/modelling principles according to the present invention are valuable tools for performing the actual design of a large structure for a particular purpose based on computer and/or mechanical modelling.

The analytical modelling performed according to the invention may be computer modelling and/or physical modelling.

The physical modelling is typically mechanical modelling, such as, e.g., where the prototype is a solid structure and the model is a geometrically substantially similar solid structure, with "tailor-made" mechanical properties adapted according to the model laws.

Thus, for example, for modelling the behaviour of a 10 meter body by means of a 10 cm model, the model is provided with a value for $$\frac{EG}{\sigma_0^2 L}$$

which is substantially identical to the value for the prototype. This means that for the 100 times smaller model ($L_{model}/L_{prototype} \approx 1/100$)

$$\left[\frac{EG}{\sigma_0^2}\right]_{model} \approx \frac{1}{100}\left[\frac{EG}{\sigma_0^2}\right]_{prototypel}$$

This is typically obtained with stronger materials ($\sigma_0$) and less fracture-tough materials (G).

A special aspect of the invention deals with the "tailor-making" of internal components—such as reinforcement, not only with respect to properties (strength, stiffness, etc.), shape and volume concentration, but also with respect to absolute size (d). Thus, in example 1 of WO 98/30769, two 200 mm panels ($L \approx 200$ mm) reinforced with 25 mm diameter (d) steel bars "caught" a 47 kg amour-piercing shell with diameter about 150 mm ($d_{ap}$) (velocity 482 m/sec) more or less as a dart arrow is caught by the dart board. In an up-scaled version of that behaviour, modelled according to the principles of the present invention, it is predicted that the same unique behaviour will be obtained with 10 times larger system—scaled up according to the invention, to "catch" a $10^3$ times larger amour piece shell: 47 tons, diameter $d_{ap} \approx 1500$ mm.

The conditions for obtaining similar behaviour for the prototype include the following criteria:

$$\frac{L_{prot}}{L_{model}} \approx \frac{d_{prot}}{d_{model}} \approx \frac{(d_{ap})_{prot}}{(d_{ap})_{model}} \approx 10$$

$$\text{and } \left(\frac{EG}{L\sigma_0^2}\right)_{prot} \approx \left(\frac{EG}{L\sigma_0^2}\right)_{model} \text{ (overall toughness number)}$$

$$\text{and } \left(\frac{EG}{d\sigma_0^2}\right)_{prot} \approx \left(\frac{EG}{d\sigma_0^2}\right)_{model} \text{ (local toughness number)}$$

A special aspect of the invention relates to modelling articles with materials with anisotropic mechanical behaviour. Thus, e.g., anisotropic behaviour typically applies for bodies which are reinforced substantially in one direction or substantially in one plane (laminates). According to the invention, similar behaviour in model and prototype is typically ensured by scaling similar anisotropic reinforcement.

One condition for similar behaviour is that there are equal values of $$\frac{\sigma_{tx}}{\sigma_{ty}}, \frac{E_x}{E_y} \text{ and } \frac{G_x}{G_y}$$

in model and prototype.

The modelling principles according to the present invention provide tools for modelling mechanical behaviour involving fracture for bodies with matrix materials which have properties which are different in different positions. This is illustrated in FIG. 14 which shows sections of matrix bodies with properties varying with the position.

Figure 14A:
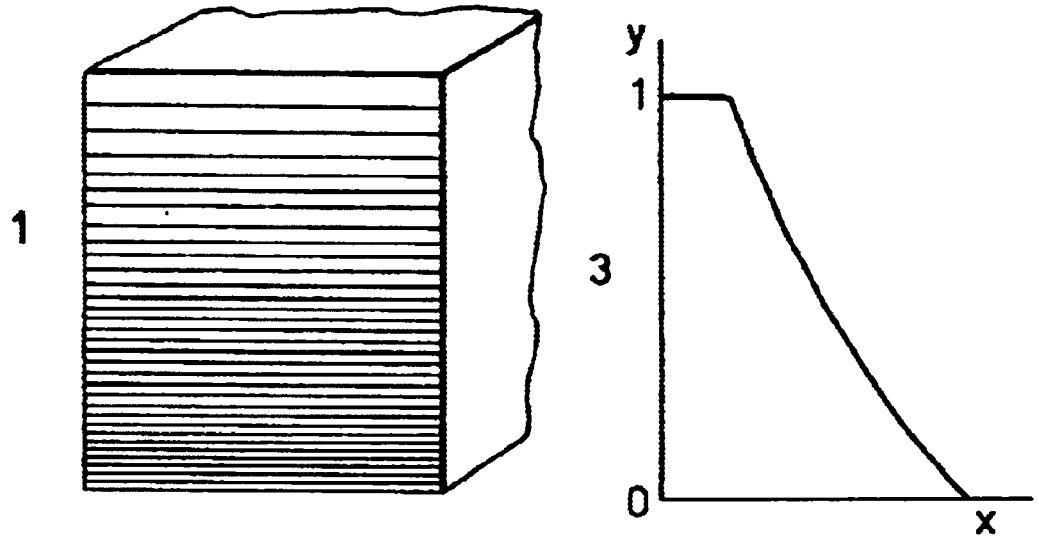
FIG. 14A illustrates a body in which the properties vary continuously from top to bottom, with the largest value in the bottom, illustrated by the largest X values and by the most dense hatching in the front section.
Figure 14B:
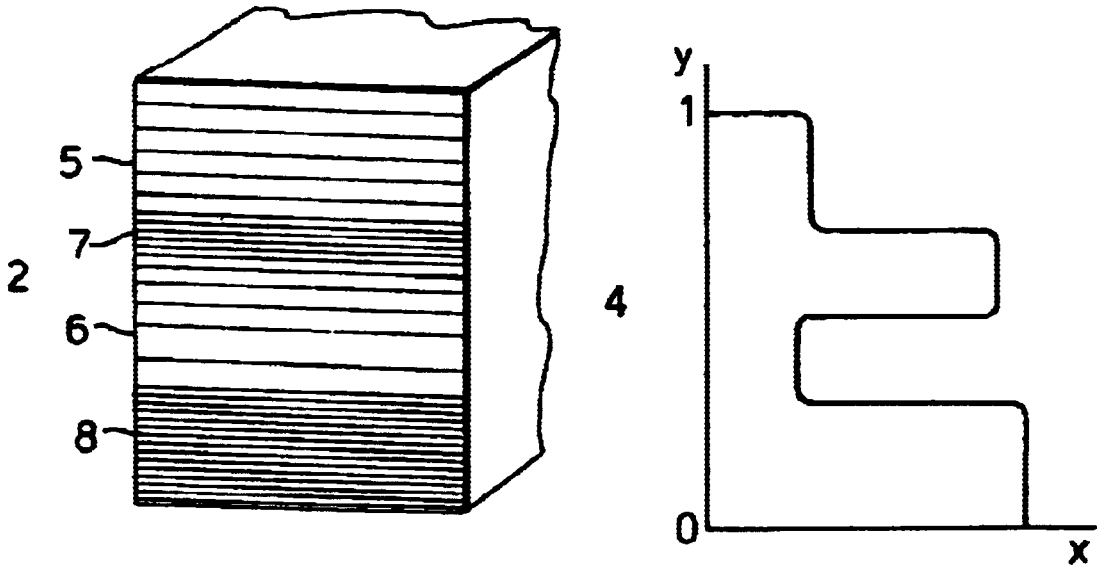
FIG. 14B illustrates a body with a discontinuous distribution of properties, with zones in which the values of the property are relatively low, and zones in which the values of the property are relatively thin.

FIG. 14 shows bodies 1 and 2 with material properties varying with position. Quantitative measurements are indicated hatched in front sections and are depicted in appertaining graphs 3 and 4 in which X is the value of the property, and Y is the position. A illustrates a body in which the properties vary continuously from top to bottom, with the largest value in the bottom, illustrated by the largest X values and by the most dense hatching in the front section. B illustrates a body with a discontinuous distribution of properties, with zones 5 and 6 in which the values of the property are relatively low, and zones 7 and 8 in which the values of the property are relatively high.

The property or properties in question may, e.g., be strength, modulus of elasticity, density, or fracture energy.

In model experiments it is required that the same properties vary with the positions in the same manner. This means that the models and the prototypes should have substantially the same relative values of the specific properties as function of the position, for example, $$\left(\frac{\sigma_y}{\sigma_0}\right)_{model} \approx \left(\frac{\sigma_y}{\sigma_0}\right)_{prototype}$$

wherein "y" indicates relative position, and "0" indicates a reference position, and analogously for other properties.

Relative positions are indicated by distances from a reference point divided by a characteristic length of the body.

Thus, when the properties that are not homogeneously distributed are one or several properties selected from tensile strength ($\sigma_t$), modulus of elasticity (E) and tensile fracture energy ($G_t$), the dimensionless parameters used in the modelling are parameters relating corresponding relative values of properties selected from $$\frac{\sigma_{tx}}{\sigma_{tr}}, \frac{E_x}{E_r}, \frac{G_{tx}}{G_{tr}}$$

$$\frac{\sigma_{ty}}{\sigma_{tr}}, \frac{E_y}{E_r}, \frac{G_{ty}}{G_{tr}}$$

$$\frac{\sigma_{tz}}{\sigma_{tr}}, \frac{E_z}{E_r}, \frac{G_{tz}}{G_{tr}}$$

to corresponding relative positions $$\frac{x}{L}, \frac{y}{L}, \frac{z}{L},$$

index r referring to reference properties in a reference position.

The modelling may comprise modelling of a complex failure behaviour including fracture which goes beyond pure tensile fracture, in which case the modelling will include parameters describing other failure parameters than tensile failure parameters, such as one or more parameters describing compressive strength $\sigma_c$, e.g., a dimensionless strength ratio $$\frac{\sigma_c}{\sigma_t}$$

between compressive strength $\sigma_c$ and tensile strength at of the body.

FIG. 14 show bodies which have properties varying in one direction, the y direction. In the method of the invention, it may be desired to model matrix bodies with properties varying in two or all three directions in accordance with the above principles.

Of special interest in the present context dealing with fracture are matrix bodies in which the fracture toughness varies with the positions as well as modelling of the fracture behaviour of such matrix bodies, including modelling of composite structures containing such matrix bodies.

Typically, this will be done using model experiments in which conditions about $$\left(\frac{\sigma_y}{\sigma_0}\right)_{model} \approx \left(\frac{\sigma_y}{\sigma_0}\right)_{prototype} \text{ and}$$

$$\left(\frac{\frac{G_y E_y}{\sigma_y^2}}{\frac{G_0 E_0}{\sigma_0^2}}\right)_{model} \approx \left(\frac{\frac{G_y E_y}{\sigma_y^2}}{\frac{G_0 E_0}{\sigma_0^2}}\right)_{prototype}$$

are fulfilled to a reasonable or substantial extent.

A special aspect of the invention is to ensure a desired fracture toughness, and desired fracture toughness variations, by building up matrix bodies in which a desired fracture toughness is controlled/established by incorporation of fibres or fine bars or rods. Thus, by incorporating fibres in varying amounts and/or with varying sizes etc., it will be possible to vary fracture energies corresponding to factors 100 to 1000 by producing the matrix bodies from basic matrices, without or with a specified smallest value of volume of fibres/bars or rods, into which are mixed more fibres/bars or rods, adapted to the positions at which the specific mixtures are to be incorporated in the matrix body.

Another important aspect of the invention comprises modelling of fracture involving major strains, where a reasonably correct simulation of strains becomes essential. Such behaviour typically applies at impact with strong solid bodies penetrating into the structures in question where the local strains in the contact zones are typically very large. The size of the deformations is of decisive importance for how the forces are transferred, and thereby of decisive importance for the entire failure-fracture behaviour. Not only the shape changes in fracture zones, but also shape changes outside fracture zones should be included in the modelling according to the invention.

Simulation of the behaviour requires similar relations between relative stresses $$\left(\frac{\sigma}{\sigma_0}\right)$$

and absolute values of strain ($\epsilon$) in model and prototype. For example, there may be suitable model systems in which the strengths are down to 1/100 of the strengths of the prototype, or 100 times larger, but always with fracture strain ($\epsilon_0$) substantially equal to the fracture strain of the prototype.

Figure 15A:
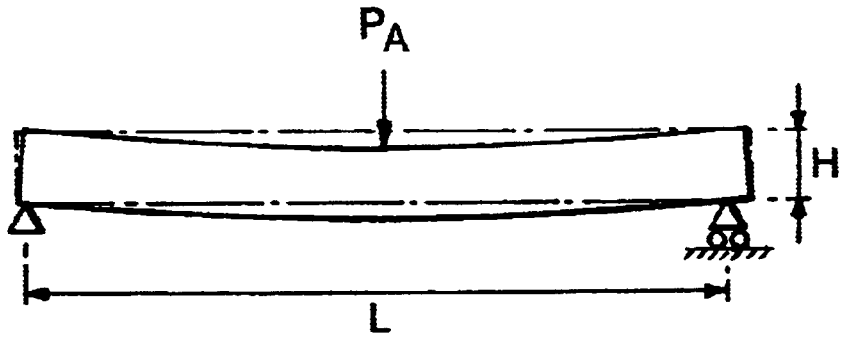
FIGS. 15A–C illustrate linear elastic behavior (bending) of a member of an initial length L under transverse loading with forces $P_A$ and $P_{Bending}$ respectively, the members showing linear elastic behavior.
Figure 15B:
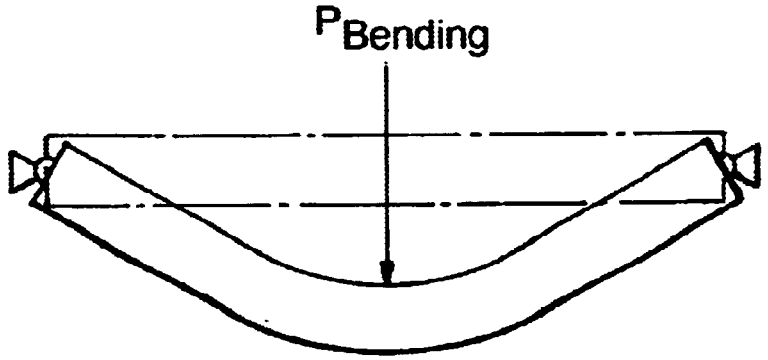
Figure 15C:
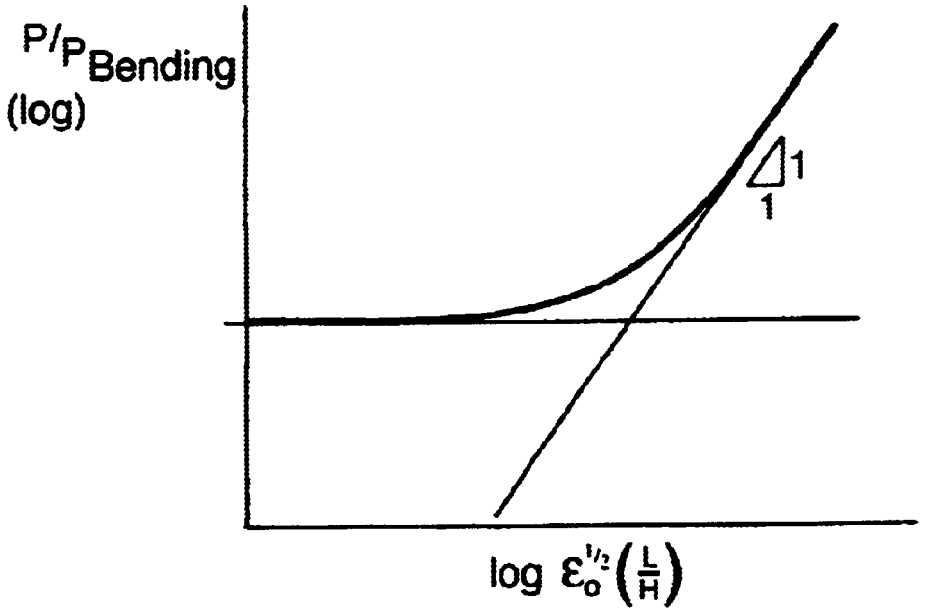

The concept of modelling failure/fracture with models in which the conditions concerning similar relations between relative stresses $$\left(\frac{\sigma}{\sigma_0}\right)$$

and absolute values of strain ($\epsilon$) in model and prototype are fulfilled is not only relevant/essential in connection with simulation of behaviour in local failure/fracture zones. FIG. 15 illustrates an example in which global strains are essential for the behaviour.

FIG. 15 illustrates members A and B of an initial length L under transverse loading with forces $P_A$ and $P_B$, respectively, the members showing linear elastic behaviour.

FIG. 15 also shows a graph of $P/P_{Bending}$ as a function of $$\varepsilon_0^{1/2}\left(\frac{L}{H}\right)$$

in which P is the actual force required to produce critical strain—fracture strain $\epsilon_0$. $P_{Banding}$ is the calculated force required to provide critical strain so under the classical assumptions of pure bending behaviour with small deflection (see member A), L is the initial length, and H is the thickness of the member. For small values of $$\left(\varepsilon\left(\frac{L}{H}\right)\right)^2,$$

the members function substantially in bending as shown for member A. The load capacity is proportional to the strength of the material, independently of the fracture strain $\epsilon_0$. For large values of $$\left(\varepsilon\left(\frac{L}{H}\right)\right)^2,$$

the members function substantially in tension, like a membrane, as shown for member B. The load capacity increases with increasing fracture strain $\epsilon_0$, being proportional with the product of strength and the square root of the fracture strain $\epsilon_0$.

For transversely loaded bodies with bending behaviour, A, the behaviour at failure/fracture is independent of absolute strain and may be simulated by model experiments which, in addition to the fracture conditions with respect to strains only require similar relations between relative stress $$\left(\frac{\sigma}{\sigma_0}\right)$$

and relative strains $$\left(\frac{\varepsilon}{\varepsilon_0}\right)$$

in model and prototype.

For the often preferred special composite structures according to this invention and related inventions, made with very strong reinforcement in strong, rigid, extremely fracture-tough matrix and showing very large strain capacity, a far larger load capacity is obtained, partly due to utilisation of membrane effect, as illustrated for member B of FIG. 15. As it appears from FIG. 15, member B, this essential behaviour characteristic in these special structures is decisively dependent on absolute strain. Modelling of such systems under failure/fracture is therefore, according to the invention, dependent on similar relations between relative stress $$\left(\frac{\sigma}{\sigma_0}\right)$$

and absolute strain ($\epsilon$) in model and prototype to simulate both local and global failure/fracture behaviour.

A characteristic feature of the modelling according to the invention is to work with models which differ fundamentally in absolute size and with respect to specific properties, but which are coupled through the requirement that fundamental governing parameters relating properties and sizes, such as $$\frac{EG}{\sigma_f^2 L},$$

have substantially identical values in prototype and model.

In many cases, models are used which do not differ much from the prototypes with respect to size and properties. This will, for example, be the case where, based on positive experience about failure, fracture behaviour of fracture-tough reinforced concrete elements in one size L, it is desired to design geometrically similar reinforced concrete elements with sizes L' which are not substantially different from L, such as where L'/L is in the range of 1.5–10, such as in the range of 2–5, or in the range of 5–10, or, conversely, in the range of 0.1–0.8, such as in the range of 0.2–0.5, or in the range of 0.1–0.2, and with matrix materials with substantially identical strengths, stiffnesses and densities, showing substantially similar fracture-tough behaviour. In such cases, which are often relevant in practice, the task will be, with basis in the principle of the invention, that is, with basis in the condition about substantially identical values of $$\frac{EG}{\sigma_f^2 L},$$

to modify the fracture energy of the matrix material accordingly.

Let it be assumed, as an example, that the matrix material in the reference element had been provided with fracture toughness with fracture energy of 2000 N/m using 2 vol % of fibres 20×0.4 mm. To obtain similar failure/fracture behaviour with larger or smaller similarly shaped elements, respectively, it is required, provided substantially identical values of strength c and modulus of elasticity E, that fracture energies G are modified to values between 200 N/m for L'/L=0.1 and 20.000 N/m for L'/L=10.

According to the invention, this is typically done by 1. scaling of the fibre size such as, e.g., use of approximately 2 vol % of fibres/rods 2×0.04 mm for L'/L=0.1 and 200×4 mm for L'/L=10, and/or
2. change of the fibre volume, e.g. to approx. 4 vol % for L'/L=2 and 1 vol % for L'/L=0.5,
3. typically combined with modification of the particle structures of the matrix materials.

Using the scaling principles of the present invention, it is possible also to make model experiments in scales which differ very much from the scales of the prototypes, with L'/L in the range between, e.g., between 2 and 1000 (or more than 1000), such as L'/L=10–30, L'/L=30–100, L'/L=100–1000 or larger.

This makes it possible, e.g., by model experiments with failure/fracture of small models of structures of a size of 300 mm and wall thickness 10 mm to simulate behaviour of similar large or giant structures with, e.g.,

| Size≈ | and wall thickness | for L'/L |
|---|---|---|
| 3 meter | 100 mm | 10 |
| 9 meter | 300 mm | 30 |
| 30 meter | 1 m | 100 |
| 300 meter | 10 m | 1000 |

The possibilities of making such small scale model tests provide novel and unique design tools.

Thus, it will be possible with 100 small precision model experiments to relatively cost-economically investigate a large number of combinations of structures, materials and influences. This would be unthinkable in practice with large structures, say, size 30 m and wall thickness 1 m or size 300 m and wall thickness 10 m. In such situations, with large structures, when major failure/fracture is concerned, the known art provides no useful design basis beyond sparse experience with failure of similar large structures.

The model technique according to the present invention may also be used to predict behaviour of large existing structures, such as large concrete dams, under accidental overloading. With small scale testing according to the invention in, e.g., scale 1:100 or 1:1000, it now becomes possible by, e.g., 10–100 model experiments in small scale, to investigate effects of a wide range of various types of influences.

Another important aspect of the modelling of failure/fracture according to the invention is design of novel micro structures especially adapted to resist overloading without major failure/fracture, based on model experiments in larger scale with $$\frac{L_{model}}{L_{prot}}$$

between 5 and 1000 or larger than 1000, such as between 10 and 30, or between 30 and 100, or between 100 and 1000, or larger than 1000.

By, e.g., simulating behaviour of micro composite structures with thread reinforcement with diameter 1–10 $\mu$m in 100 to 1000 times larger models, it becomes possible to work with reinforcement with diameter 0.1–1–10 mm. Thereby, it becomes possible to relatively easily create potentially interesting configurations, established, for example, by sewing, knitting, etc., which it would be very difficult or cumbersome to establish in micro scale. If, by such model experiments, interesting reinforcement configurations have been found, a goal for further development work with the specific micro structures has been created. If similar configurations can be created in the further development work, the model experiments have shown that it is possible to thereby create micro structures to resist overloading without major failure/fracture. Without such a guidance obtained through model experiments in large scale, knowledge about these possibilities might never have been obtained.

By such model experiments in large scale, with, e.g., reinforcement components between 1 and 10 mm diameter and matrix materials based on particles, binders and fibres, it is, e.g., typically possible to investigate failure/fracture behaviour over a large range of values of the governing dimensionless parameter $$\frac{EG}{\sigma_f^2 L}$$

varying with factors 1–100 or even 1–1000 or more. This is, inter alia, related to the fact that be incorporation of fibres (up to about 10 vol %), the fracture energy G can typically be increased by a factor 100 to 1000 compared to the value for the matrix material without fibres. This provides excellent design/prediction possibilities for evaluating the effect of providing the matrix of the micro structures with corresponding fracture toughness $$\left(\frac{EG}{\sigma_f^2 L}\right)$$

which it would be very difficult/cumbersome and in some cases even impossible to arrive at by direct experiments with the micro structures.

As mentioned above, scaling according to the invention is often used with models with properties which do not differ very much from the properties of the prototypes. However, based on the same considerations as mentioned above, the invention provides excellent possibilities for making realistic failure/fracture model tests with model materials which differ fundamentally from the corresponding properties of the prototypes.

Thus, in small scale model testing of large concrete dams, such as in scale 1:500 or smaller, e.g. 1:1000, it will often be advantageous to us models of very strong materials. With the condition of substantially identical values of $$\frac{EG}{\sigma_f^2 L}$$

in model and prototype, it will be seen that with a 1000 times smaller size L, a 1000 times larger value of $$\frac{\sigma_f^2}{EG}$$

is required. This requires a very brittle matrix material which may suitably be obtained with a strong DSP material without fibres—large $\sigma_f$, small G. The product of E and G in DSP materials will typically be of the order of 1/10 of E·G for concrete. This means that $\sigma_f^2$ should be 100 times the corresponding value for concrete, and correspondingly, of should be 10 times larger.

In other cases, the principles of the invention can be exploited using model materials of very modest strengths. This is typically done when model experiments in large scale are used to predict/simulate behaviour of very strong micro structures, the arguments being analogous to the above (but with the opposite sign).

By modelling, according to the invention, with materials of very small strengths, the experiments may be performed in a much simpler manner. Thus, e.g., there are unique possibilities in working with composite structures with particles, reinforcement components etc. in submatrices based on wax or plaster.

An essential aspect of the invention is modelling according to the principles of $$\frac{EG}{\sigma_f^2 L}$$

being substantially equal in model and prototype, where this condition is primarily obtained by adapting the fracture energy G.

The principles of creating fracture energy by incorporation of fibres/rods provides the possibility of varying the fracture energy over very wide ranges and thus operate with ratios $G_{prot}/G_{model}$ or $G_{model}/G_{prot}$ over a broad spectrum of ranges such as one of the following ranges:

2–5
5–20
20–50
50–200
200–500
500–2000
2000–5000, the material(s) and/or structure(s) of the model body being correspondingly adapted so that governing parameters relating properties and sizes, such as $$\frac{EG}{\sigma_f^2 L}$$

have substantially identical value in prototype and model.

This is, in practice, a very important detail in the entire scaling according to the invention, without which it would be very difficult or impossible to scale over wide ranges with respect to sizes L and properties E, σ, ρ, such as, e.g., size ranges of 1:1000 and strength ratios of 1:50.

One important aspect of the invention is modelling failure/fracture during impact. Impact velocities may vary over wide ranges. Thus collision velocity in the prototype system and/or in the model system may be in the range of 0.1–10000 meters per second, for example, in one of the following ranges, stated as meters per second:

0.1–1
1–10
10–100
100–1000
1000–2000
2000–4000
4000–6000
6000–10000.

The collision velocity in the prototype system and/or in the model system may also be larger than 10000 meters per second.

While one aspect of the invention relates to modelling of impact with velocities υ smaller than the sound velocity c for propagation of mechanical impulse in the material, another important aspect is modelling of high velocity impact where the impact velocities are larger than the sound velocity.

An essential parameter in this connection is the ratio $$\frac{\upsilon}{c} \approx \upsilon\sqrt{\frac{\rho}{E}}$$

This ratio will normally be in the range of 0.01–50, e.g., in one of the following ranges:

0.01–0.1
0.2–0.2
0.2–0.4
0.4–0.6
0.6–0.8
0.9–1.0
1–2
2–5
5–50, but it may also be larger than 50.

A special aspect of the invention relates to modelling in which gravity forces or forces of inertia play a significant role. The modelling is typically done by model tests in which the ratio between force of gravity (or force of inertia) $F_g \propto L^3\rho$, wherein is the density, a g is acceleration of gravity, and other governing forces, including force of fracture $$F \propto \sigma_f L^2 \propto \sqrt{EG} L^{3/2}$$

are identical in model and prototype.

This means, e.g., that criteria about substantially identical fracture/failure typically also involve criteria about identical values of $$\frac{gL^3\rho}{\sigma_f L^2} \approx \frac{gL\rho}{\sigma_f}$$

A special aspect of the invention involves model tests in which, primarily for the small models, this has been obtained by performing the tests in a field of inertia different from the field of inertia/field of gravity for the prototype.

With the scaling over very wide ranges made possible through the present invention, say, scaling over 1:100 or 1:1000, it has now become possible to study/predict failure/fracture of very large structures where gravity forces play a significant role, by model tests in very small scale in which the field of gravity is correspondingly significantly increased, say, by factors in the range of 100 to 1000.

This is typically done by carrying out the failure/fracture tests in centrifuges or under impact from below simulating gravity forces.

Other aspects are testing under conditions where an equivalent field of forces is applied, such as magnetic or electrical forces.

This approach has bee n made possible through the scaling principles for failure/fracture according to the invention, with modelling with very small models with which it has become practically possible to make experiments under conditions with very large a artificial gravity fields.

This opens up the possibility for new types of research on failure/fracture under earthquake for large structures, where gravity forces play a dominant role.

An important aspect of the present invention relates to scaling of the total behaviour of a system, not only the behaviour of a single object under a specified load.

In the examples above, the discussion has, in order to simplify, concentrated on borderline cases with impact against a target, the behaviour of which is of interest, by an idealised indefinitely stiff, strong body.

Real life is more complex, and the scaling principles of the present invention are capable of 1) simulating complex failure/fracture behaviour of a body and also
2) additional behaviours in a
3) total system.

Thus, for example, impact between a ship and a bridge pier gives a complex behaviour system with 1. a two body impacting system, ship and bridge pier
2. additionally complicated by the presence of a third medium, water.

In the analysis performed according to the invention, the focus may, for example, be concentrated on the building of the bridge, such as, e.g., the design of hew bridge piers. However, the focus might alternatively primarily have been on the construction of the ships, for example, in connection with design of new structures to be used in ships, such as structures for ship hulls, for example for icebreakers.

In none of these cases, or only in borderline cases, modelling in which one of the impact bodies is presumed to be "indefinitely stiff" will be satisfactory.

According to the present invention, a much more realistic modelling may be obtained by modelling the behaviour of both impact bodies in an integrated behaviour complex.

For modelling such complexes according to the invention, mechanically similar behaviour will be required for the complex system.

Thus, for example, with a solid body impact between body 1 and body 2, ship against bridge pier, where both bodies are overloaded, conditions to be fulfilled are equal ratios in model and prototype of $$\text{lengths}\frac{L_1}{L_2}$$

$$\text{strengths}\frac{\sigma_1}{\sigma_2}$$

$$\text{stiffness}\frac{E_1}{E_2}$$

$$\text{fracture energy}\frac{G_1}{G_2}$$

$$\text{density}\frac{\rho_1}{\rho_2}$$

and equal dimensionless toughness numbers $$\frac{E_1 G_1}{\sigma_1^2 L_1}$$

in model and prototype and equal $$\frac{E_2 G_2}{\sigma_2^2 L_2}$$

in model and prototype

In the example with impact "ship, bridge pier", the water is an essential part of the complex.

The behaviour is fundamentally different from corresponding impact without the presence of water, such as, e.g., in impart of a car or an aeroplane against a bridge pillar. This has to do, inter alia, with the inertia of the mass of water, as water following the ship is also to be arrested at the impact against the bridge pillar, whereas still-standing water contributes to braking the ship.

In the model scaling according to the present invention of such behaviours are used model conditions about similar ratio between involved mechanical energies for the solid bodies $$\sigma^2 E^{-1} L^3,\ GL^2,$$
$$\rho \upsilon^2 L^3$$

and energy in connection with impulse transfer to the water—$\upsilon^2\rho_3 L^3$, wherein $\rho_3$ is the density of the liquid—water.

This manifests itself, e.g., in requirement about equal values of dimensionless expressions $$\frac{\sigma^2}{\rho_3 v^2 E}, \frac{G}{\rho_3 v^2 E} \text{ and } \frac{\rho}{\rho_3}$$

in model and prototype.

Examples are solid bodies subject to overloading in a surrounding medium which may be solid, liquid, gaseous, or represent vacuum.

As an example, it may be desired to simulate, using the scaling principles according to the present invention, effect of explosion of an explosive arranged in various positions far from the surface or at the surface of a body when the body is surrounded by a) air or b) liquid or c) granulat friction material or d) solid rock, etc.

According to the invention, this task is modelled by using including relevant model laws from the relevant physics, combined, in the total system, with the expressions used according to the present invention, including also failure fracture parameters such as parameters involving fracture energy.

In the actual case with explosion, the behaviour is simulated by involving, in the model complex, conditions about equal velocity ratios in model and prototype, including explosive-detonation velocities, such as equal $$\frac{v_{det}}{v_{solid}} \text{ and } \frac{v_{det}}{\left(\frac{E}{\rho}\right)^{1/2}_{solid}}$$

and equal $$\frac{v_{det}}{v_{gas}}$$

and equal $$\frac{v_{det}}{v_{liquid}}$$

in model and prototype.

To generalize, all known expressions for mechanical behaviour, including thermal behaviour, can, where relevant and required, be included in the modelling method according to the invention where, in accordance with the principles of the invention, they are combined with the failure/fracture behaviour related to overloading formulated as model laws in accordance with general principles of similarity.

Composite Structures With Internal Structure Components and Matrices Designed With Regard to Fracture Resistance Against Specified Concentrated Influences Two categories of systems/structures are now considered:

1) open systems/structures, and—the category which is the subject of the present invention:

2) solid systems/structures.

An open system may, e.g., be a bridge, a chair or a crane structure.

A solid system may, e.g., be part of a bridge, such as a solid pier, or part of a defence structure, e.g., a solid protection panel of steel or reinforced concrete.

In open structures designed to function under specified concentrated loads, adaptation of structural design to the specific concentrated loads is commonly and widely used.

Figure 16A:
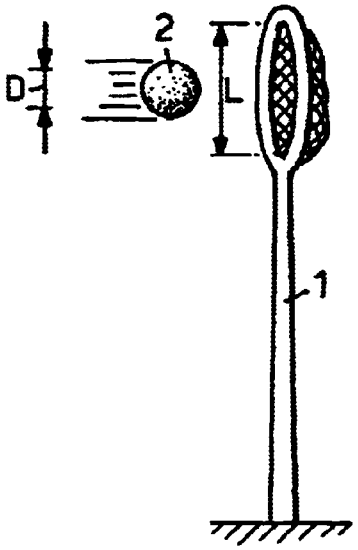
FIG. 16A shows an open system/structure illustrated as a device 1 adapted to catch an impact body 2.
Figure 16B:
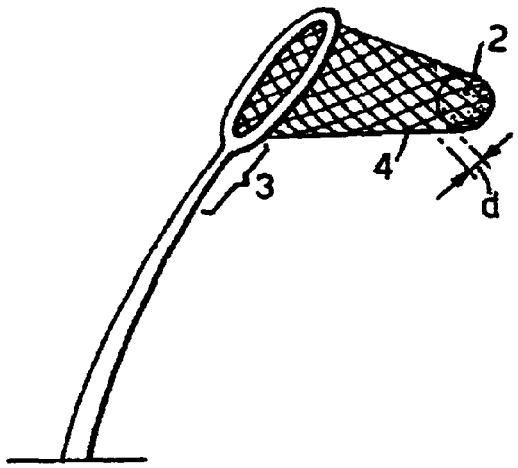
FIG. 16B shows the same system after the impact body 2 has been stopped by means of the device 1.
Figure 16C:
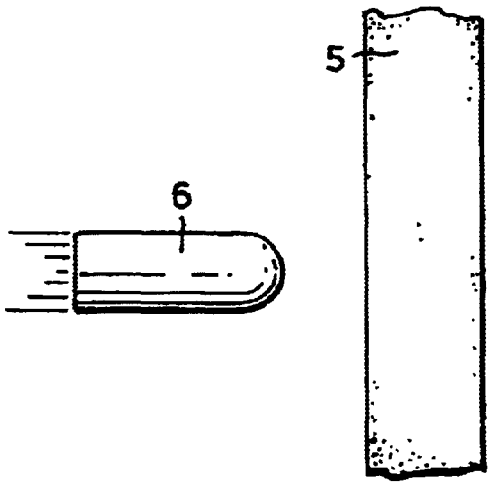
FIG. 16C and D show before and after impact against a solid body, respectively.
Figure 16D:
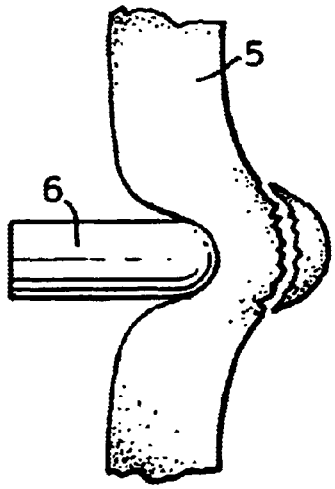

This is illustrated in FIGS. 16A and B which show a structure adapted to catch an impact body 2. FIG. 16A shows an open system/structure illustrated as a device 1 adapted to catch an impact body 2. FIG. 16B shows the same system after the impact body 2 has been stopped by means of the device 1. 3 is an elastically deformable frame, and 4 is an elastically yielding net. The structure is designed to catch the impact body in a flexible manner, with a small force and a long path of displacement, through bending of the elastic frame 3 and stretching of the elastic net 4. FIGS. 16C and D show impact against a solid body, before impact and after the impact body has been stopped, respectively. 5 illustrates a solid body, and 6 illustrates an impact body.

A desired performance is ensured by adapting the designs of the structural elements to the impact body, both with respect to forces and energies and with respect to geometric design.

Thus, for example, in the open system illustrated in FIG. 16A, the transverse dimensions of the catching area (L) are large compared to the transverse dimensions of the impact body (D), thereby enabling catching, but not unnecessarily/unsuitably large. As an example, $$L/D \approx 3\text{–}5.$$

Correspondingly, the net design is substantially optimum, with net width in strained condition (d) somewhat smaller than D, but not much smaller, for example $$d/D \approx 0.2\text{–}0.5.$$

For solid structures exposed to local influences, for example, exposed to heavy local impact as illustrated in FIGS. 3C and 3D, conventional design is almost exclusively focussed on/concentrated on 1. the exterior shapes and dimensions of solid bodies, thus, e.g., with reference to FIGS. 3C and 3D, the thickness of the body, and
2. the properties of the materials of which the solid bodies are made, typically expressed through the mechanical properties of these materials, such as through yield stress, strength, modulus of elasticity and density.

Like all other bodies, solid bodies have internal structures, that is, atomic structure, crystal structures, fibrous structures, etc. The internal structures of the solid bodies manifest themselves through the properties they confer to the materials of which the solid bodies consist.

The internal structures of the solid bodies to be exposed to impact bodies are almost never adapted, with respect to shapes and sizes in their internal structures, to the shapes and sizes of the specific impact bodies. Thus, it is conventional to say that, e.g., a solid body of tough steel must have a specific thickness (H) in order to avoid through-going penetration of a rigid strong impact body of a specified shape, size and mass and with a specified impact velocity. Analogously, it is conventional to set up corresponding thickness requirements for solid bodies of other materials, such as solid bodies of concrete of a specified quality, reinforced concrete of a specified quality, rock of a specified quality, soil of a specified quality, ceramics of a specified quality, etc.

In conventional design, it is often of minor importance or even irrelevant by means of what structure the specific material properties have been obtained. It is not conventional to use design in which the internal structures of the solid bodies are designed with special sizes adapted to the size of the bodies to which the solid bodies are exposed.

The present invention provides new hard, strong, fracture-tough solid composite structures with internal structures adapted to resist, in intimate interaction with neighbouring hard, strong, fracture-tough matrix bodies, specific concentrated loads, the composite structures being characterized in that 1) the shapes and sizes of the internal structures are adapted to shapes and sizes of the bodies which influence the composite body, the "influencing bodies", and
2) the matrix body or matrix bodies of the composite structures are provided with fracture toughnesses ($EG/\sigma^2$) adapted to the size (D) of the influencing bodies.

The invention relates to articles which are wholly or partially built up of such composite structures, and principles/methods of design of such composite structures.

As an example may be mentioned composite structures designed to resist penetration of long, rigid, strong bodies (e.g., long cylinder-shaped bodies of diameter D) where the composite structures are built up with internal structures in the form of reinforcing members (diameter d) suitably designed geometrically (shape/size) to be able, in intimate interaction with strong, hard, stiff, fracture-tough matrix with specifically adapted fracture toughness $EG/\sigma^2$, to effectively catch/stop the penetration body without the material outside the local impact zone undergoing any major destruction.

In the design of such structures, 1) the internal structure (d) of the composite material is adapted to the size (D) and shape of the impact body, for example, through the coupling parameter d/D, and
2) the fracture toughness ($EG/\sigma^2$) of the composite material is adapted to the size D of the impact body, for example, through the coupling parameter $$\frac{EG}{\sigma^2 D}.$$

Similar design principles according to the invention can be applied for design against concentrated explosive load, for example, from a chemical explosive arranged/applied concentrated on the surface of the structure, or arranged concentrated internally in the structure.

The size of explosives is typically described by 1) volume (V) or mass (M) and
2) shape.

Optimum interaction with the composite structure, for example, for ensuring only limited local damage, is obtained by geometric adaptation of the shapes and sizes (diameter d) of reinforcing members and of the matrix fracture toughness ($EG/\sigma^2$), for example, by using the coupling parameters $$\frac{d}{V^{1/3}} \approx \frac{d\rho_*^{1/3}}{M^{1/3}} \text{ and}$$

$$\frac{EG}{\sigma^2 V^{1/3}} \approx \frac{EG\rho_*^{1/3}}{\sigma^2 M^{1/3}}$$

wherein $\rho^*$ is the density of the explosive.

FIG. 17 illustrates penetration of impact bodies in composite structures built up of matrix materials with embedded interlaced reinforcement nets.

Figure 17A:
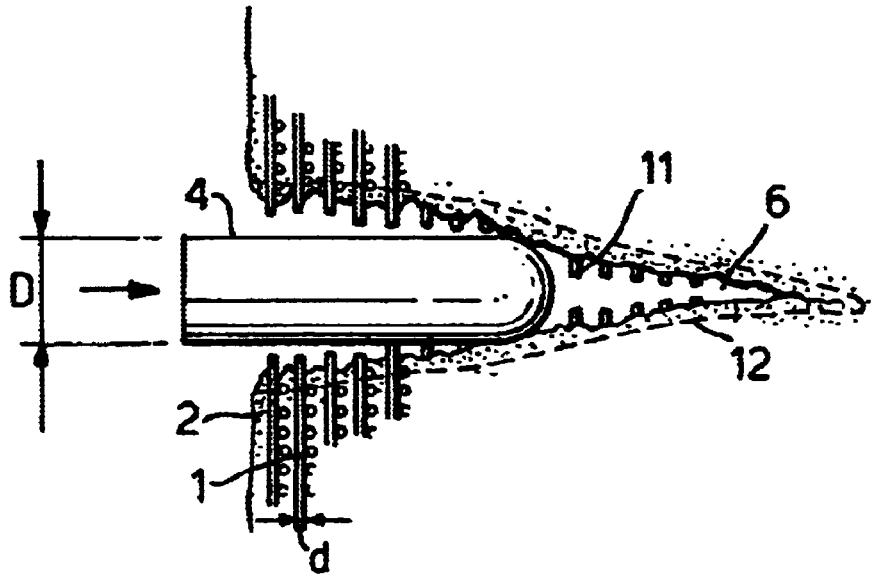
FIG. 17A illustrates penetration of an impact body in a composite structure with then, fine-meshed reinforcement nets in a matrix material.
Figure 17B:
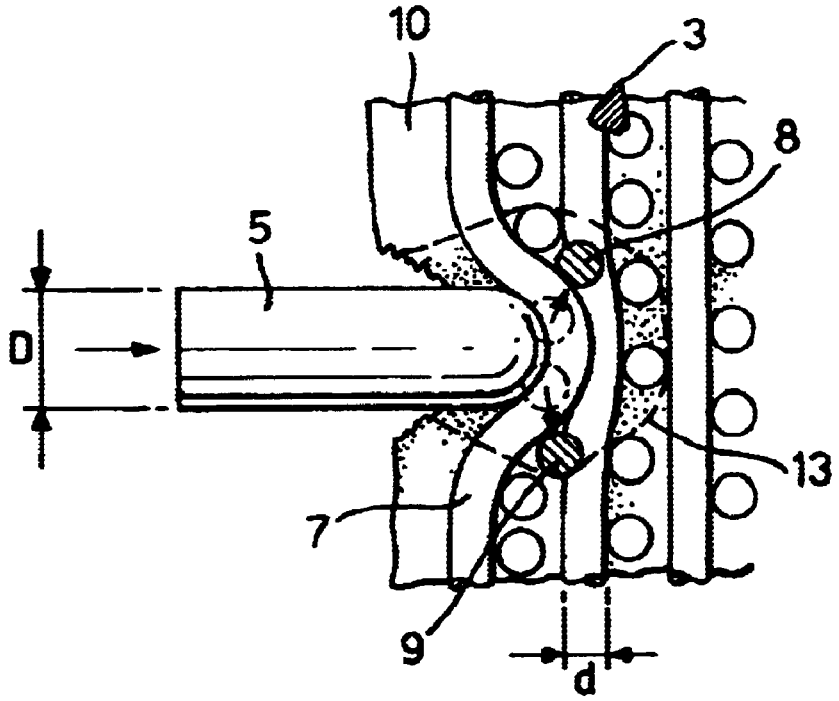
FIG. 17B illustrates penetration of an impact body in a composite structure with geometrically similar heavy reinforcement nets in a matrix material.

FIG. 17A shows a composite structure with thin, fine-meshed reinforcement nets 1 in a matrix material 2. FIG. 17B shows a composite structure with geometrically similar heavy reinforcement nets 3 in a matrix material 10.

4 and 5 are impact bodies. 6 is a sharp crack with protruding ends of torn reinforcement nets 11. 7 is a bar/thread of reinforcement net 3, heavily deformed at the impact. 8 and 9 are sections of two bars/threads in the reinforcement net 3 arranged perpendicularly to the plane of the section, which bars/threads are heavily deformed. Their positions prior to impact is shown in dotted lines. The arrows indicate the displacements. 12 indicates a fracture-active zone in FIG. 17A, and 13 indicates a fracture-active zone in FIG. 17B.

With reference to FIG. 17, the above-discussed principles of adapting the internal structure of solid bodies to the impact bodies to which the solid bodies are to be exposed will now be illustrated by examples.

A starting system comprises composite structures for catching cylindrical, hard, strong, stiff impact bodies of

| | |
|---|---|
| diameter (D) | 50 mm |
| length (L) | 200 mm |
| mass (M) | 2 kg |

with impact velocity ≈400 m/sec.

With reference to FIG. 17, two proposed structures, I and II, will be discussed. Both proposed structures are massive structures with the same exterior measurements and with strong, hard matrix materials and strong, geometrically similar reinforcement nets in the same volume concentration.

In proposal I, the transverse dimension of the bars/threads in the reinforcement nets $$d=10 \text{ mm}$$

and the fracture energy of the matrix material $$G=10{,}000 \text{ N/m}$$

the reinforcement percentage ≈20% by volume

In proposal II, the strengths and stiffnesses are the same as in I, but the internal structures are down-scaled to 1/100. Thus, in this proposal, the reinforcement nets are not with 10 mm diameter bars, but rather with fine threads, $$d=0.1 \text{ mm},$$

and the matrix material (which has the same strength and stiffness as in proposal I) will—confer model laws for scaling failure/fracture according to the present invention—because of the 100 times finer structure have 100 times smaller fracture energy $$G\approx 100 \text{ N/m}$$

As mentioned above, the reinforcement percentage is 20% by volume, the same as in proposal I.

In penetration experiments, behaviours as illustrated in FIG. 17 will, for example, be seen.

In proposal I, the behaviour is as shown in FIG. 17B, where the impact body has been stopped after a short penetration, substantially without destruction outside the penetration zone. In intimate interaction with the hard, fracture-tough matrix material, the reinforcement nets catch the impact body. The stresses and deformations, and thus also the energy absorbed in the active volume—illustrated by the limitation surface 13 are very large.

With the composite structure according to proposal II, the behaviour is much more brittle, more as shown in FIG. 17A which, in this case, does not show the final state, but rather an instantaneous situation during the penetration, where the impact body has been only modestly decelerated. The fine fibre net is tom locally, with a very narrow active one (illustrated by the limitation surface 12) to absorb he energy, and without the "catching function" exerted by the reinforcement net/bars in proposal I.

In accordance with the design principles of the present invention, a number of consequences/conclusions can be seen with basis in the above examples I and II:

1) Using the terminology of the present invention, the causes of the differences can be seen in the light of the differences in the governing coupling parameters:

$$\frac{d}{D} \text{ and } \frac{EG}{\sigma^2 D}.$$

In proposal I, $$\frac{d}{D} = \frac{0.1}{50} = 0.2,$$

whereas in proposal II, the size ratio is 100 times smaller:

$$\frac{d}{D} = \frac{0.1}{50} = 0.002$$

In proposal I, the toughness number $$\frac{EG}{\sigma_f{}^2 D}$$

is relatively high; in proposal II, with unchanged E, $\sigma_F$ and D, and 100 times smaller G, the toughness number is 100 times smaller, in other words, the failure/fracture behaviour is 100 times more brittle.

2) There is basis for prediction/design of similar—and geometrically similar—composite structures to resist penetration bodies of other sizes.

An example could be the challenge of assessing and designing giant solid structures to resist giant impact bodies geometrically similar to the above example, but with a length 100 times larger than in the above example:

| | |
|---|---|
| diameter (D) | 5 m |
| length (L) | 20 m |
| mass (M) | $2*10^6$ kg (2000 tons) |

with impact velocity ≈400 m/sec (the same as in the starting system).

a) If, according to conventional classical design, and inspired by the good experience with reinforcement net with diameter d=10 mm and strong, hard, fracture-tough matrix with fracture energy G=10,000 N/m, the same structure as in the above proposal I were used, in other words d=10 mm and matrix with G=10,000 N/m, the resulting behaviour would, in pursuance of the model laws according to the present invention, be a clearly brittle behaviour, that is, not a behaviour as illustrated in FIG. 17B, but rather a behaviour substantially geometrically similar to the behaviour of a structure with a fine net, d=0,1 mm, and a fine matrix with G=100 N/m, confer FIG. 17A.

This can be explained/realized using the similarity principles according to the present invention, as the two systems have 1) the same small ratio d/D: d/D≈0.002, that is, $$\frac{0.1 \text{ mm}}{50 \text{ mm}}$$

for system II $$\frac{10 \text{ mm}}{5000 \text{ mm}}$$

for the system in question, and 2) the same small toughness number $$\frac{EG}{\sigma^2 D},$$

in both cases 100 times smaller than in the well-functioning system I. For system II because G is 100 times smaller; for the system in question because D is 100 times larger.

b) According to the present invention it is, however, possible to design new large composite structures to resist such impact from such huge high velocity strong/rigid impact bodies, with behaviour substantially similar to the behaviour of composite structures I comprising 10 mm diameter bars in a fracture-tough matrix, G=10,000 N/m, under impact of small 2 kg 50 mm diameter penetration bodies, as illustrated in FIG. 17B.

According to the parameters of the model laws of the present invention, it is required that $$\frac{d}{D}$$

is substantially the same in the two systems, and that also $$\frac{EG}{\sigma^2 D}$$

is substantially the same in the two systems.

Assuming substantially identical strength (σ) and stiffness (E) in the two systems, the requirements for the actual systems with 100 times larger impact bodies (D=5 m versus 50 mm in system I) can be fulfilled with 1) a huge reinforcing net, geometrically similar to the nets in structure I, but built up of huge bars with diameter d=10*100=1000 mm=1 m, and at the same time:

2) providing the matrix with 100 times larger fracture energy, G=10,000*100=$10^6$ N/m.

The individual "threads" of the huge net may be made as composite structures from a multiplicity of steel wires or ropes wound together in a fracture-tough matrix, and the large fracture energy may be conferred to the matrix by suitable use of fine fibres and coarse fibres and rods in a high strength matrix material. Such new structures are described and claimed in Applicants co-pending Danish Patent Application No. PA 1999 00853 filed on Jun. 16, 1999.

c) Again according to the present invention, it is possible to predict a good penetration resistance of the fine-structured composite structure according to proposal II with a fine net, d=100 μm and a matrix with G=100 N/m in resisting penetration from 100 times smaller penetration bodies, such as from strong, rigid "needles" with diameter $$d=50/100=0.5 \text{ mm}$$

$$L=200/100=2 \text{ mm}$$

$$M=2 \text{ kg}/100^3=0.002 \text{ gram},$$

impact velocity as in the above examples, 400 m/sec.

From the model laws used according to the present invention, it will be seen that the behaviour will be substantially similar to the behaviour of the structure II with 10 mm diameter bars under impact of 50 mm diameter penetration bodies, cf. FIG. 17B.

d) The design principles according to the present invention also give a basis for designing better, stronger, more fracture-tough micro-composite structures, e.g., for resisting far larger penetration influences from strong, rigid needles with diameters around 0.5 mm.

Thus, e.g., with basis in the above, prediction can be made of the behaviour of microstructures according to the invention with 1) reinforcement designed geometrically similarly to the exemplified net reinforcement (FIG. 17)
2) reinforcement threads with diameter about 100 μm (like in system II), but with
3) ultra-strong reinforcement, with a tensile strength of, say, 3000–4000 MPa
4) high quality ceram-based matrix with a compressive strength of 1500–3000 MPa, a tensile strength of 200–1000 MPa, a modulus of elasticity of 200–400 GPa, provided with a designed fracture energy G by incorporation of fine, ultra strong 1–10 μm diameter whiskers. The requirements to the fracture energy G are determined by the requirement of identical toughness number $$\frac{EG}{\sigma^2 D}$$

in model and prototype.

Assuming, in order to illustrate principles, that with the above strengths and stiffnesses we are dealing with reinforcement with a strength of the order of 10 times the strengths of the reinforcement in structures I and II and also with approximately 10 times stronger matrix (σ) than used in the structures I and II and with approximately 3 times stiffer matrix.

With such a structure, it can be aimed at creating geometrically similar tough penetration behaviour, but with 10 times larger penetration forces, and 10 times larger penetration energy, e.g., corresponding to impact with ten times larger kinetic energy $W_k$ $$W_k \propto \rho L \cdot D^2 \cdot \upsilon^2$$

wherein L is the length of the impact body.

That is, the structure can resist impact bodies of the same shape and mass impact with much higher impact velocity: Velocity $\upsilon=400\cdot\sqrt{10}\approx1200$ m/sec, or the structure can resist impact with the same velocity and impacting body with the same diameter, but with 10 times larger mass, e.g., a ten times longer impacting needle.

According to the model laws and with fulfilment of the condition for similarity through the condition of the same ductility number $$\frac{EG}{\sigma^2 D}$$

in the actual high performance micro system and in the well-behaving system I, we have $$\frac{E_{prot}}{E_{model}}=3,\ \frac{\sigma_{prot}}{\sigma_{model}}=10,\ \frac{d_{prot}}{d_{model}}=\frac{0.1}{10}=0.01$$

This leads to the requirement of $$\frac{G_{prot}}{G_{model}}=\frac{\left(\frac{\sigma_{prot}}{\sigma_{model}}\right)^2\left(\frac{d_{prot}}{d_{model}}\right)}{\left(\frac{E_{prot}}{E_{model}}\right)}=\frac{10^2\cdot0.01}{3}\approx0.33$$

This means the following requirement to fracture energy in the matrix material in the ultra-strong micro composite structures:

$$G=10{,}000\cdot0.33\approx3300 \text{ N/m},$$

in other words a value 33 times larger than in the well-functioning, but 10 times weaker micro structures likewise in connection with catching of 0.5 mm hard strong penetration needles, cf. d). As mentioned above, such a tough behaviour is obtained by incorporation of ultra-strong fine whiskers.

It should be noted that the above analysis is an analysis with some approximation. Thus, for example, it has been assumed that the lack of complete similarities due to the fact that stiffness and strength have not been increased in the same scale is of minor importance for this order of magnitude analysis.

e) According to the principles of the invention, it is possible, with background in the above example with ultra-strong, fracture-tough microstructures (cf. d)) based on strong ceramics, 0.1 mm diameter strong reinforcement and fine strong whiskers, especially aimed at resisting hard, strong fine penetration needles (d=500 μm), to design new types of large ceramics-based composite structures suitable for resisting penetration from hard, strong, much larger penetration bodies.

Thus, up-scaled versions of the ultra-strong ceram composite structures resisting 0.5 mm diameter penetration needles (cf. d)) can be predicted/designed to create geometrically similar 100 times larger ultra-strong, fracture-tough ceram composite structures resisting 50 mm diameter penetration bodies with the same small penetration as with structure I (FIG. 17B), but with 10 times larger force and 10 times larger penetration energy. This means, for example, 1. a mass of 2 kg with a high impact velocity of 1200 m/sec, or, for example,
2. an impact velocity of 400 m/sec and a high mass of 20 kg.

The data for such structures are as follows:

1. the geometric design of the reinforcement is geometrically similar to the above exemplified structures with 20 vol % net reinforcement, and
2. reinforcement threads/bars of diameter ≈10 mm, and 3. ultra-strong reinforcement with tensile strength 3000–4000 MPa, and
4. high quality ceram-based matrix, built up according to the principles of the present invention, with compressive strength 1500–3000 MPa, tensile strength 200–1000 MPa and modulus of elasticity 200–400 GPa provided with "designed" fracture energy G as follows:

According to the model laws of the present invention, starting from the strong micro structure d), using the same argumentation as above, the requirements to matrix fracture energy are found:

$$\frac{G_{prot}}{G_{model}} = \frac{\left(\frac{\sigma_{prot}}{\sigma_{model}}\right)^2\left(\frac{d_{prot}}{d_{model}}\right)}{\left(\frac{E_{prot}}{E_{model}}\right)} = \frac{(1)\cdot(100)}{1} = 100$$

where the model referred to is the micro structure discussed in d), which means that a fracture energy G of 3300·100= 330,000 N/m is required.

According to the present invention, this can be obtained by incorporation, in the matrix, of, e.g., 100–1000 $\mu$m diameter very strong fibres combined with 1–10 $\mu$m strong whiskers, the whiskers being incorporated to secure ductile behaviour of the local matrix material surrounding the 100–1000 $\mu$m diameter fibres.

Similar design principles according to the present invention are "universal" in that they are not limited to, e.g., penetration, hard body impact as exemplified above. Thus, as mentioned above, they are just as valid in connection with strong local influence from concentrated explosives where the design of the inner structure of the solid composite structures is based, inter alia, on the coupling parameters $$\frac{d}{V^{1/3}} \text{ and } \frac{EG}{\sigma^2 V^{1/3}}$$

wherein V refers to the volume of explosive.

Two Bodies Interaction

Another important aspect of the design according to the invention with regard to failure/fracture is to consider entire systems. This means—in simplified form for two body systems—that failure fracture in both systems should be considered in a unified analysis.

In the examples illustrated, cf. FIG. 17, it had been presumed, in order to simplify, that the impacting bodies were indefinitely strong and stiff.

In real design, also the mechanical behaviour of the impacting body, that is, elastic behaviour, plastic behaviour and fracture behaviour, should also be included.

With reference to FIG. 17, model laws including fracture parameters essential in the context of the present invention may be expressed for the impacting body, including $$\left(\frac{EG}{\sigma^2 D}\right)_{imp.body}$$

The impacting body will also, as shown in FIG. 17B, interact physically with the internal structures of the composite structure, i.e., with the reinforcement (diameter d). Thus, there will be coupling model law parameter such as $$\frac{\left(\frac{EG}{\sigma^2}\right)_{imp.body}}{d_{comp.struct}}.$$

In the following is given an illustration of the concept of design according to the invention taking into account fracture/failure, including "many bodies interaction".

Figure 18A:
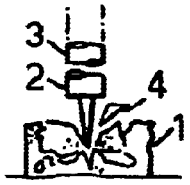
FIG. 18A illustrates a small system with a small target body under influence from a small tool body with a chisel and a hammer.
Figure 18B:
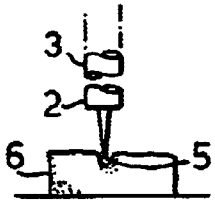
FIG. 18B shows a small system resembling system A.
Figure 18C:
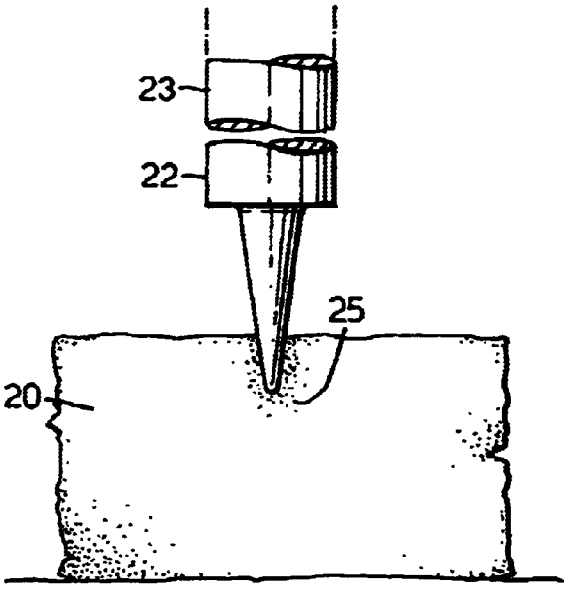
FIG. 18C illustrated the goal of the design, illustrated as a theoretical plastic zone at the tip.
Figure 18D:
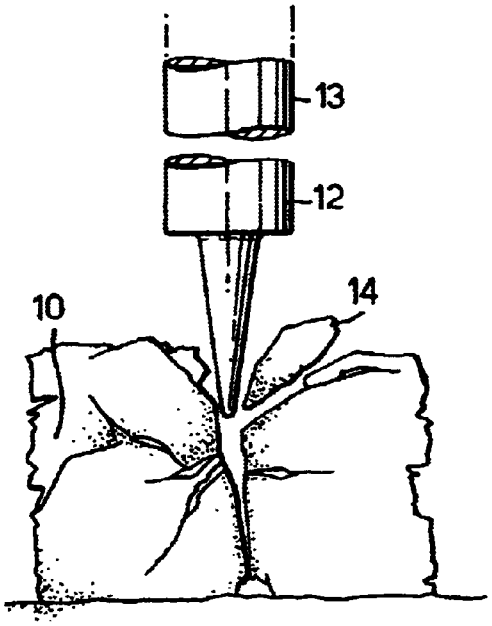
FIG. 18D illustrates a real large system, with a large target body and a corresponding large tool body.
Figure 18E:
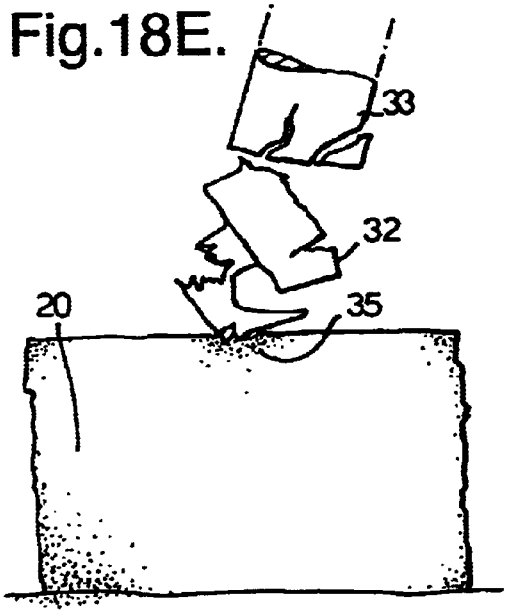
FIG. 18E shows the testing of a giant body according to the invention, with giant tool of conventional design.
Figure 18F:
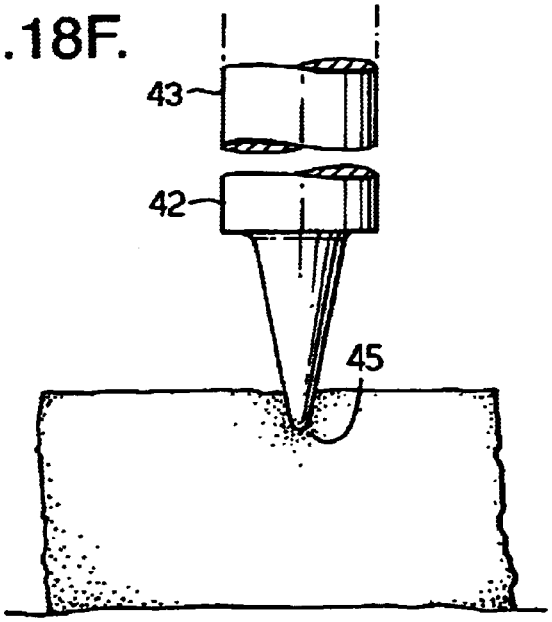
FIG. 18F shows where both the target body and the tool body are provided with approximately 100 times larger fracture energy than the small tough system of FIG. 18B.
Figure 19A:
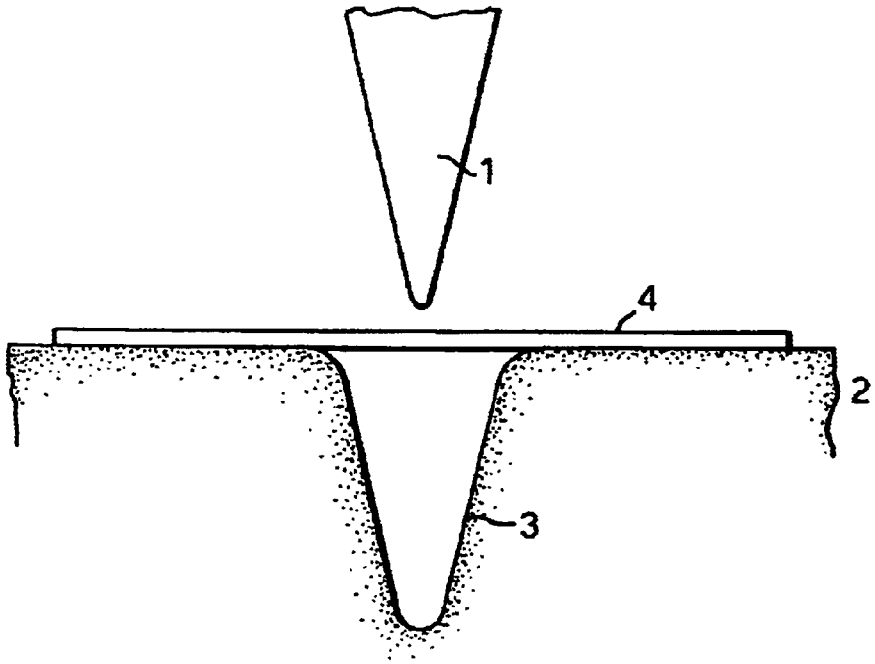
FIG. 19A–C shows using a body as a tool for shaping panels.
Figure 19B:
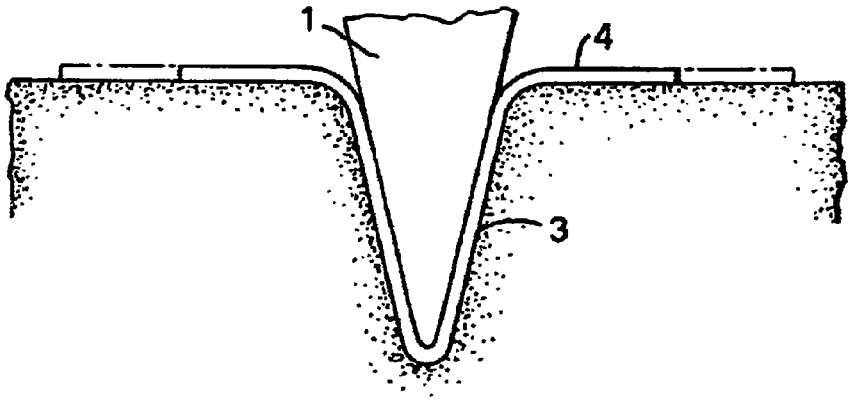
Figure 19C:
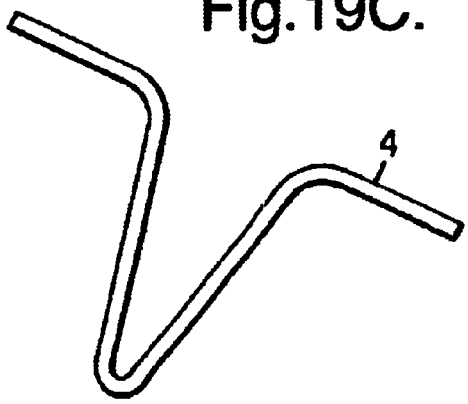

FIG. 18 illustrates an example of a two body interaction complex, and FIG. 19 is a similar example.

In FIG. 18, A illustrates a small system with a small target body 1 under influence from a small tool body with a chisel 2 and a hammer 3. The target body is disintegrated in a brittle manner, illustrated, inter alia, by a fragment 4. B shows a small system resembling system A, but where the target has been replaced with a body 6 of the same size with substantially larger fracture toughness, illustrated in that in the interaction, only local tough penetration takes place—illustrated by the plastic zone at a tip 5. C illustrates the goal of the design, illustrated as a theoretical giant system supposed to show similar though behaviour as system B. 20 is a large target, 22 and 23 illustrate a large tool body, and 25 illustrates a plastic zone at the tip. D illustrates a real large system, with a large target body 10, and a corresponding large tool body 12 and 13. The target body is made of the same material as in B, where it showed a tough behaviour. In the large system illustrated, the material shows a weak/brittle behaviour completely different from the behaviour in B, illustrated by the target body being disintegrated. 14 illustrates a fragment. The behaviour in this case is not as desired, but rather like the behaviour in A. E illustrates a large system in which a target body 20 has been provided with large fracture toughness, designed to show tough behaviour during interaction with a tool 32 and 33 substantially similar to the behaviour observed for the small tough target body B. Tools 32 and 33 are made of a material used successfully in the above systems A and B. However, in the present large system, the large tools 32 and 33 show a completely different behaviour, illustrated by the tools 32 and 33 being subject to brittle destruction at far lower loads than those calculated for obtaining the penetration shown in the large theoretical system C shown, and by the fact that only minor structural changes take place in the surface of the large, strong, fracture-tough target, as illustrated at 35. F illustrates a large system like E, but where also strong tool bodies 42 and 43 have been provided with large fracture toughness, taking the large body size into consideration, so that a behaviour substantially similar to the behaviour in the small fracture-tough system B is obtained, with modest penetration and formation of a small plastic zone at a tip 45. Thus, with system F, the goal which was formulated above, illustrated by system C, has been achieved.

FIG. 19 illustrates the shaping of a plate body 1 shows a section of an upper tool part, only the part the be pressed down into an indentation 3. 2 is a lower tool part with the indentation 3. A shows the situation prior to shaping, with a plate-shaped body 4 to be shaped loosely arranged on the upper side of the lower tool part 2. B shows the situation during the shaping, where an upper tool part 1 has been pressed down into the indentation 3, shaping the plate body 4 substantially corresponding to the narrow space between the upper and the lower tool parts. (Similar arrangements will typically also be made to ensure that the plate body outside the heavily deformed zone attains desired shapes. An upper tool part to used to ensure this is not shown). C shows the final plate body, removed from the tool.

In the following, the concept of the design of fracture/failure according to the invention, including many body interaction, will be exemplified with reference to FIGS. 3 and 4.

I. Inspiration for Innovation

The target body 1 in FIG. 18A is subject to brittle failure. With basis in the principle of building in fracture toughness by increasing the toughness number $$\frac{EG}{\sigma^2 L},$$

where L is a characteristic length measurement, the same size of target bodies, FIG. 18B 6, have been made with incorporation of strong fibres, with the same strength (σ) and the same stiffness (E), but, because of the fibres with considerably higher fracture energy (G) and consequently considerably higher toughness number $$\frac{EG}{\sigma^2 L},$$

The target shows much higher toughness than the target body 1, as shown in FIG. 18B.

II. Vision Regarding Target Bodies

Based on model laws according to the present invention, it is realised that it would be possible to create ultra-strong and tough very large target bodies able to resist very strong impact.

For example, based on model laws concerning equal force ratio and equal energy ratio in model and prototype, it appears possible to create 100 timer larger target bodies capable of resisting 10,000 times larger impact forces and 1,000,000 timer larger impact energy.

Thus, e.g., to create, starting from 10×20×30 cm target bodies and 1 kg weight hammer chisel, 1×2×3 meter target bodies to resist impact from huge $10^6$ kg=100 tons weight "hammer chisel" equipment.

This vision is illustrated in FIG. 18C

III. Conventional Approach

Inspired by the good experience with the tougher material in FIG. 18B, this material would be used, according to common conventional strategy, in the new giant target bodies. The disappointing result, with the body being disintegrated in a brittle manner under influences far smaller than the influences for which the body was designed, is illustrated in FIG. 18D.

IV. Analysis, Assessment, Explanation According to the Invention

The sad result from D is assessed according to the model principles of the present invention. The explanation of the brittle behaviour in the large system is that because of the 100 times larger size, the toughness number $$\frac{EG}{\sigma^2 L}$$

in the large system is 100 times smaller than for the small body made of the identical material.

V. Design of Giant Target Body According to the Invention

With basis in the model laws according to the present invention, giant target bodies, 100 times larger than the tough bodies in FIG. 18B, with the same material strength (σ) and stiffness (E) are designed.

Based on the requirement about substantially the same toughness number $$\frac{EG}{\sigma^2 L},$$

it results that in the large bodies, 100 times higher fracture energy (G) is required. As described above, this is typically obtained by incorporation of combinations of strong bars and coarse and fine fibres.

VI. Testing of Giant Body According to the Invention, with Giant Tool of Conventional Design (FIG. 18E)

During testing, the tool fails, showing brittle behaviour, at loads which are considerably smaller than the loads designed to give the specific penetration. The target body resists these loads, but is not tested as it had been desired. The reason for the failure of the tool is higher brittleness caused by the 100 times smaller toughness number $$\left(\frac{EG}{\sigma L}\right)_{Tool}.$$

VII. Final Design—According to the Invention

This i shown in FIG. 18F, where both the target body and the tool body are provided with approximately 100 times larger fracture energy than the small tough system of FIG. 18B in order to fulfil the requirement of identical or substantially identical toughness number $$\frac{EG}{\sigma^2 L}.$$

In designs in which it is especially the behaviour of the target body at the tip of the tool body which is essential, it will be preferred to adapt the internal structure of the target body, especially at the surface, to the size and shape of the tool tip, e.g., through the geometric coupling parameters $$\frac{l_{tool}}{l_{target}}, \frac{d_{tool}}{d_{target}}$$

in which $l_{tool}$ and $d_{target}$ are characteristic sizes for the tool tip and $d_{target}$ is a characteristic size of an inner target component, such as the diameter of reinforcement.

Likewise, with respect to local behaviour, the fracture energy of the matrix material, especially at the surface, will be adapted to the tool geometry, for example, governed by the condition of identical toughness number $$\frac{EG}{\sigma^2 d_{target}},$$

which E, G and σ refer to the matrix.

A similar example is shown in FIG. 19 which shows a tool for shaping panels. According to quite the same principles, it is possible, based on successful experience with pressing of 0.3 mm panels 4 in tool 1 and 2 with size, e.g., 200 mm, to predict realistic possibilities for designing and making substantially as strong, large and fracture tough giant tools with sizes of, e.g., ≈2 meter, to shape panels of thickness 30 mm with forces that are 10,000 times larger and energy influences which are 1,000,000 times larger.

One particular aspect of the invention relates to a method for designing one or several components of a prototype system showing substantial behavioural similarity to a model system behaviour with regard to mechanical behaviour, including fracture behaviour, the method comprising 1) designing the component or components of the prototype system in a desired size and geometrically substantially similarly shaped as a corresponding component or corresponding components of the model system,
2) designing the prototype component(s) so that it/they is/are provided with properties which are mutually adapted to each other and are adapted to characteristic size ratio(s) between the prototype system and the model system so as to achieve substantially identical values of the parameter $$\frac{EG}{\sigma_t^2 L}$$

in the prototype system and the model system.

The prototype component(s) is/are preferably designed so that substantially identical values of one or several of the other parameters defined above and in any of claims 7–58 are achieved.

Furthermore, it is preferred that the prototype component(s) is/are designed so that similarity with the model system with respect to physical influences such as body impact is obtained, this including securing that substantially equal values of $$\frac{\rho v^2 E}{\sigma_t^2}$$

are obtained in model and prototype also in this regard.

The computer modelling of the various aspects of the invention are suitably carried out on suitable workstations of a suitable computer network using software adapted to the purpose A number of structural design software systems are known; such systems could be adapted to perform the method of the invention by incorporation of the principles and algorithms characteristic of the invention. Data obtained by computer modelling according to the present invention may be stored together with data obtained by physical, e.g., mechanical, modelling according to the invention, and the stored data may be compared, if desired under software control, to obtain an adjustment and refinement of the modelling tools.

EXAMPLE 1

Impact of a hard body against a structure built up as a solid cylinder shell with an internal structure built up as a strong and tough matrix with a high concentration of reinforcement.

In the present hypothetical example, the hard body is in the form of a body having the shape of a cylinder having a length/diameter ratio of about 5 provided with end parts shaped as half spheres, so that the shape of the body (apart from the size) could resemble a pharmaceutical capsule. The impact body is presumed to be much harder, stiffer and stronger than the target.

Model Experiment

Impact Body:

Length about 50 cm, diameter 10 cm, made of solid steel (density 7800 kg/M$^3$), mass 30 kg.

Target:

A massive cylinder shell (density 4000 kg/m$^3$), thickness 150 mm, built up with a reinforcement having a tensile strength of 500 MPa arranged in a dense, hard, fracture-tough matrix having a modulus of elasticity of 40 GPa and a compressive strength of 125 MPa, fracture energy 10 kN/m. The reinforcement is constituted by cylinder-shaped rods, diameter 15 mm, straight and curved, arranged in a suitable configuration. The matrix has been rendered fracture-tough by means of fibres of diameter 0.2 mm having a tensile strength of 1000 MPa.

Impact Experiment:

Impact velocity 200 m/sec perpendicular to the target, impact point about the middle of the side of the cylinder shell.

In the impact experiment, local penetration of about 100 mm was observed, but without any total penetration of the shell, and with only minor fractures out side the impact zone.

Scaling and Designing Based on the Model Experiment

Using the scaling principles of the present invention, estimates are made with respect to impact capacity of larger and smaller, and also stronger, structures which are designed so that they are shaped substantially geometrically similarly with the shell of the model experiment.

Using the model laws in accordance with the present invention, similar behaviour, with the impact body penetrating about two thirds of the shell thickness, substantially without any damage outside the penetration zones, can be predicted for structures having the design shown in the table subjected to the impact influences shown in Table 1:

TABLE 1

Estimated structures-shell thickness, interior structure, etc.-for resisting impact from hard, strong, stiff solid steel bodies with masses from 30 kg (reference) up to 30*10$^6$ kg (30,000 tons) with impact velocity 200 m/sec. In the example, strengths and stiffnesses are kept constant.

| Shell thickness mm | Impact body mass | Velocity, m/sec | Matrix $\sigma_c$ MPa | Matrix E GPa | Matrix G kN/m | Reinforcement diameter, mm |
|---|---|---|---|---|---|---|
| 150 | 30 | 200 | 125 | 40 | 10 | 15 |
| 300 | 240 | 200 | 125 | 40 | 20 | 30 |
| 750 | 3.75*10$^3$ | 200 | 125 | 40 | 50 | 75 |
| 1500 | 30*10$^3$ | 200 | 125 | 40 | 100 | 150 |
| 3000 | 240*10$^3$ | 200 | 125 | 40 | 200 | 300 |
| 7500 | 3.75*10$^6$ | 200 | 125 | 40 | 500 | 750 |
| 15000 | 30*10$^6$ | 200 | 125 | 40 | 1000 | 1500 |

The scaling up of the substructure—such as, e.g., obtaining the stated values of fracture toughness while retaining geometrically similar shaping on substructure level may be performed by suitable adaptation of the parameters of the substructure.

Based on the above principles, a number of estimates are performed in the following for other combinations of impact load and structure properties, with the shell structure showing the same (similar) behaviour as above.

With stronger reinforcement, such as tensile strength 1000 MPa, and stronger, stiffer and tougher matrix, such as having a compressive strength of 250 MPa, and a modulus of elasticity of 80 GPa, density unchanged, 4000 kg/m3, the estimations to the invention result in combinations as shown in Table 2:

TABLE 2

| Shell thickness mm | Impact body mass | Velocity, m/sec | Matrix $\sigma_c$ MPa | Matrix E GPa | Matrix G kN/m | Reinforcement diameter, mm |
|---|---|---|---|---|---|---|
| 30 | 0.24 | 280 | 250 | 80 | 4 | 3 |
| 150 | 30 | 280 | 250 | 80 | 20 | 15 |
| 300 | 240 | 280 | 250 | 80 | 40 | 30 |
| 1500 | $30*10^3$ | 280 | 250 | 80 | 200 | 150 |
| 3000 | $240*10^3$ | 280 | 250 | 80 | 400 | 300 |
| 15000 | $30*10^6$ | 280 | 250 | 80 | 2000 | 1500 |

With still stronger reinforcement, such as tensile strength 2000 MPa and also stronger and stiffer matrices having higher fracture toughness (compressive strength 500 MPa, modulus of elasticity 160 GPa), combinations as shown in Table 3 result:

TABLE 3

| Shell thickness mm | Impact body mass | Velocity, m/sec | Matrix $\sigma_c$ MPa | Matrix E GPa | Matrix G kN/m | Reinforcement diameter, mm |
|---|---|---|---|---|---|---|
| 15 | 0.030 | 400 | 500 | 160 | 4 | 1.5 |
| 30 | 240 | 400 | 500 | 160 | 8 | 3 |
| 75 | $3.75*10^3$ | 400 | 500 | 160 | 20 | 7.5 |
| 150 | $30*10^3$ | 400 | 500 | 160 | 40 | 15 |
| 300 | $240*10^3$ | 400 | 500 | 160 | 80 | 30 |
| 750 | $3.75*10^6$ | 400 | 500 | 160 | 200 | 75 |
| 1500 | $30*10^6$ | 400 | 500 | 160 | 400 | 150 |
| 3000 | $240*10^3$ | 400 | 500 | 160 | 800 | 300 |

These examples show the use of the principles of the invention for making estimates relating to combinations of structure and impact loading to create new impact-resistant structures, thereby enabling optimum combinations of 1) impact performance, 2) other performance such as lightness in the case of moving objects) and 3) economy.

Thus, for example, it appears from Table 1 that shells can be made with a thickness of only 1.5 m which resist impact from hard, strong solid steel bodies of 30 tons falling from a height of 2 km (200 m/sec) without any major destruction (apart from penetration in ⅔ of the shell), a combination resulting as a logical consequence of the scaling principles of the present invention.

Tables 2 and 3 show examples where the scaling according to the invention is used to estimate a) combinations with stronger, stiffer materials having higher fracture toughness b) higher impact velocities, 280 m/sec and 400 m/sec, respectively, and c) fir design of thinner hard impact-loaded shells, down to 30 mm and 15 mm, respectively.

Thus, unique, relatively thin shells are shown which resist giant impact from 30 tons hard, strong solid steel bodies at impact velocities of 400 m/sec, corresponding to a free fall of 8 km. The thickness of the shells is only 1.5 m.

The tables also show estimated combinations with thinner shells, for example, shells stopping hard, strong, stiff solid steel impact bodies with impact velocities of 400 m/sec, the shell thicknesses being 15 mm, 30 mm and 75 mm, respectively, for impact masses of 30 g, 240 g and 3.75 kg, respectively.

A practical design task utilizing the principles of the invention could, for example, be performed as follows:

1) on the basis of estimates like the ones shown above, for example, with an estimated 800 mm thick shell structure for resisting impact from strong, hard solid bodies weighing 3–5 tons and having impact velocities of between 300 and 600 m/sec, 2) a spectrum of design possibilities is sketched, 3) on the basis of this, a number of model composite structures are designed and produced, 4) a number of model experiments are designed and performed on the model composite structures, under varied conditions with varied actual impact loads, and 5) on the basis of the results of the model experiments, the actual design of the structures for practical use is performed.

In this manner, a far better basis for the actual design is obtained than was possible in the prior art.

If desired, the modelling can be performed on a number of levels, so that after step 4, another step 3) could be performed where a new series of model composite structures could be designed and produced, preferably in a scale closer to the end product scale or with other parameters adapted on the basis of the experience gained in the first model experiments, and new model experiments 4) could be performed with these new models which, thus, closer reflect the prototype structure or special problems to be investigated in connection with the conditions to which the prototypes will be subjected.

FIG. 20 illustrates aspects in connection with mechanical interaction between reinforcement component and matrix, including local failure/fracture under conditions where the reinforcement is substantially only influenced—and moved—in the longitudinal direction of the reinforcement relative to the surrounding matrix A is a reinforcement component 1, such as a substantially cylindric rod, in a surrounding/enveloping matrix material 2. The reinforcement component 1 is influenced by a force in the longitudinal direction 3 of the reinforcement. Bis an analogous large system with a reinforcement component 4 in a matrix 5 influenced by a force 6.

During the displacement, the matrices 2 and 5 are influenced by forces from the reinforcement, as illustrated by shear forces $\tau_A$ and $\tau_B$, expressed as strains. During the displacement, there is typically also a small expansion in a narrow shear zone in the matrix adjacent to the reinforcement. C and D are sections of the systems A and B, respectively, the sections being perpendicular to the longitudinal direction of the reinforcement, the sections being enlarged relative to A and B. 7 and 8 indicate the above-mentioned shear zones in the respective sections.

Due to the expansions, stresses are induced in the surrounding matrix material, with radial compression stresses and tangenial tensile stresses, as shown in respective sections 9 and 10 with, respectively, $\sigma_{R.A}$ and $\sigma_{R.B}$ compression acting at the rim of the reinforcement $\sigma_{X.A}$ and $\sigma_{X.B}$ compression acting in the matrix in the distance X from the reinforcement axis $X_A$ and $X_B$, respectively, $\sigma_{\theta.A}$ and $\sigma_{\theta.B}$ tangential tensile stresses.

E and F show longitudinal sections (enlarged) of A and B, respectively, enlarged deformed shear zones 7 and 8 being shown.

In the light of FIG. 20, model scaling of matrix/reinforcement interaction, including failure/fracture, will now be discussed for the special cases illustrated, with displacement of reinforcement relative to surrounding matrix, in the longitudinal direction of the reinforcement.

Let us assume that A is a small model, e.g., with a diameter $d_A$ of the reinforcement of 10 mm, the small model showing a desired fracture-tough behaviour, and that it is desired to scale up this behaviour to a geometrically similar large system, e.g., with 10 times larger reinforcement component with diameter $d_B$100 mm.

Figure 20A:
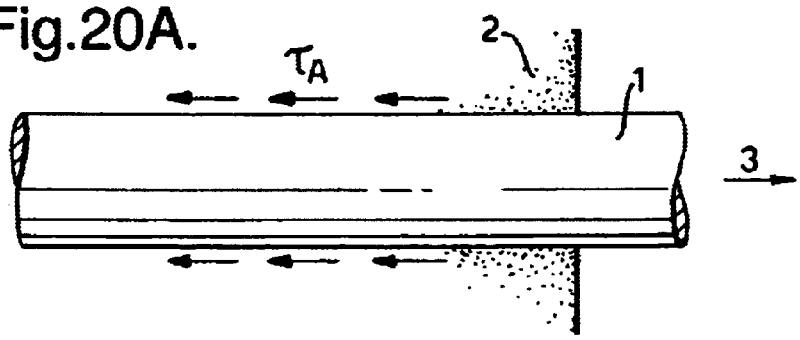
FIG. 20A–H illustrate aspects in connection with mechanical interaction between reinforcement component and matrix.
Figure 20B:
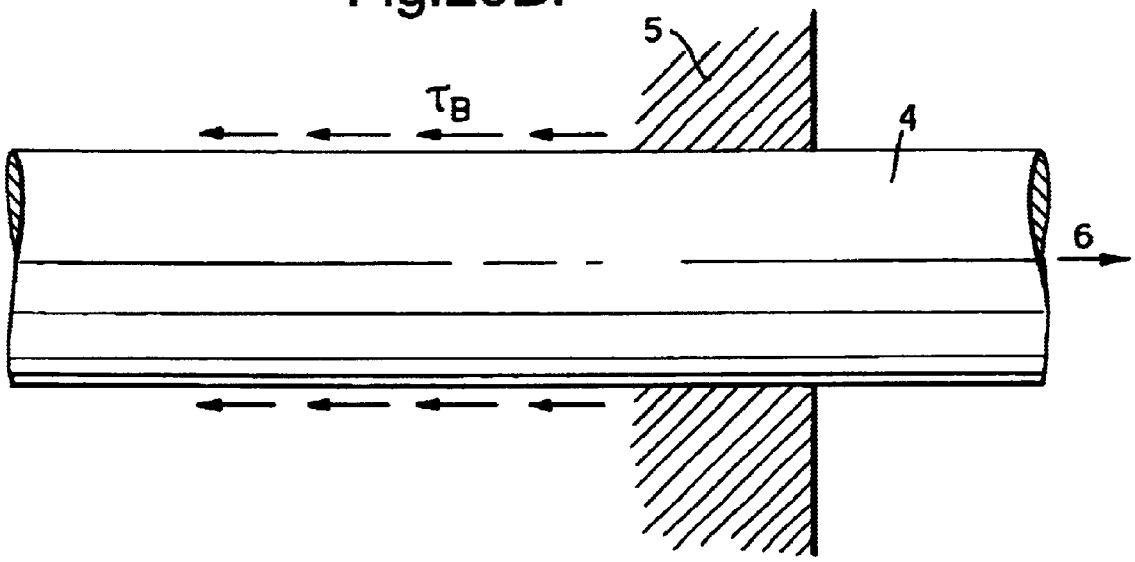
Figure 20C:
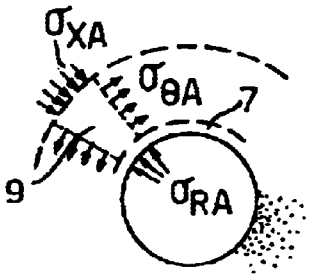
Figure 20D:
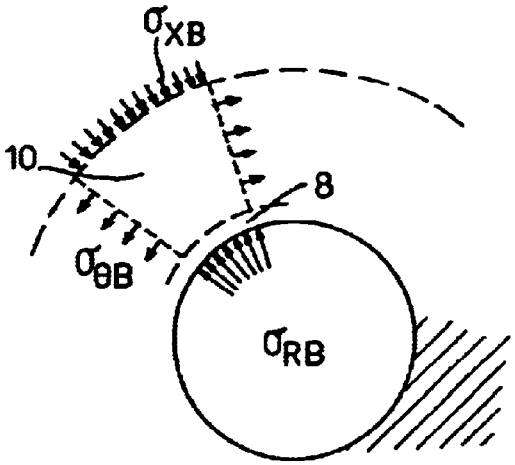
Figure 20E:
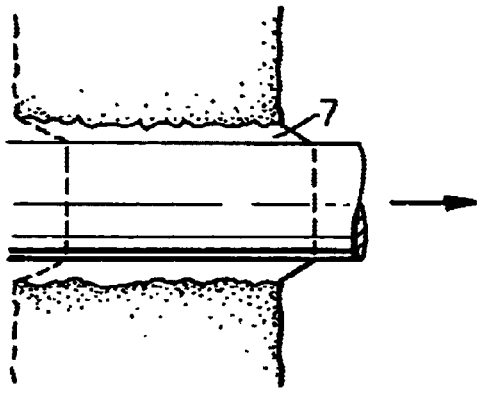
Figure 20F:
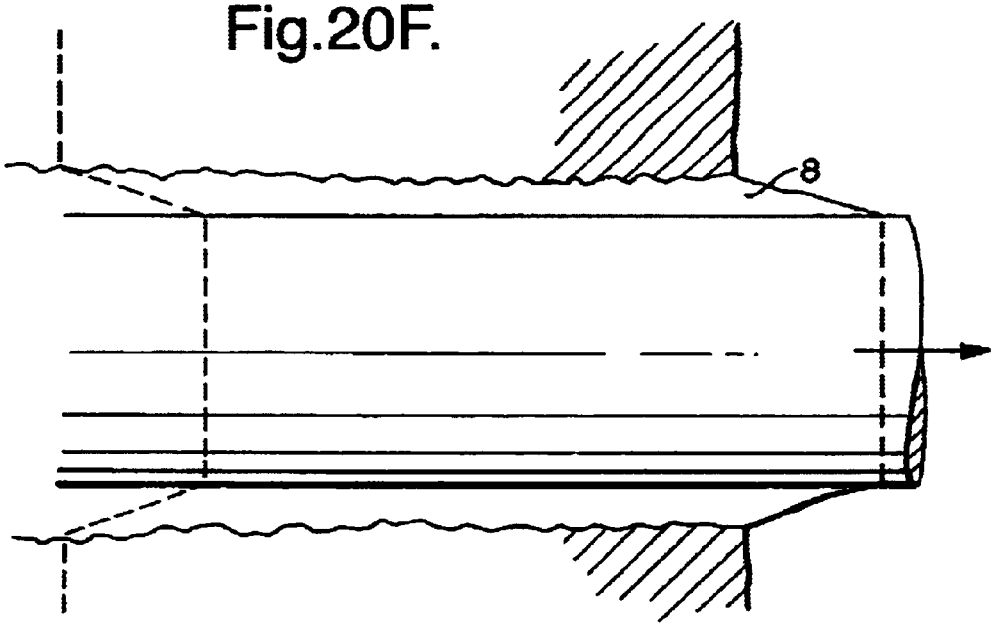
Figure 20G:
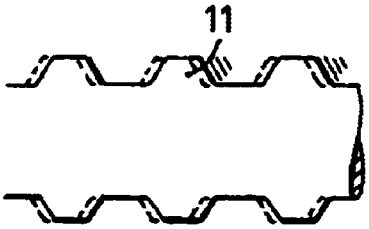
Figure 20H:
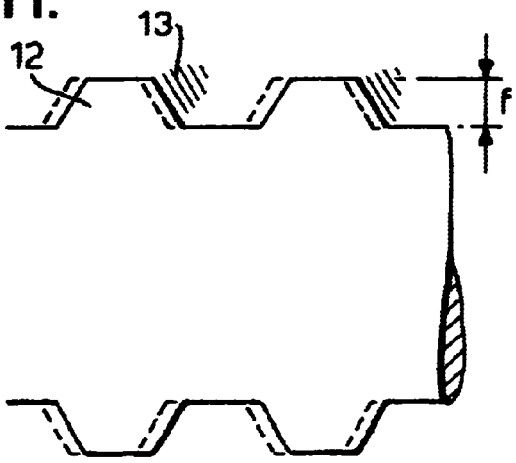

In order to create similar shear behaviour, similar stress conditions are required. With reference to FIG. 20C and D, this means that it is required that $$\frac{\tau_B}{\tau_A} = \frac{\sigma_{RB}}{\sigma_{RA}} = \frac{\sigma_{XB}}{\sigma_{XA}} = \frac{\sigma_{\theta.B}}{\sigma_{\theta.A}}$$

The shear also introduced tension in the matrix, $\sigma_{\theta.A}$ and $\sigma_{\theta.B}$, in tangential direction. The tension stresses thus introduced by the shear will typically result in tensile fracture, with formation of tension flow zones and/or tension cracks, such as illustrated in FIG. 21.

Figure 21:
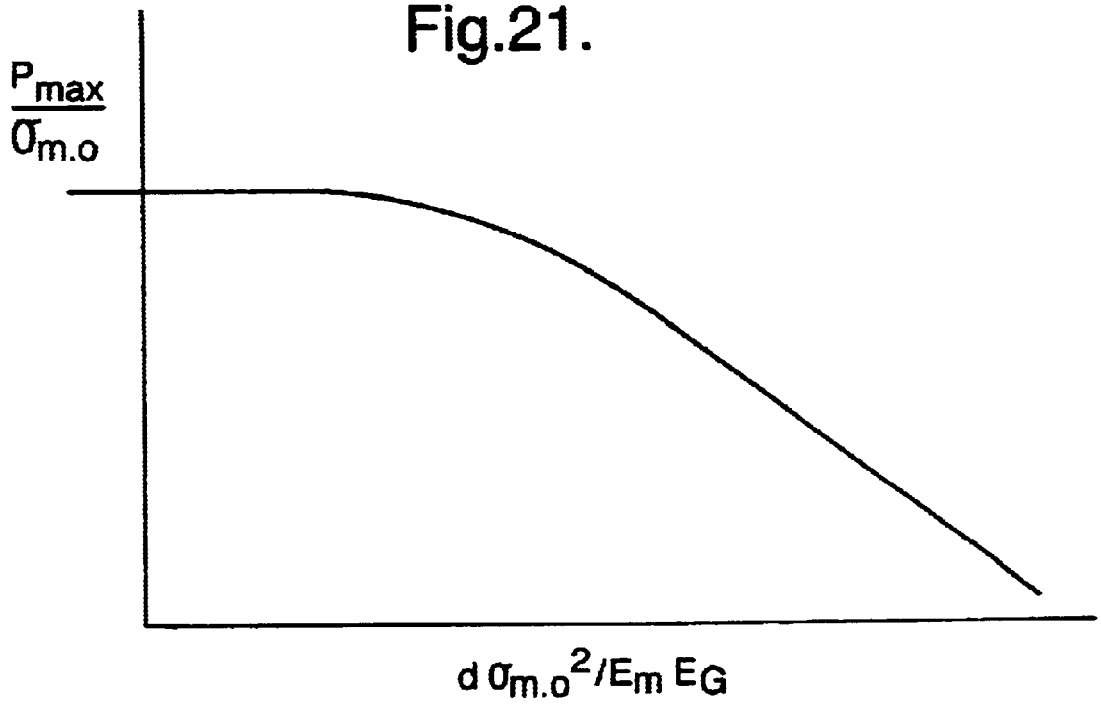
FIG. 21 shows behavior of cylindrical cavities in matrices subjected to internal pressure.
Figure 21A:
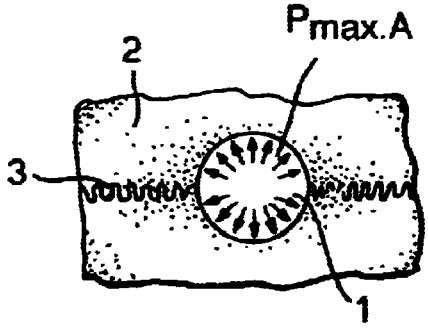
FIGS. 21A and B shows section with a) fracture-tough behavior and high maximum pressure and b) brittle behavior with formation of large cracks and low maximum pressure.
Figure 21B:
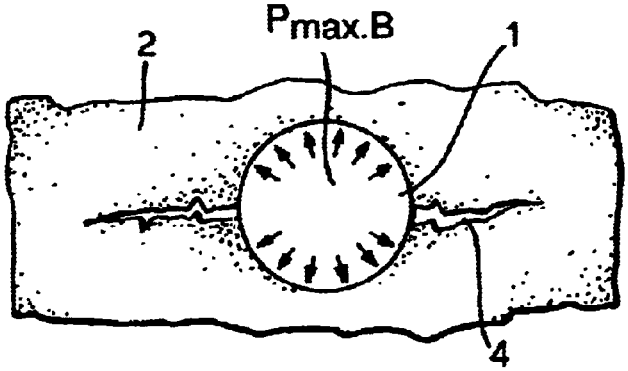

FIG. 21 shows behaviour of cylindrical cavities 1 in matrices 2 subjected to internal pressure. The failure pressure, $P_{max}$, divided by the tensile strength of the matrix, $\sigma_{m.0}$, is shown as a function of the toughness number $$\frac{E_m G_m}{\sigma_{m.0}^2},$$

plotted as the reciprocal value. A and B show sections with a) fracture-tough behaviour and high maximum pressure ($P_{max.A}$) and b) brittle behaviour with formation of large cracks and low maximum pressure ($P_{max.B}$). 3 designates an active/plastic flow zone, 4 designates a crack, and d designates the diameter of the cylindrical cavity.

This means that in the scaling of failure-fracture, identical toughness number with regard to tensile behaviour should be secured in model and prototype $$\left(\frac{E_m G_m}{d\sigma_m^2}\right)_B = \left(\frac{E_m G_m}{d\sigma_m^2}\right)_A$$

Figure 22A:
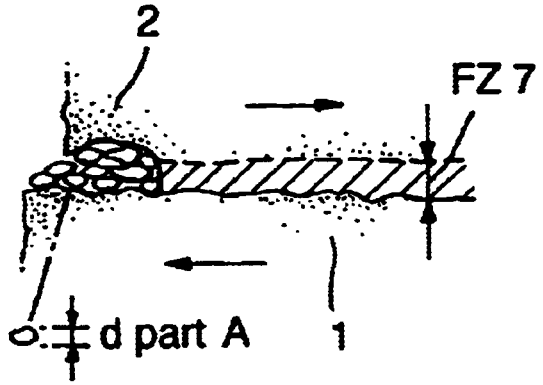
FIGS. 22A–C show various displacements of a matrix in relation to the surface of reinforcement in a small system.
Figure 22B:
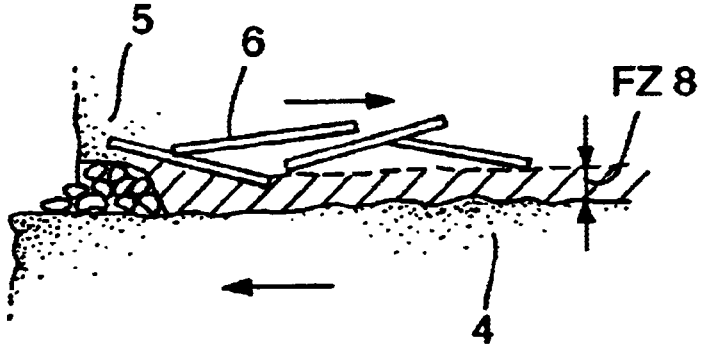

It could be considered to do this solely by toughening the matrix 2 in A with fine fibres. However, this is often not sufficient. If, e.g., in systems with identical matrix tensile strength in model A and prototype B, the same basic matrix were selected in B as the matrix in A, a desired, such as 10 times larger fracture energy had been established using, e.g. 0.5–1% of fine fibres, $$\frac{G_{m.B}}{G_{m.A}} = 10,$$

a desired scaling with respect to shear behaviour would not necessarily have been obtained, because the desired scaling up of the narrow shear zone, confer FIG. 20, scaling from 7 to 8, would not have been obtained. This is illustrated in FIG. 22, in which A shows displacement of matrix 2 in relation to the surface of reinforcement 1 in a small system, B shows a similar displacement of matrix 5 in relation to the surface of reinforcement 4. The matrices 2 and 5 are the same, apart from small amounts of fine fibres 6 being added in matrix 5.

These fibres have substantially no influence on the shear zones 7 and 8, respectively, which a) have substantially the same small thickness b) show substantially identical shear behaviour c) with substantially the same absolute transverse expansion under shear $$\delta_{FZ.7} \approx \delta_{FZ.8}$$

Figure 22C:
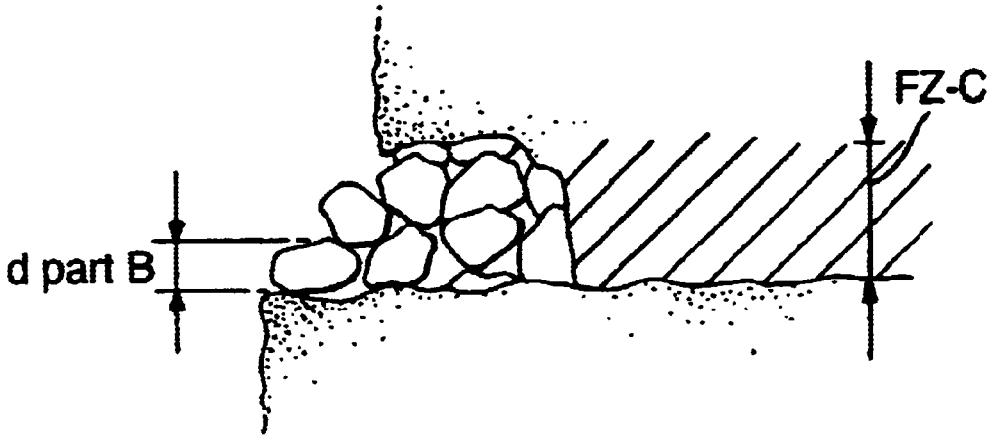
Figure 23A:
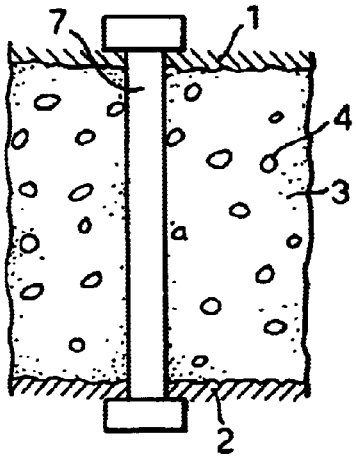
FIGS. 23A–E show various displacements of a matrix.
Figure 23B:
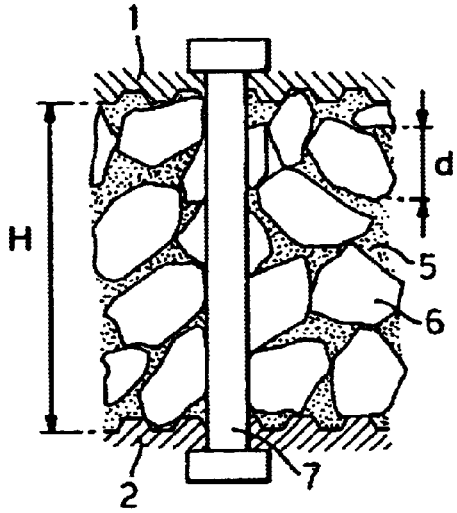
Figure 23C:
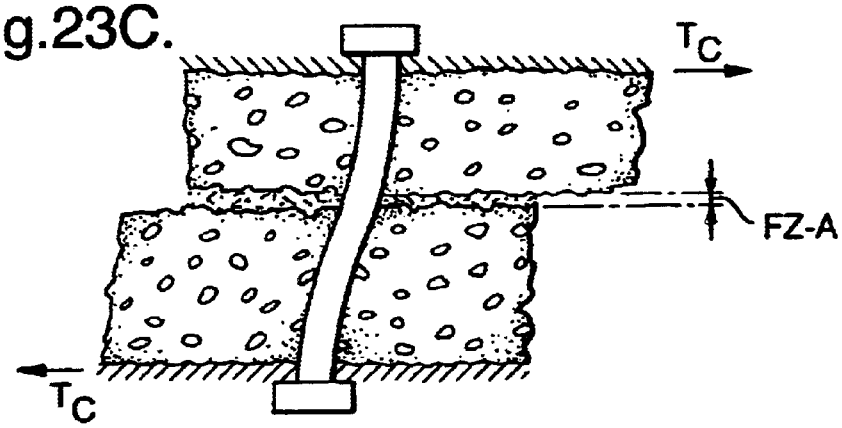
Figure 23D:
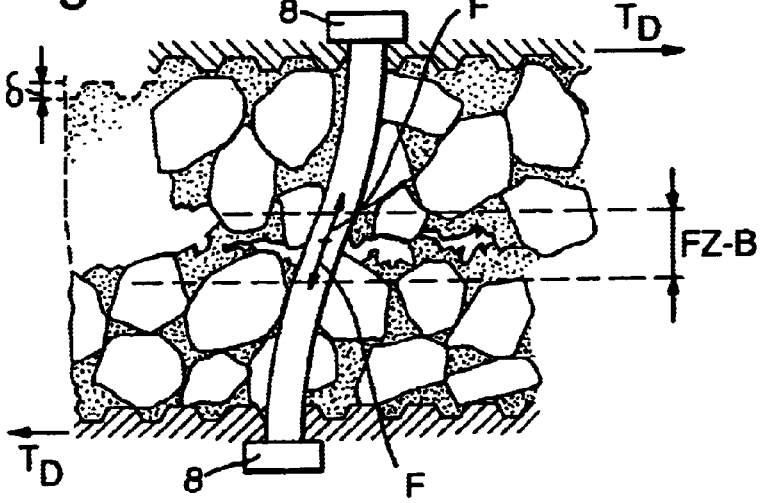
Figure 23E:
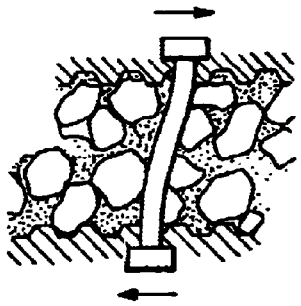
Figure 24A:
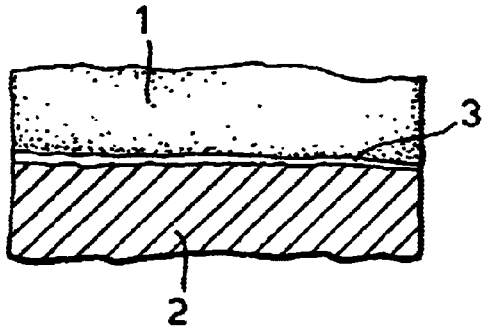
FIGS. 24A–E show various displacements of a matrix.
Figure 24B:
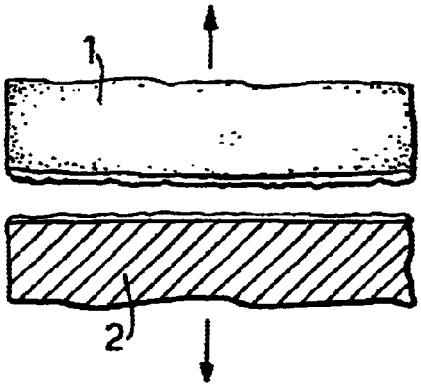
Figure 24C:
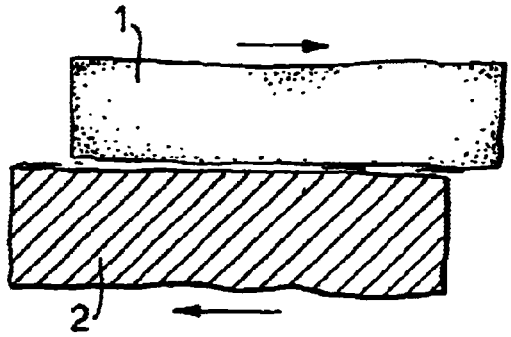
Figure 24D:
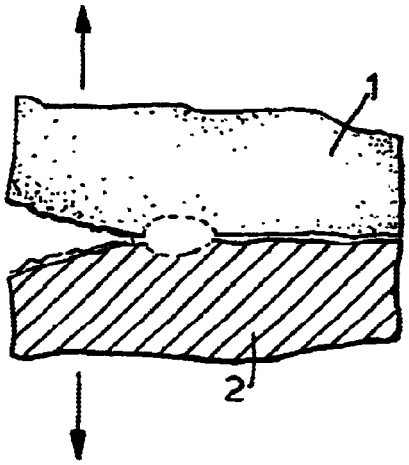
Figure 24E:
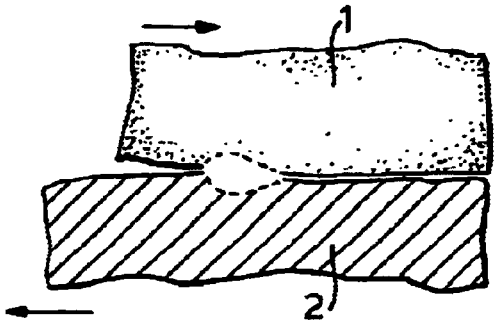

What is meant by $\delta_{FZ}$ appears from FIG. 22C. See also FIG. 23.

For the large system B, this means

I. that there is considerably less relative expansion in the shear zone in B than in A $$\frac{\delta_{FZ.7}}{d_A} > \frac{\delta_{FZ.8}}{d_B}$$

II. that hereby, in B, not anything near the same large compression stresses $\sigma_R \cdot \sigma_X$ axis obtained in B as in A $$\sigma_{RA} > \sigma_{RB}$$

This means that also similar crack zone behaviour with respect to transverse expansion should be established. This can be done, e.g., by scaling up the particles of the matrix, e.g., with the requirement that $$\frac{d_{part.B}}{d_{part.A}} = \frac{d_B}{d_A}$$

here, thus, by a factor 10

Complex Local Matric Compression Failure

FIG. 20, G and H, show surface structures of reinforcement components with ridges/protrusions 11 and 1. Such designs of reinforcement components can be very beneficial with respect to anchoring capability and are often preferred and are widely used, e.g., in reinforcement for reinforced concrete.

A scaling will also require scaling of the ridges/protrusions/surface contour, geometrically:

$$\left(\frac{f}{d}\right)_A = \left(\frac{f}{d}\right)_B; \left(\frac{f}{d_{part}}\right)_A = \left(\frac{f}{d_{part}}\right)_B$$

During displacement of the reinforcement, the ridges will typically result in local failure/flow in the matrix. This is illustrated at the front of a ridge 12 by a fracture/flow zone 13. This is a typical compression failure under complex triaxial tension distribution. In order to simulate this often essential effect which is often a considerable contribution to the total shear resistance, similar complex failure must be simulated, including identical ratio between compression strength and tensile strength $$\left(\frac{\sigma_c}{\sigma_0}\right)_B = \left(\frac{\sigma_c}{\sigma_0}\right)_A$$

This example, thus, illustrates a) the complexity of the behaviour at simple displacement/pulling out of a reinforcement component in/from matrix b) aspects in the building up of model tools according to the present invention for modelling the complex behaviour.

In real life, local failure/fracture in reinforced composites is often even more complicated. Based on the principles of the present invention, composite structures, even very large composite structures, which utilize reinforcement effectively not only in tension, but also in shear and in bending.

The model concept of the present invention is uniquely suited for developing, through model experiments, such composite structures.

Figure 25A:
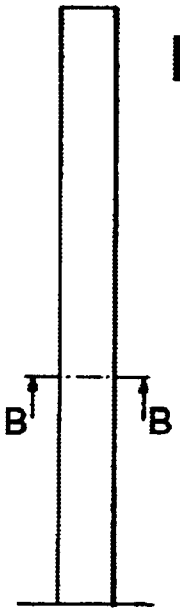
FIG. 25A illustrates a part of a very high building.
Figure 25B:
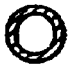
FIG. 25B shows a section of the structure of FIG. A.
Figure 25C:
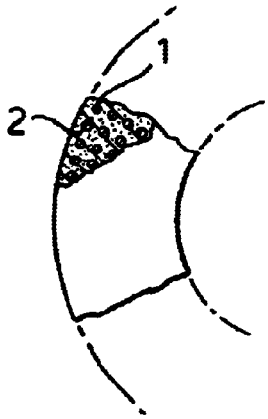
FIG. 25C shows an enlarged part of the section of FIG. B with reinforcing bars.

FIG. 25A illustrates a part of a very high building, e.g., the core of a 480 meter high rise tower made of very strong conventional reinforced concrete. FIG. 25B shows a section in that structure, and FIG. 25C shows an enlarged part of the said section B with reinforcing bars 1 of diameter, e.g., 25 mm, surrounded by matrix material 2 in the form of conventional high quality concrete of very high compressive strength, (e.g., $\sigma_c$=80 MPa).

It is now desired to

I. Evaluate/estimate the performance of the high rise structure under accidental loading such as
   explosions,
   impact, such as from collision with an aeroplane,
   earthquake.

II. If necessary de novo-designing such high structures, still with the use of materials having great similarity with materials used for conventional high strengh concrete, but arranged according to principles derived in the present invention, II. to design, and construct, using far stronger materials, such as DSP-based materials, new giant high-rise structures with heights of 1000–2000 meter capable of performing well also under heavy accidental loading.

This is done using the design principles according to the present invention, based on simulation of the behaviour by physical model testing.

Figure 25D:
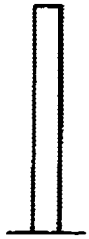
FIG. 25D shows a small physical model which is tested according to the principles of the invention.
Figure 25E:
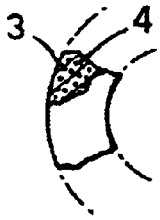
FIG. 25E shows a part of the section of FIG. D, geometrically similar to the part of FIG. C with reinforcement and surrounding fine matrix.

FIG. 25D shows a small physical model which is tested according to the principles of the invention. As an example, the size ratio $$\frac{L_D}{L_A} \approx 1/100$$

where $L_A$ is a characteristic size, such as the height/length, of the large structure A, and $L_d$ is the corresponding size of the model. FIG. 25E shows a part of a section in D, geometrically similar to the part C of the section of the large concrete structure A, with reinforcement 3 and surrounding fine matrix 4. Based on $$\frac{L_D}{L_A} \approx 1/100$$

and the requirement of geometric similarity, this means, e.g. that a) the reinforcement 3 is in the form of 0.25 mm threads, versus say 25 mm bars in the large concrete structure A, b) the fine matrix 4 has a maximum particle size of 160 $\mu$m, versus, e.g., $d_{max}$=16 mm in the concrete structure.

Then, a series of tests is performed with such models, with influences simulating various forms of "accidental loading". Assuming that assessments of expected behaviour of the real large concrete structure under accidental loading have shown that a surprisingly unacceptable behaviour must be expected, with very low resistance against such expected/feared accidental influences and with a disastrously brittle fracture behaviour, it is then desired to II. Redesign, with concrete-like materials, e.g. with substantially the same compressive strength but with new design principles using very large reinforcement dimensions.

Thus, according to these principles, the focus is on 1) using far larger reinforcement, such as reinforcement with 10 times larger diameters, i.e. 250 mm diameter, and 2) at the same time providing the matrix with better fracture performance, that is, larger toughness on all levels. This may be done by introducing larger discrete rods, e.g. 10 mm, combined with fibres, e.g., d=1 mm and large strong particle-like bodies, e.g. 160 mm.

Figure 25F:
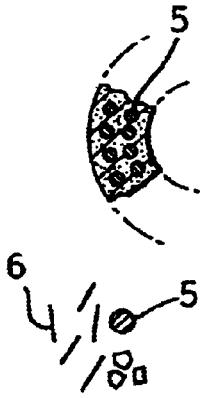
FIG. 25F shows a part having a defined structure.

In order to evaluate his new design, model tests are again performed as described above, but with the new structure arrangements; for example, as illustrated in the section part shown in FIG. 25F with a) reinforcement 5 with a diameter of 2.5 mm and b) matrix material with maximum particle size 1.6 mm and c) toughened with 0.1 mm fibres 6, e.g. 1% by volume thereof.

Figure 25G:
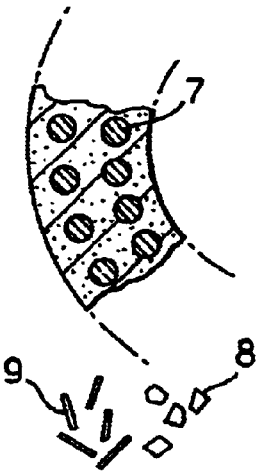
FIG. 25G show part of a section of the structure of FIG. 25F.

Assuming that with model structures, acceptable/good failure/fracture behaviour has been found, then the scaling principles of the present invention provide a tool for designing the new reinforced "concrete" structure. FIG. 25G shows part of a section of such a structure. The actual numerical values are:

main reinforcement 7: diameter 250 mm, in the form, e.g., of a "composite" reinforcement "concrete" with large particles/bodies 8 of a diameter up to 160 mm toughened with small 10 mm diameter rods, e.g. 1% by volume), and additionally 1% by volume of 1 mm diameter fibres.

Compared to the conventional strong reinforced concrete used in a), the properties may, e.g., be as shown in the following table:

| | Concrete | New "concrete" |
|---|---|---|
| Compressive strength, Mpa | 80 | 80 |
| Fracture energy N/m | 150 | 4500 |
| Toughness number (relative) | 1 | 30 |

This means a much better design, with 30 times larger toughness.

III. Design of new high-rise structures, height 1000–2000 meters

Figure 25H:
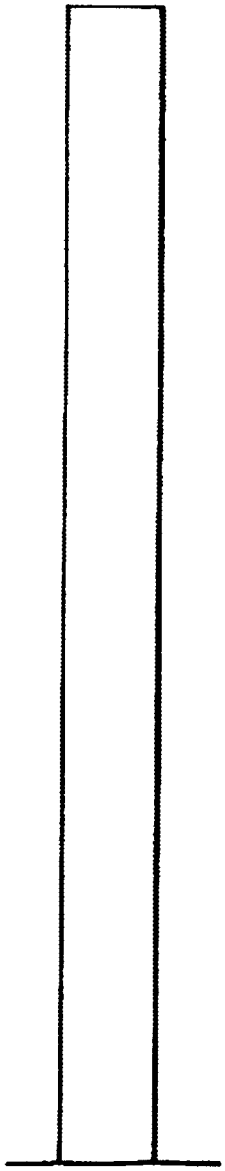
FIG. 25H shows part of a high-rise structure in accordance with the principles of the invention.
Figure 25I:
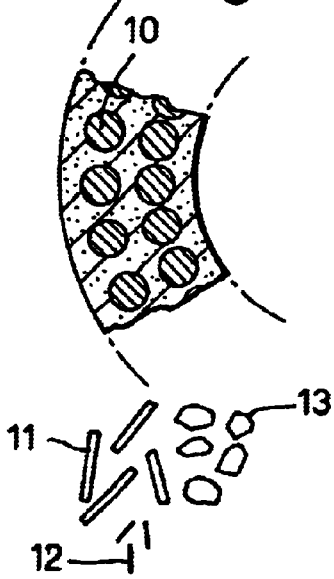
FIG. 25I shows a prototype/model in accordance with the invention.

Such a structure is shown in FIG. 25H.

The results of the above-described model test is used as a first guide. It is assumed that large Compact Reinforced Composite (CRC) structures with compressive strength 400 MPa and density ρ=3500 kg $m^3$ (compared to 2500 kg /$m^3$ for conventional reinforced concrete) are available for the task.

Height of Tower, L

Assuming that gravity forces are the dominating external forces, the following model law applies to geometrically similar towers:

$$\frac{\rho g L}{\sigma_c} = constant$$

This means that on the basis of known art towers, the height of the new giant towers can be estimated:

With the above-stated values, the length ratio is calculated:

$$\frac{L_H}{L_A} \approx \frac{2500}{3500} \cdot \frac{400}{80} \approx 3.6$$

and with $L_A \approx 500$, the height of the new giant towers could be $L \approx 500 \cdot 3.6 \approx 1800$ meter.

This means that it is possible to operate in the range of L=1500–2000 m with respect to maximum height. In the following, L=1800 m is considered.

It is assumed that a good solution has been found via model experiments with models in a size as earlier and that the components are as shown at F, but in other configurations, other weight ratios, etc., and of other materials with other strengths. It is further assumed that in the new model experiments, optimum structures have been found, e.g., 2.5 mm reinforcement/high concentration/strong $d_{max}$, 1.6 mm particles/strong 0.1 mm fibres (high concentration, strong).

Based on this, the method of the present invention provides a tool for designing the giant towers.

With a length ratio prototype/model of $$\frac{L_H}{L_D} = 360$$

the result for the prototype is, e.g., as shown in FIG. 25, a part of a section I:

Main reinforcement 10:

composite reinforcement, diameter 900 mm toughening rods 11, diameter 36 mm plus diverse smaller rods, e.g. diameter 4 mm and fibres, e.g. diameter 0.4 mm, and compact strong bodies, maximum size ≈600 mm.

To obtain the same degree of overall toughness in H as in the smaller, but reasonably tough structure G, there are the following requirements with respect to matrix toughness:

$$\left(\frac{EG}{\sigma_m^2 L}\right)_H = \left(\frac{EG}{\sigma_m^2 L}\right)_G$$

This has given an indication of the fracture energy G which must be created in the strong matrix by mans of the rods, fibres, bodies, etc.:

$$G_H = \frac{E_G}{E_H}\left(\frac{\sigma_{m.H}}{\sigma_{m.G}}\right)^2 \frac{L_L}{L_G} \cdot G_G$$

assuming the following material property ratio and size ratios $$\frac{E_H}{E_G} = 2;\ \frac{\sigma_{m.H}}{\sigma_{m.G}} = 5;\ \frac{L_H}{L_G} \cdot 3.6$$

and with

G≈4.5 kN/m (se the table above)

we get $$G_H = \frac{1}{2} \cdot 5^2 \cdot 3.6 \cdot 4.5 \approx 200 \text{ kN/m}$$

Thereby, a unique giant structure has been made possible.

PART C

In this part C, there is described principles and methods useful not only in implementing the aspect of the invention described herein, but also some of the teachings of part A, including the shaped articles described therein. Some of the teachings of the preceding part B, and the principles and methods described therein, are relevant in the context of the present aspect of the invention. Such relevant material should be referred to where appropriate in putting into practice the teachings of this part C.

An aspect of the present invention relates to a special method of making a reinforced structure of the above-discussed type including a body of solidified matrix material and reinforcing elements surrounded thereby.

One method of making the structures is the classical method of providing a mould or cavity in which the reinforcing elements are positioned in the desired arrangement, and subsequently filling liquid or plastic matrix material into this mould or cavity where the matrix material is allowed to solidify so that the reinforcing elements are embedded therein.

Efficient methods for casting bodies and articles with complex internal structure using mechanical vibration are disclosed in U.S. Pat. No. 4,979,992, the contents of which are hereby incorporated by reference.

As mentioned above, however, an aspect of the present invention provides a new method by means of which such reinforced structures may be made in a more flexible manner, allowing production of reinforced structures with characteristics which to a great extent may be selected and designed to fulfil predetermined criteria.

Thus, the present invention provides a method of making a reinforced structure of the type including a body of solidified matrix material and one or more reinforcing elements surrounded thereby, in particular embedded therein, said method comprising shaping, e.g. moulding or casting, and solidifying matrix material so as to form a matrix body, shaping the matrix body with at least one elongated space and/or cavity therein, or arranging said matrix body members adjacent to each other so as to form thereby such matrix body with such at least one space and/or cavity, arranging at least one reinforcing element within said at least one space and/or cavity, and interconnecting the matrix body or body members and the reinforcing element or elements so as to form said reinforced structure or reinforced structure element.

The method is novel in itself, not limited to large rods or plates. However, it is especially suited for creating the structures described in Parts and B According to the present invention the matrix body may be shaped, e.g., moulded, in one or more parts and separately from the reinforcing elements.

An interesting alternative that may be used for all or part of the matrix bodies of a final reinforced structure is that the individual matrix body may be shaped from a shapeable matrix body in contact with the reinforcement with which it is later to be in intimate contact, the shapeable body thereby being given its final shape or substantially its final shape. The thus shaped matrix body may then be allowed to solidify, either as the final matrix body or as a "green" body which is then subjected to its final shape- and strength-conferring solidification, such a by a high temperature sintering, at least this final shape- and strength-conferring treatment being performed with the matrix body separated from the reinforcement.

After the final solidification of the matrix body or matrix body members they may be positioned as desired mutually and in relation to the reinforcing elements. Finally, the matrix body or matrix body members and the reinforcing elements may be bound together by suitable binding or interconnecting means so as to form a unitary reinforced structure. By choosing among a great variety of binding or interconnecting means, including mechanical means and adhesives, it is possible to obtain a desired mechanical behaviour of the reinforced structure when exposed to an excessive load, such as a controlled mutual sliding of the matrix material in relation to the reinforcing elements with controlled energy absorption.

The method according to the invention allows a high flexibility in making the matrix body or matrix body members. Thus, a desired number of matrix body members may be used for forming the matrix body which means that the actual size or dimensions of the reinforced structure to be produced does not necessarily dictate the method and equipment to be used for moulding the matrix body members forming the matrix body. Thus, the matrix material may be vibrated, compressed or otherwise compacted by means of the most efficient equipment available, exposed or heated to a desired temperature, surface finished, exposed to electrical or magnetic fields, and/or to radiation to, e.g., effect hardening of a binder, e.g. polymerisation of a monomer, such as radioactive radiation.

Because the size of the matrix body members may to a high degree be selected according to the intended final use of the resulting structure, the matrix body or matrix body members may be machined or subjected to another mechanical treatment subsequent to moulding and solidification thereof.

The reinforcing elements may be interconnected to the matrix body or body members by any suitable means, such as mechanical means, e.g., bolting, riveting, binding or tying or welding, or complementary, mutually engageable shapes, etc. If it is desired to make the final structure detachable, bolting or tying, optionally combined with complementary, mutually engageable shapes may be the preferred interconnecting means. In many cases, however, the interconnection will be obtained by means of one or more binders which are able to bind to adjacent surfaces of the matrix bodies and/or to adjacent surfaces of the reinforcing elements and the matrix body or matrix body elements, respectively. The binder or binders used may be any glue, adhesive or other binding agent. The binder or binders, which may be a one, two or a multi-component binder, may be introduced or injected into the spaces or cavities of the matrix body in a paste-like or liquid form, when the reinforcing elements have been arranged therein, and subsequently allowed to solidify within the spaces or cavities.

Alternatively, or as a supplementary measure, a binder or binder component may be applied to the outer surface of the reinforcing elements prior to arranging the reinforcing elements in the spaces or cavities. Alternatively or additionally the binder or a binder component may be applied to the inner surfaces of the matrix body or body members defining the spaces or cavities prior to arranging the reinforcing elements within these spaces or cavities. When a two component or multi-component binder is used at least one further gaseous or liquid binder component may subsequently be introduced into the spaces or cavities of the matrix body so as to activate the binder composed by said components, and/or the binder system may be activated by irradiation, including radioactive irradiation.

As previously indicated, when the matrix body is formed by two or more body members having adjacent surface parts, such surface parts may be shaped so as to mechanically interlock said matrix body members. Similarly, the surface parts of the reinforcing elements on one hand and adjacent surface parts of the matrix body or matrix body members on the other hand may be shaped so as to mechanically interlock the reinforcing elements and the matrix body or body members. As an example, the interlocking surfaces may form a dove tail connection or have any other complementary shapes preventing mutual movement of the interlocked parts in at least one direction.

It will be understood that the above-mentioned interconnecting techniques may be combined with each other in any suitable way adapted to the particular purpose.

The combination of the matrix body or matrix bodies and the reinforcement should be adapted to the particular use of the final structure. Thus, the matrix and the reinforcement should be interconnected in such a manner that they have a controlled interaction with each other with respect to the desired properties dictated by the end use. Evidently, to be able to function as a reinforcement proper, the reinforcement "adjacent" to the matrix should not only be in contact with the matrix, but should, for most purposes, be embedded in the matrix such as is also the case with final structures which are made by casting or moulding the matrix around the reinforcement. However, it is a particular advantage of the present invention that the interconnection between the reinforcement and the matrix can be made to have any desired firmness, varying from a rather loose interconnection allowing a controlled sliding greater than a sliding in a structure made by conventional casting around a reinforcement to a very firm interconnection with a positive compressive force between the matrix and the reinforcement permitting less sliding than in a structure made by conventional casting. In both cases, it may be possible to obtain an interaction between matrix and reinforcement which is better controlled than in structures made by conventional casting.

The matrix material may or may not contain other types of reinforcement. Thus, when each of the matrix body members are made, any type of smaller reinforcing means may be included therein in a known manner and may form a secondary group or subgroup of reinforcements or subordinate reinforcements in the final reinforced structure being formed. Such smaller reinforcing means may comprise fibres, wires, rods, strands, net-like structures, sheets, and/or plates. Very interesting structure systems that may be implemented in the individual matrix bodies or matrix body members are the so-called CRC structures disclosed, e.g., in U.S. Pat. No. 4,979,992. It should be understood that while the subordinate reinforcement means are embedded in each of the matrix body members when moulding the same, the "main" reinforcing members of the final structure are separate from the matrix body and the matrix body members until the matrix body or matrix body members have been finally solidified and are assembled with the separate "main" reinforcement members to form the reinforced structure.

As an important example, the matrix material may a fibre reinforced material. Alternatively or additionally, the matrix body or the matrix body members may be more complex or elaborate composite material body. In the latter case the matrix body or body members may, for example, be formed by stacking two or more flat, solidified matrix body parts with intermediate layers of a binder material, which may or may not be different from any of the binders used for interconnecting the matrix body members and the reinforcing elements. Said binders and/or binding material may contain reinforcing fibres or other reinforcing means.

When the matrix body or body members are constituted by stacked matrix body parts the spaces or cavities for receiving the reinforcing elements are preferably formed in the matrix body so as to extend transversely to said flat matrix body parts, whereby the reinforcing elements may strengthen the bonds between the matrix body parts and matrix body members forming the matrix body.

Usually it is desirable to form the matrix body from a material which is compact strong. However, in some cases it may be desirable that the solidified matrix material is a porous material, and a suitable binder may then be injected into the pores of the porous material. Thereby this material may be made compact and strengthened, and preferably at the same time the matrix body members and/or the matrix body members and the reinforcing elements may be mutually interconnected.

The various matrix body members forming the matrix body of the reinforced structure being made by the method according to the invention may be made from the same type of matrix material. However, in some cases the matrix material may advantageously comprise two or more different materials, i.e. at least first and second different materials having different characteristics. The matrix body members forming a single matrix body may then be made from such different materials. The various matrix body members made from two or more different matrix materials may then be mutually arranged in the matrix body so as to impart desired strength or other characteristics to the final reinforced structure. As an example, matrix body members made from said first matrix material may be arranged adjacent to at least some of the reinforcing elements, while matrix body members made from said second matrix material may be spaced from such reinforcing elements, so as to obtain a desired failure behaviour of the final reinforced structure.

The reinforced structure made by the method of the present invention may be of any kind, whether large or small. By way of examples the reinforced structure may be a tu machine part, such as a machine part reinforcement with plate-shaped reinforcement according to the invention or the reinforced structure may be a much larger structure, such as a building structure and the reinforced body element may be a building structure element, such as a structure element for a bridge, such as a bridge pier, a building, a military defence structure, or the like.

Depending on the kind of structure to be made, the matrix material may be selected from a group of suitable materials, such as cement-based materials, ceramics-based materials, metal- or metal alloy-based materials, plastics materials, glass, or any other mouldable and solidifiable material. As mentioned above, the materials may suitably be of the type advanced particle-based composites such as DSP materials. The terms "mouldable material" and "solidifiable materials" and the starting materials from which the "solidified materials" are made should be understood to comprise any liquid or plastic material which may harden or solidify, and any powdered or particulate material which is mouldable and solidifiable, for example by compression and/or heating and/or sintering so as to provide a unitary, coherent body. The powdered or particulate material may include a binder which may be activated by compression, radiation and/or heating or in any other manner. In the method according to the invention the size or dimensions of the matrix body members may be chosen such that the moulding process is as efficient as possible by using the processing equipment available. As mentioned above, the so-called CRC structures are interesting structures of the matrix materials.

A special, but in some cases important, matrix material may be natural rock which is shaped, by cutting and/or grinding, to achieve a suitable shape for the particular matrix body or matrix body element or part in question.

Some kinds of matrix materials, such as ceramic materials, are solidified at very high temperatures, which would destroy or deteriorate the material of many otherwise available reinforcing elements. Therefore, the conventional method of embedding reinforcing elements therein can not be used. By using the method according to the invention in which the matrix body or matrix body elements are made separately and subsequently combined with the reinforcing elements this problem is solved.

The reinforcing elements used in connection with the method of the present invention may be of any suitable type which may be arranged within the spaces or cavities defined in the matrix body. Thus, the reinforcing elements may be in the form of rods, wires, strands, plates, sheets, and/or profile members, and such reinforcing elements may be made from any suitable material conventionally used for such purpose, such as metals, metal alloys, glass, plastics material and carbon.

The present invention further provides a reinforced structure or a reinforced structure element including solidified matrix material and reinforcing elements surrounded thereby, said reinforcing structure comprising a matrix body made from solidified matrix material or from two or more separate matrix body members of solidified matrix material, reinforcing elements arranged within elongated spaces or cavities formed in the matrix body, and at least one binder different from the matrix material adjacent to the reinforcing elements for interconnecting the matrix body or body members and the reinforcing elements. The binder or binders may be selected so as to provide good bonds between opposite surfaces of the matrix body members on one hand and between the matrix body or matrix body members and the reinforcing elements on the other hand. Furthermore, the binder or binders may be chosen so as to impart desired strength characteristics to the reinforced structure.

Figure 26:
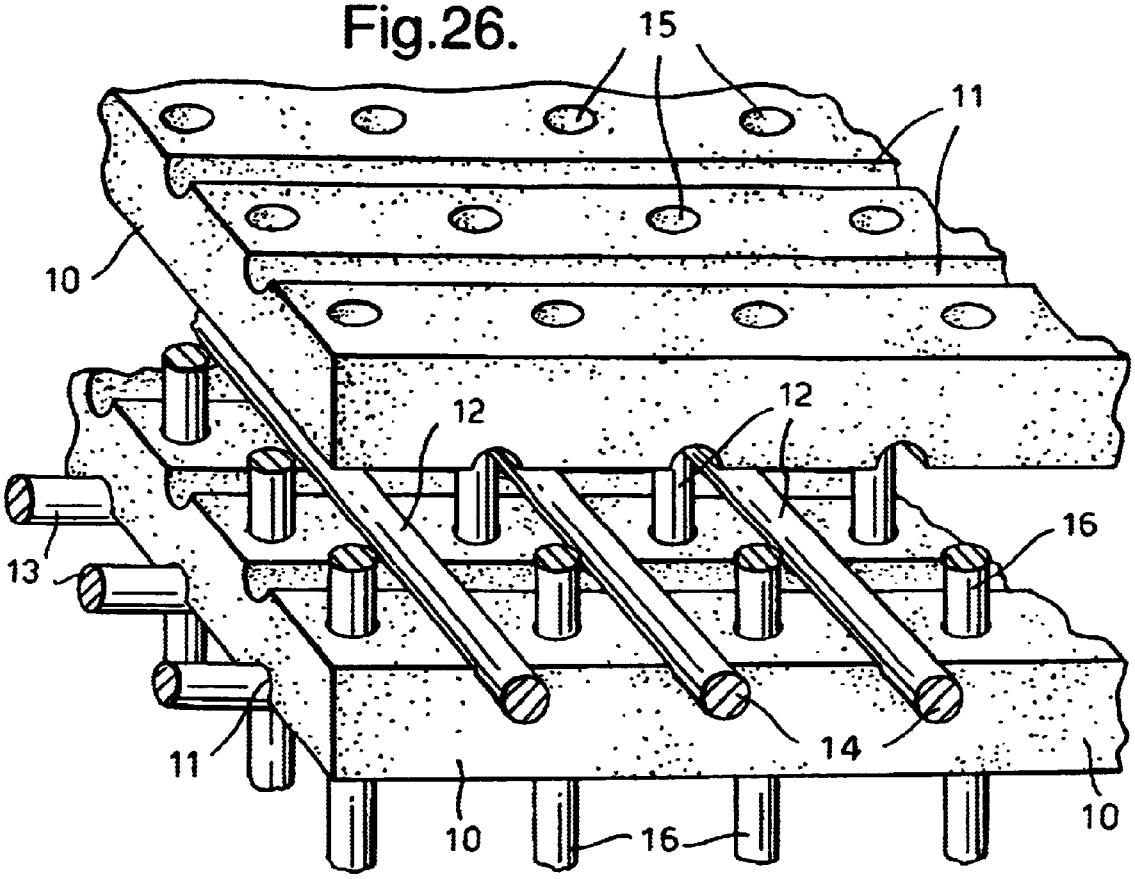
FIG. 26 is a perspective view of part of an embodiment of the reinforced structure according to the invention.
Figure 27:
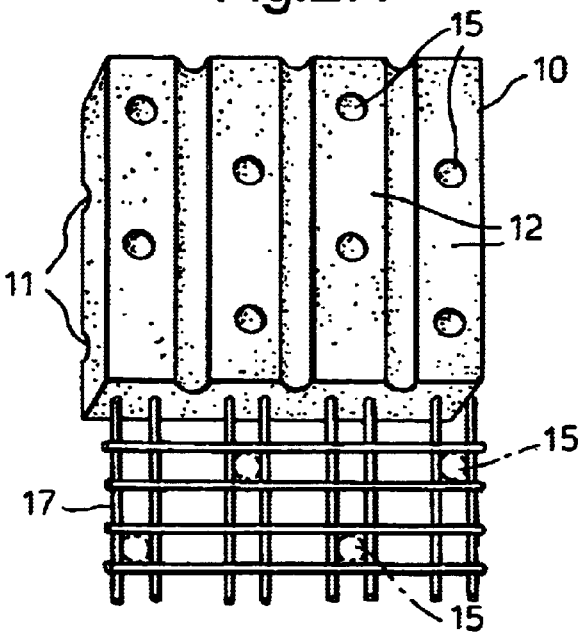
FIG. 27 is a plan view and partly sectional view of a matrix member forming part of the structure shown in FIG. 26.
Figure 30A:
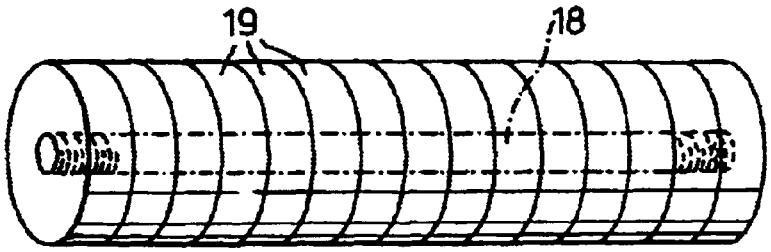
FIGS. 30A–C illustrate a reinforcing element surrounded by a plurality of matrix body members.
Figure 30B:
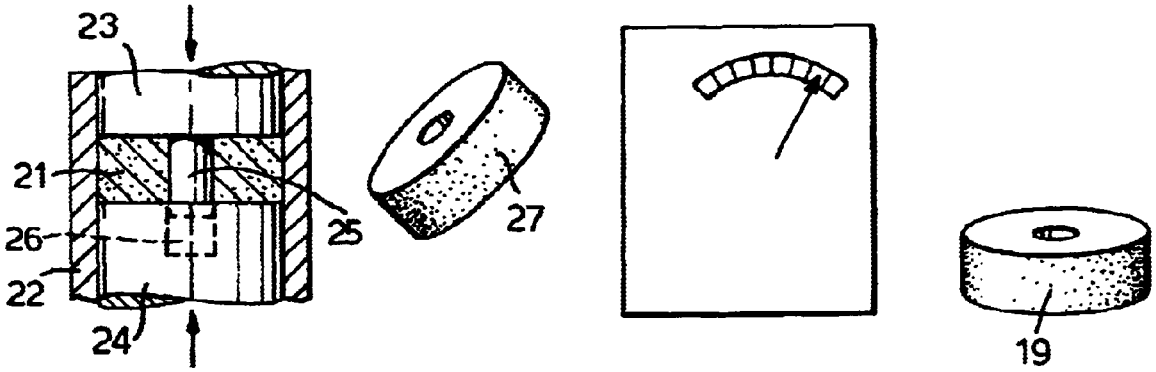
Figure 30C:
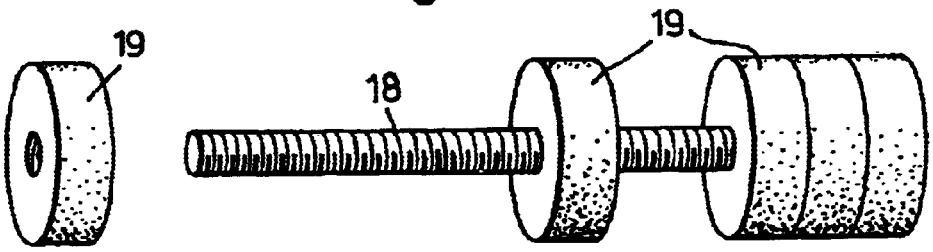
Figure 31:
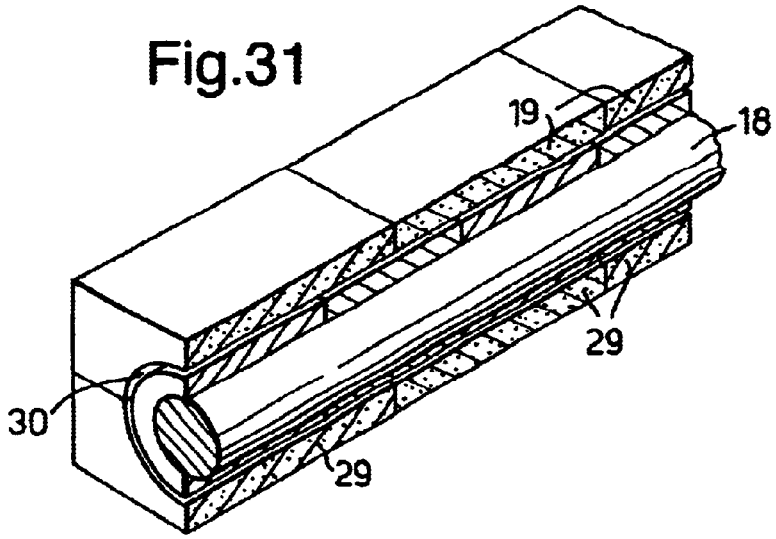
FIG. 31 illustrates a reinforcing element surrounded by two layers of matrix body members.
Figure 32:
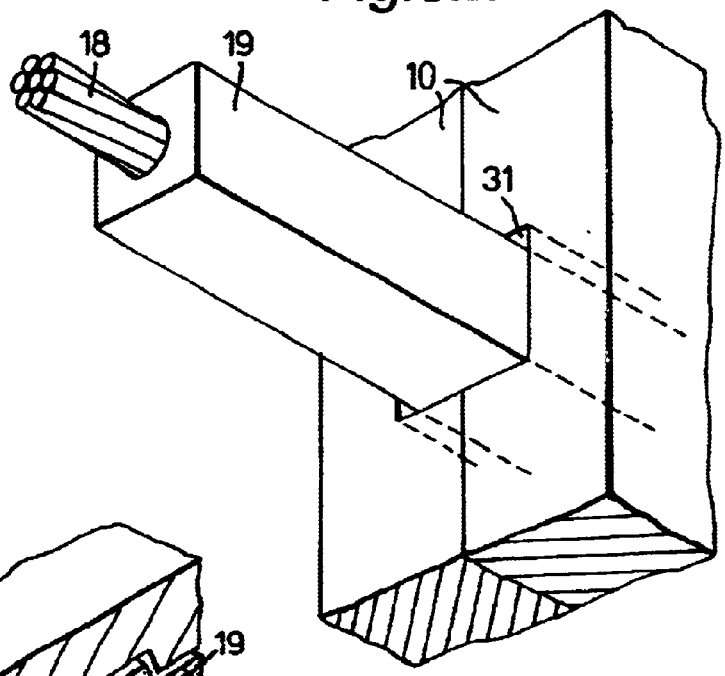
FIGS. 32–32 illuatrate various embodiments of the structure according to the invention.
Figure 33:
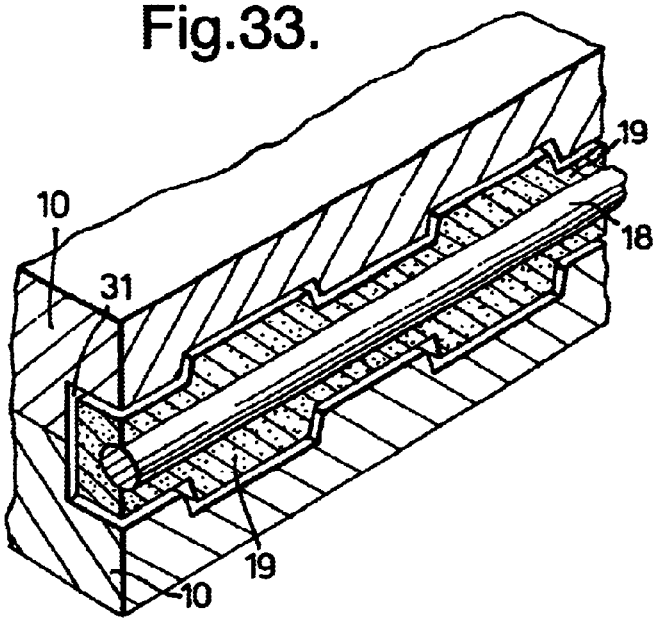
Figure 34:
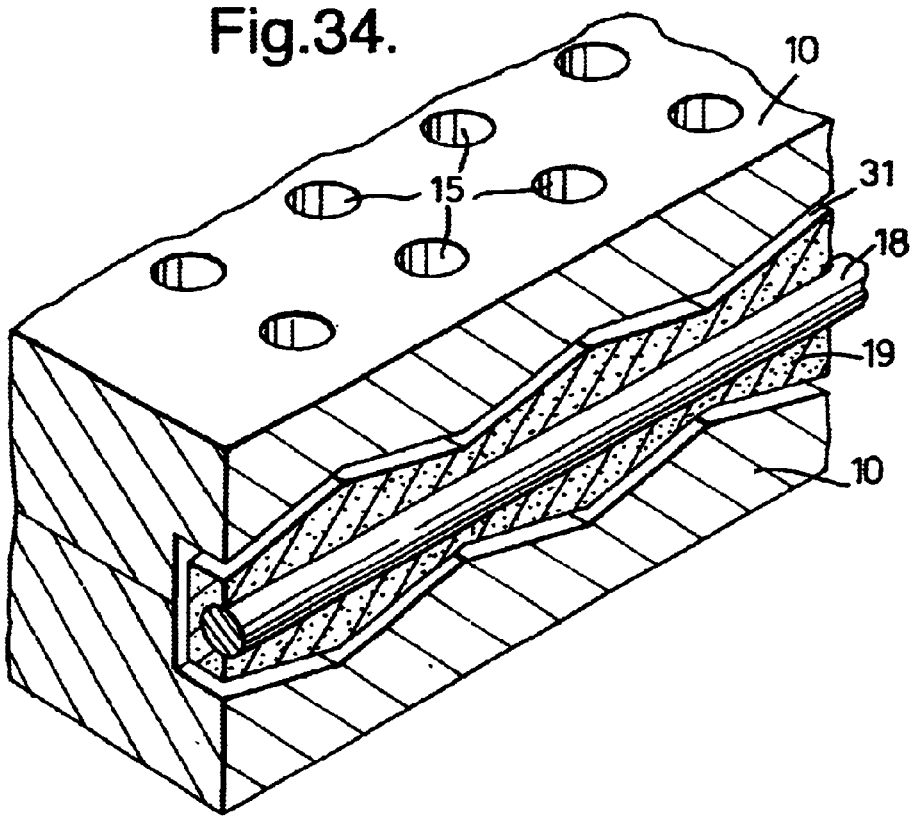
Figure 35:
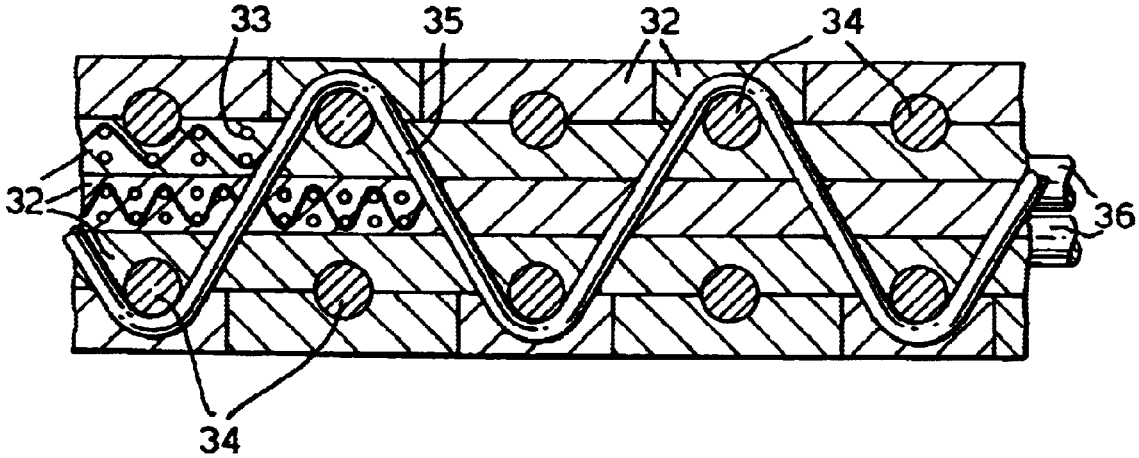
FIG. 35 is a perspective view of another embodiment of the structure according to the invention.
Figure 36:
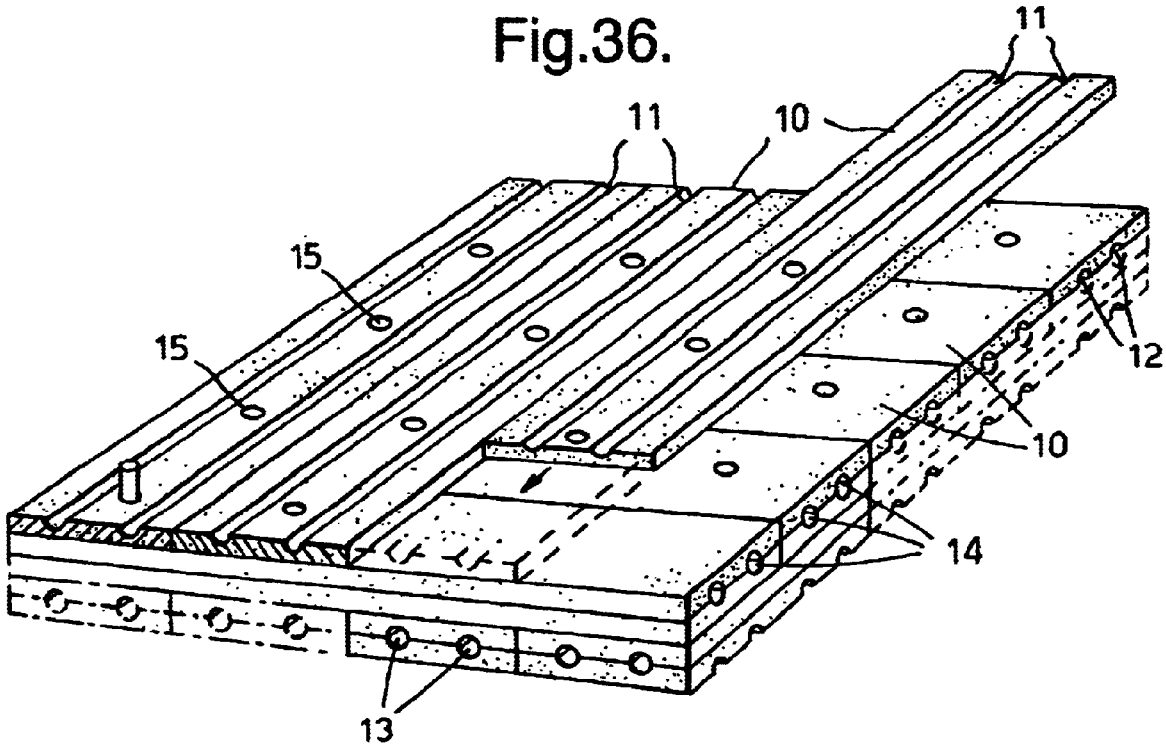
FIG. 36 is a perspective view of another embodiment of the structure according to the invention.
Figure 37:
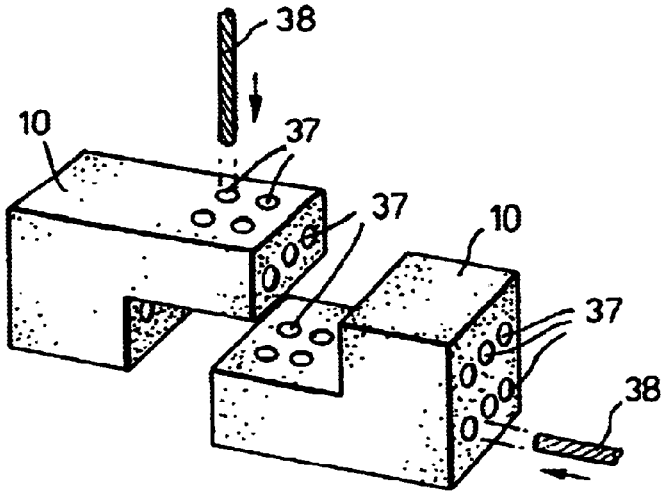
FIG. 37 illustrates a structure comprising matrix body member with mutually engaging complementary surfaces and wire-shaped reinforcing members.
Figure 38A:
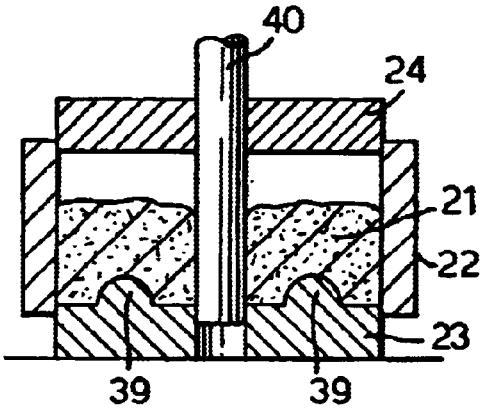
FIGS. 38A–D illustrate a method of making a matrix body member.
Figure 38B:
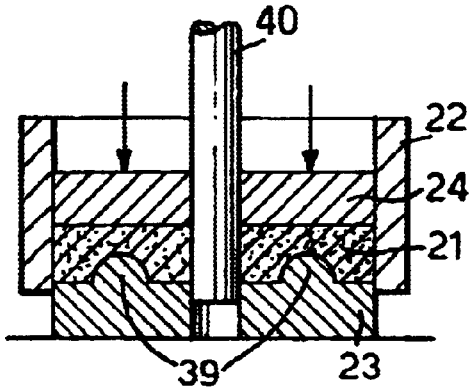
Figure 38C:
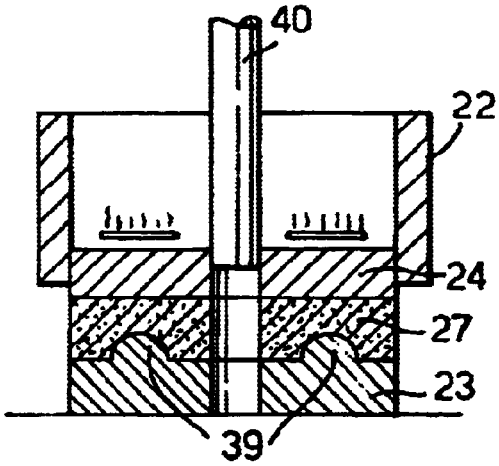
Figure 38D:
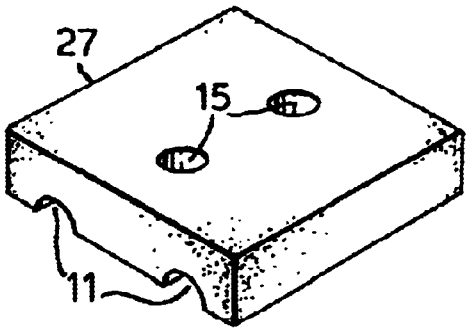
Figure 39A:
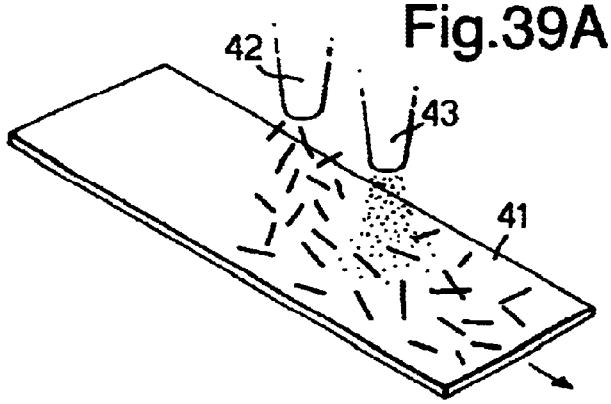
FIGS. 39A–D illustrate a method for making a plate shaped matrix body member.
Figure 39B:
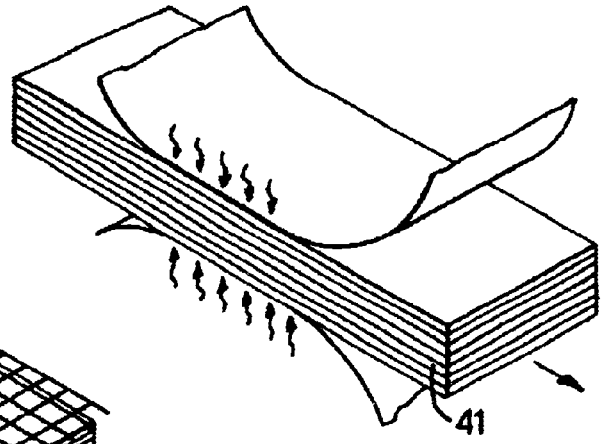
Figure 39C:
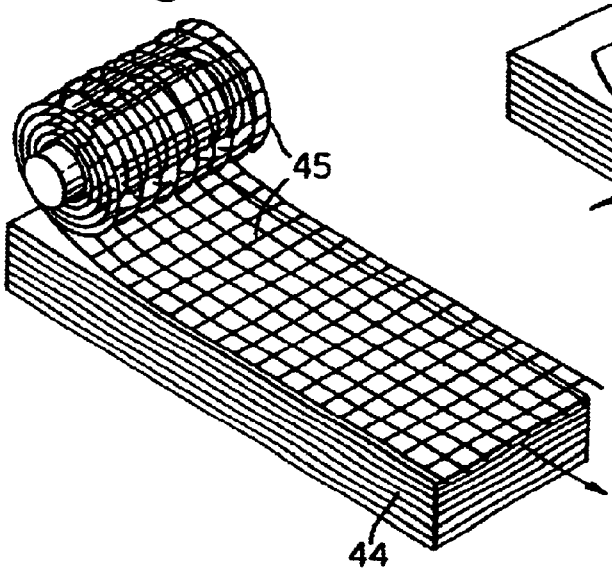
Figure 39D:
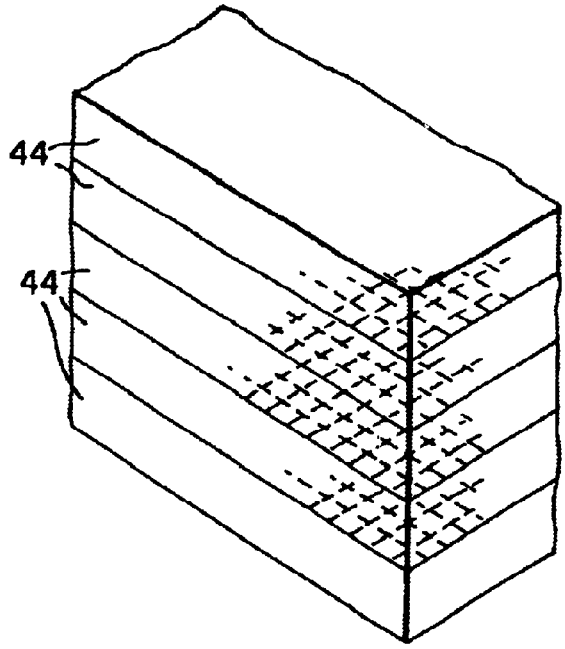

The above-described aspect of the invention will now be further described with reference to the drawings, wherein FIG. 26 is a perspective view of part of an embodiment of the reinforced structure according to the invention, FIG. 27 is a plan view and partly sectional view of a matrix member forming part of the structure shown in FIG. 26, FIG. 28 shows different types of reinforcing elements, which may be used in connection with the present invention, FIG. 29 and 30 illustrates a reinforcing element surrounded by a plurality of matrix body members, FIG. 31 illustrates a reinforcing element surrounded by two layers of matrix body members, FIGS. 32–34 illustrate various embodiments of the structure according to the invention in which structures of the type shown in FIGS. 28–30 are incorporated, FIG. 35 is a cross-sectional view of a further embodiment of the structure according to the invention FIG. 36 is a perspective view of another embodiment of the structure according to the invention, FIG. 37 illustrates a structure comprising matrix body members with mutually engaging complementary surfaces and wire-shaped reinforcing members, FIG. 38 illustrates a method of making a matrix body member, FIG. 39 illustrates a method for making a plate shaped matrix body member, and FIG. 40 illustrates how a reinforced structure may be made from plate shaped matrix body members, such as those shown in FIG. 39.

FIG. 26 shows a first embodiment of a reinforced structure according to the invention. The structure comprises a plurality of matrix body members 10 having parallel grooves or channels 11 and 12 formed in opposite side surfaces thereof. The grooves or channels 11 and 12 extend transversely and preferably at right angles to each other, and the channels 11 and 12 formed in abutting side surfaces of adjacent body members 10 define bores or passages for receiving reinforcing elements 13 and 14. An array of aligned bores 15 formed in the body members 10 extend substantially at right angles to the side surfaces of the body members and are adapted to receive further reinforcing elements 16.

The body members 10 are made separately from a mouldable matrix material, for example from concrete, another cement based or from a DSP material which may be cement-based, plastics-based or metal-based, by moulding or casting. Because the size of each body member 10 is small compared to the size of the structure made thereby, the matrix material being shaped may be efficiently compacted by compression and/or vibration in a known manner. If desired, the matrix material from which the body members are made may be fibre reinforced. Alternatively or additionally a net-like reinforcement 17 or similar reinforcing means may be embedded in the matrix body members 10 during moulding thereof, as shown in FIG. 27.

Figure 28A:
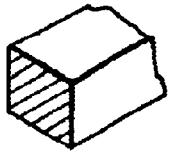
FIGS. 28A–F show different types of reinforcing elements, which may be used in connection with the present invention.
Figure 28B:
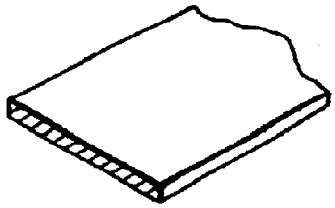
Figure 28C:
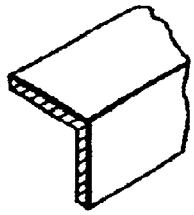
Figure 28D:
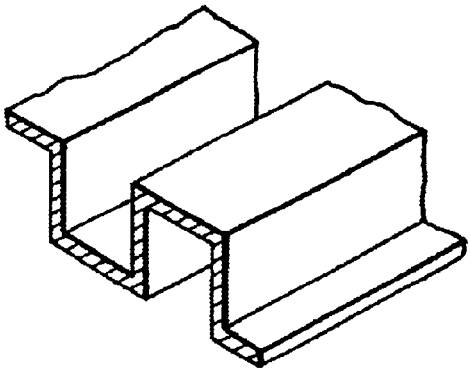
Figure 28E:
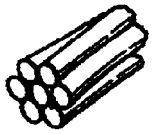
Figure 28F:
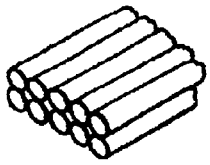

The reinforcing elements 13, 14 and 16 shown in FIGS. 26 and 27 are rod-shaped metal elements having a substantially circular cross-section. They, may, according to the invention, be large with diameter, e.g., 60–100 mm, or very large, with diameter, e.g., 600–1000 mm. However, as illustrated in FIG. 28 the cross-sectional shape of the reinforcing elements may be different. Thus, FIG. 28*a–d* show square, rectangular, angular, and meander-shaped cross-sectional shapes, respectively. Preferably, the cross-sections of the structure passages receiving the reinforcing elements correspond to the cross-sectional shapes of the reinforcing elements. FIGS. 28*e* and 28*f* illustrate reinforcing elements formed by fibres or wires in a round and a flat cross-sectional arrangement, respectively.

The matrix body members 10 and reinforcing elements 13, 14 and 16 forming the structure illustrated in FIG. 26 are interconnected by a suitable binder, which may be applied to adjacent surfaces of the structure components when building up the reinforced structure, or the binder in liquid form may be injected into the spaces defined between adjacent body members 10 and between body members 10 and adjacent reinforcing elements 13, 14 and 16 subsequent to assembling the matrix body members and the reinforcing elements.

Figure 29A:
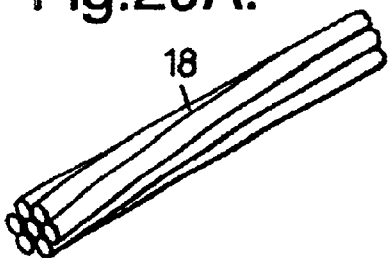
FIGS. 29A–C illustrate a reinforcing element surrounded by a plurality of matrix body memebers.
Figure 29B:
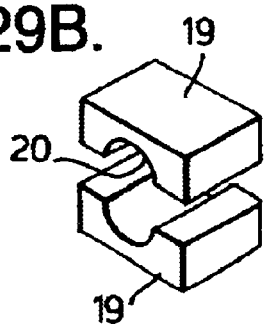

FIG. 29*a* shows a reinforcing element 18 in the form of a bundle of wires twisted together. Reinforcing elements of this type may be used in a reinforced structure as shown in FIG. 26. However, each such reinforcing element 18 may be enclosed within a plurality of solidified lining members 19. FIG. 29*b* illustrates a pair of such lining members 19, which together defines a through-going bore 20 for receiving the reinforcing element 18 therein. The lining members 19 may be interconnected and bound to the reinforcing element 18 by means of one or more binders. Lined reinforcing elements of the type shown in FIG. 29*c* may replace the reinforcing elements 13, 14, and 16 in a structure of the type shown in FIG. 26. The matrix body members 10 and the lining members 19 may be made from different matrix materials having different strength characteristics. Therefore, by combining suitable different matrix materials a reinforced structure according to the invention having desired strength and failure behaviour characteristics may be obtained.

Figure 29C:
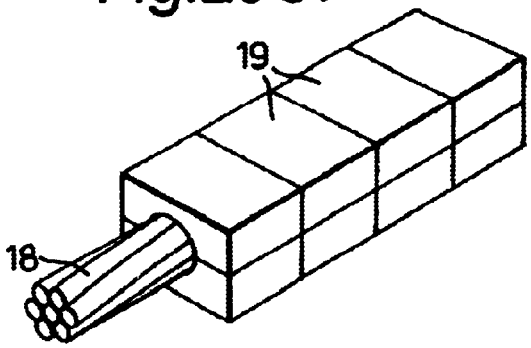

FIG. 30 illustrates a method for producing a lined reinforcing element corresponding to the lined reinforcing element shown in FIG. 29*c*. The lined reinforcing member shown in FIG. 30*a* comprises a rod-shaped reinforcing element 18 surrounded by a plurality of annular lining members 19 threaded thereon. The reinforcing element 18 is preferably made from steel or another metal and the lining members 18 may, for example be made from ceramics or a similar material. As illustrated in FIG. 30*b* the annular or ring shaped lining members 18 may be formed from a particulate starting material 21 in a compression mould 22 comprising a cylinder and a pair of opposed pistons or plungers 23 and 24. One piston 23 has a central projection or stud, which may engage with a corresponding blind bore 26 in the other piston 24. In the mould the particulate material may be compressed so as to form a "green" sample. The green samples 27 may be heated in a furnace or oven to a sintering temperature, such as about 1400 degrees centigrades—indicated at 28—so as to form the annular lining members 19. Finally, the lining members 19 may be threaded on the rod-shaped reinforcing element 18 as illustrated in FIG. 30*c* and bound together and to the rod 18 by means of a suitable binder. Lined reinforcing elements thus produced may be used for making a more complex structure of the type shown in FIG. 26.

FIG. 31 illustrates an example of a rod-shaped reinforcing element 18, which is provided with a double lining. Thus, the lining comprises an inner lining formed by a number of annular, cylindrical lining members 19 similar to those shown in FIG. 30, and an outer lining formed by a number of outer lining members 29. Each of outer lining members 29 has a shape similar to the shape of the lining members 19 shown in FIG. 29. A space 30 is defined between the inner and outer lining and a binding material for interconnecting the lining members 19 and 29 is arranged within this space. This means that each reinforcing element 18 is surrounded by three layers of material, which may have different strength characteristic. The reinforcing element 18 with the surrounding lining members 19 and 29 may be incorporated in a complex structure as shown in FIG. 26. The characteristics of the various lining materials may be chosen such that a certain load to which the structure is exposed causes a desired mutual movement of the reinforcing element 18 and the surrounding lining and matrix materials so as to allow the reinforced structure to receive and convert a high amount of energy, such as impact energy. Consequently, by using the method according to the invention it is possible to tailor a reinforced structure so that it is able not only to carry a predetermined working load, but also to show a desired failure behaviour in case the structure should become exposed to unexpected excessive loads.

FIG. 32 illustrates a building structure member, which comprises matrix body members 10 made from ceramics, cement based materials and/or DSP materials. These body members 10 define through-going passages 31 with a rectangular cross-sectional shape for receiving lined reinforcing elements 18, 19 of the type illustrated in FIG. 29*c*. As shown in FIGS. 33 and 34, the outer surfaces of the lining members 19 and the complementary inner surfaces of the matrix body members 10 defining the passages 31 may be shaped so as to obtain a mechanical interlocking between the lining members 19 and the adjacent matrix body members 10 against mutual movement in the longitudinal direction of the reinforcing elements 18. In addition, the various elements forming the reinforced structure may be bound together by one or more suitable binders being introduced in the spaces defined between the elements or parts forming the structure. As shown in FIG. 34 a plurality of aligned bores 15, which extend transversely to the reinforcing elements 18 may be formed in the matrix body members 10 for receiving further rod-shaped reinforcing elements, which are made for example from steel.

FIG. 35 illustrates a building structure member made constituted by a plurality of plate-like matrix body members 32, which are arranged in layers. Each plate 32 may be made from a cement-based matrix, e.g. a cement-based DSP matrix material, around a secondary reinforcing arrangement 33 in a conventional member. As shown in FIG. 35 such reinforcing arrangement may comprise a plurality of parallel rod members interconnected by transverse wires passed around the rod members and having a substantially sinusoidal shape. A primary reinforcement is formed by a plurality of substantially parallel, rod shaped reinforcing elements 34, which are arranged between the layers of matrix body members 32 in channels or grooves formed in the outer surfaces of the plate-like members 32. Also the primary reinforcement comprises sinusoidal reinforcing wires 35 extending in planes substantially at right angles to the rod-shaped elements 34 for interconnecting the same. The primary reinforcement may further comprise rod-shaped reinforcing elements 36 extending substantially at right angles to the elements 34 and arranged between layers of the plates 32 where no reinforcing elements 33 are arranged. Also in this case reinforcing elements extending transversely to the layers of plate-like matrix body members 32 may be arranged in aligned bores (not shown). The various members and elements of the structure may be bound together by one or more different binders.

The structure illustrated in FIG. 36 comprises superposed layers of elongated panel- or plate-like matrix body members 10. Each body member 10 has longitudinally extending grooves or channels 11 and 12 formed in one of its side surfaces for receiving rod-shaped reinforcing elements 13 and 14. Each layer of the structure is formed by pairs of the plates or panels 10 with reinforcing elements 13 or 14 sandwiched there between and received in bores defined by oppositely arranged channel 11 or 12. As shown in FIG. 36 the elongated panels or plates 10 may extend substantially at right angles in alternating layers of the structure. Furthermore, the plates or panels have bores 15 formed therein being aligned with bores in adjacent panels, whereby passages or bores are defined in the structure for receiving reinforcing elements 16 which extend transversely to the layers of the structure. The plates or panels 10 may be formed from a compressed or compacted cement or DSP-based material or a ceramic material and may contain conventional reinforcing means, such as fibres from plastic, glass, carbon and/or metal and/or metallic rods and/or wires. Furthermore, the members and elements of the structure may be bound together by one or more binding agents.

FIG. 37 illustrates how a pair of adjacent matrix body members 10 forming part of a structure in accordance with the present invention may have complementary stepped shapes for mechanically interlocking such members against mutual movement in two directions at right angles. The body members 10 have aligned bores 37 therein extending in said directions for receiving cables or wires 38 or other reinforcing elements which are preferably tensioned so as to maintain the matrix body members in close mutual contact.

In FIG. 38 it is illustrated how matrix body members 10 of the type shown in FIGS. 26 and 36 may be made. A matrix body member 10 may be made from a particulate starting material 21 in a compression mould 22 comprising a cylinder and a pair of opposed pistons or plungers 23 and 24. One piston 23 has ridges 39 for forming the channels or grooves 11 in the member 10 to be produced. The transverse openings or bores 15 may be formed by means of pin-shaped plungers 40, which are moveable in relation to the other mould parts. In the mould the particulate material 21 may be compressed so as to form a "green" sample 27 which may be allowed to cure or harden. Alternatively, the green sample 27 thus made may be heated in a furnace or oven to a sintering temperature as previously described.

In FIGS. 39 and 40 a method for making a composite wall structure according to the present invention is illustrated. The structure comprises a plurality of prefabricated, relatively thin solidified plates 41. The plates 41 may, for example be made from glass, ceramic material or DSP-based material and may have a thickness of about 1 mm or even less. As shown in FIG. 39 a layer of powdered binding agent and reinforcing fibres may be sprayed on the upper side surface of each plate 41 by means of spray nozzles 42 and 43, respectively. The fibres may be made from glass, carbon, ceramics and/or steel. A number of the plates 41 with binder and reinforcing fibres are stacked on top of each other. Thereafter, said stack of plates 41 are heated so as to melt the binding agent and pressed together, FIG. 39*b*. Then the binder is allowed to solidify, preferably while still under pressure, whereby a thicker composite plate 44 is formed. As an example, the binder may be so-called "solder glass" having a relatively low softening temperature below 500 degrees centigrade.

A number of such composite plates 44 may be stacked on to of each other with intermediate net-like reinforcing elements 45 and layers of a binding agent so as to form a wall or plate structure. This binding agent may be similar to that arranged between the thin plates 41, or of another type, such as a solidifying liquid or paste-like binder.

Figure 40A:
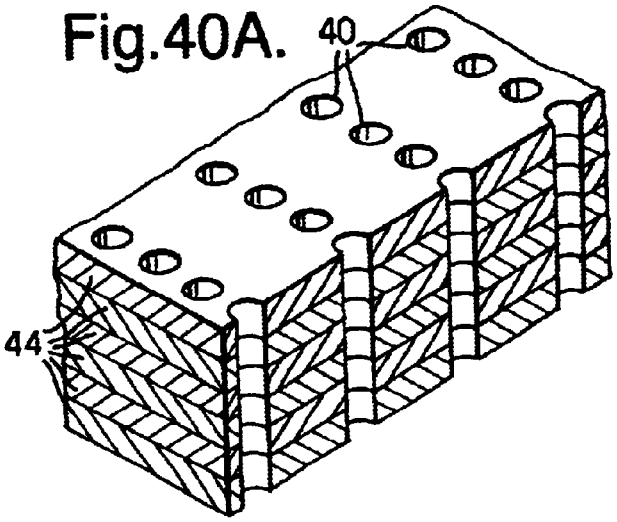
FIGS. 40A–E illustrates how a reinforced structure may by made from plate shaped matrix body members, such as those shown in FIG. 39.
Figure 40B:
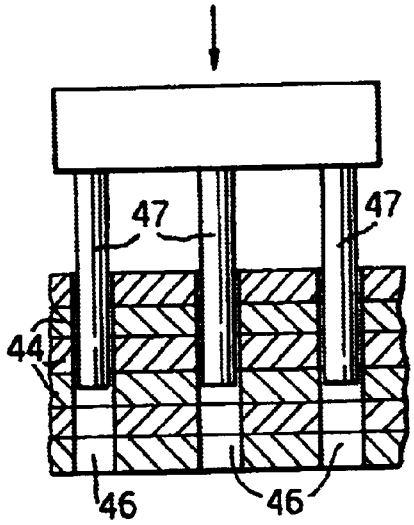
Figure 40C:
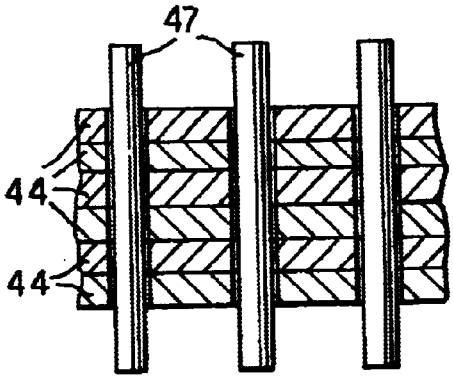
Figure 40D:
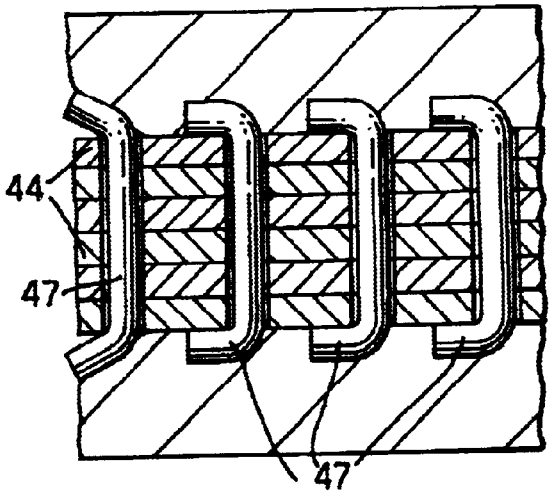
Figure 40E:
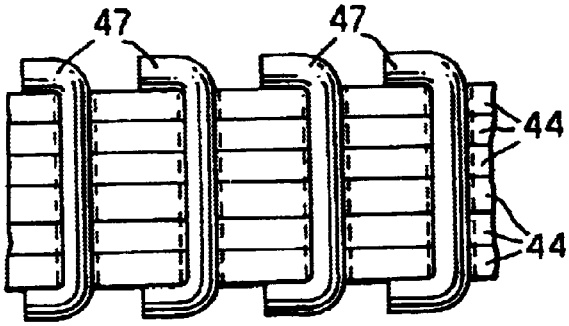

Transverse bores 46, FIG. 40*a*, are formed in the wall or plate structure or defined by aligned openings formed in the thin plates 41. Transverse rod-shaped reinforcing elements 47 may now be inserted into the bores 46 as illustrated in FIG. 40*b* such that the free ends of the reinforcing elements 47 extend from the opposite side surfaces of the wall as shown in FIG. 40*c*. Now, the plates 41 and 44 may be mechanically interlocked by deforming the free ends of the reinforcing elements 47 in a press as illustrated in FIG. 40*d*, and the structure may at the same time be heated such that liquefied binding agent may flow from the spaces between the plates into the transverse bores 46, whereby also the reinforcing elements 47 are bound to the plate structure.

In the following, the above aspects and a few other aspects of the invention will be discussed.

1. Casting the matrix material in fluid/plastic condition around the reinforcement, optionally with vibration, etc., and
2. subsequently solidifying the matrix material.

These methods may also applied for casting large structures with larger reinforcement with production similar to production typically applied on very large massive structure in reinforced concrete, e.g., in casting of large bridge piers.

The present new method, in which the limitations incurred by the casting of the matrix material around the reinforcement are obviated, makes it possible to rationally provide 1) normally-sized, large and very large articles with closely arranged reinforcement which may be large and very large articles with closely arranged large and very large reinforcement, and 2) extremely strong, hard, stiff, fracture-tough articles, both large and very large and with extremely closely arranged reinforcement, and also smaller articles with plate-shaped reinforcement 3) where the space between the reinforcement component is filled with dense material with a complex internal structure, comprising, e.g., cubically shaped bodies with sizes of the same order of size as the transverse dimensions of the reinforcement, and with rods, fibres, etc. in high concentrations incorporated in a sub-matrix.

The preparation of the structure according to the invention may partially be performed by casting the matrix material in fluid plastic condition around the reinforcement, with subsequent solidification of the matrix material, but with the added freedom that at least a part of the matrix material which fills the void between the reinforcement components is prepared separately from the reinforcement, the process then being characterized by 1) preparation of the matrix bodies, or some of or parts of these bodies, separately from the reinforcement components, 2) subsequent placing of at least some of the matrix bodies and reinforcement in the final position or substantially the final position, and 3) subsequent mutual fixation of the parts of the matrix body and fixation of the matrix body to the reinforcement.

Further, it is often preferred that the matrix bodies—or some of the matrix bodies—are in fluid/plastic condition during the mutual placing and the placing relative to the reinforcement, the said bodies being 1) bodies wholly or partially being enclosed in a flexible/thin enclosing/delimiting body and/or 2) bodies having an internal stability and only to a small extent or not at all enclosed in thin enclosing/delimiting bodies.

The process may be performed by forming the said matrix body by arranging the said partial bodies in said fluid/plastic condition, with or without the said flexible enclosing/delimiting/enveloping bodies adjacent to neighbouring body/bodies and reinforcement components and, by mechanical influence bringing it in intimate contact with the said adjacent body or bodies and reinforcement components.

Figure 41:
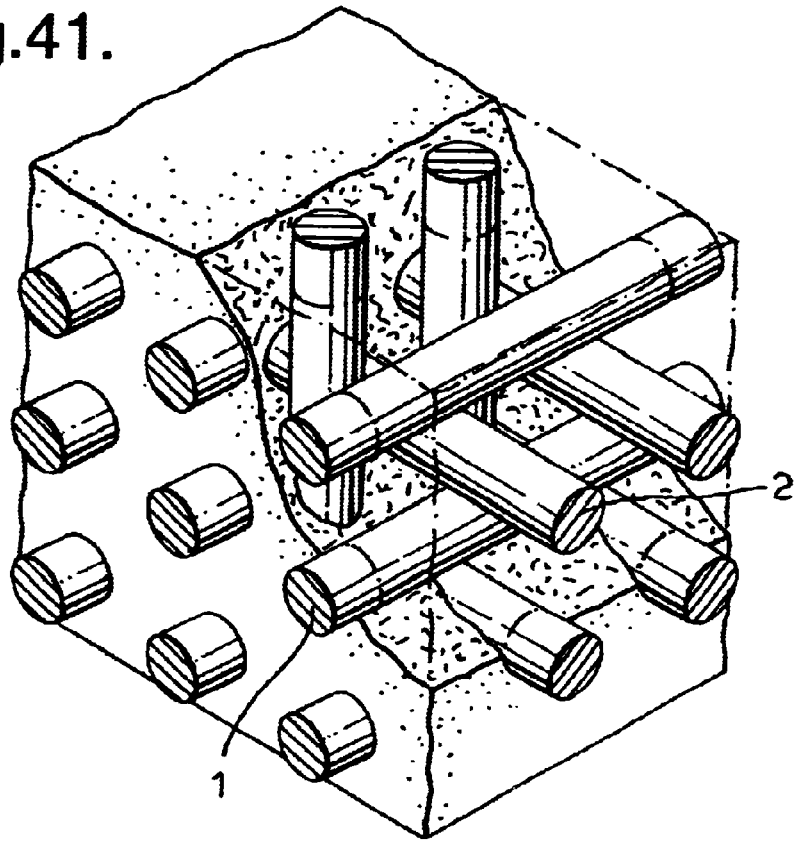
FIG. 41 illustrates a section of a reinforced article according to the invention with large reinforcement under otherwise conventional preparation.

FIG. 41 illustrates a section of a reinforced article according to the invention with large reinforcement under otherwise conventional preparation. 1, 2 and 3 are pre-arranged reinforcement components. 4 is matrix material during casting—embedding the reinforcement components present in the volume. 5 illustrates void around the reinforcement components, which voids, later in the process, will be filled with matrix material in the same way as has taken place at 4. Thus, In the casting of the reinforced article or structure with reinforcement 1, 2 and 3 arranged in position, the matrix material 4 in fluid/plastic condition is brought to fill the space between the reinforcement components and embed them tightly. The casting is often preferably combined with mechanical vibration and/or applied external stresses, such as pressure and shear stresses and/or applied forces of inertia such as by impact or centrifugation. Preferably, the processes are aided by high frequency mechanical vibration applied to the reinforcement components.

Subsequently the matrix material solidifies, trough solidification processes related to the matrix materials in question, such as solidification of melts sintering polymerisation nucleation and precipitation, etc.

Figure 42:
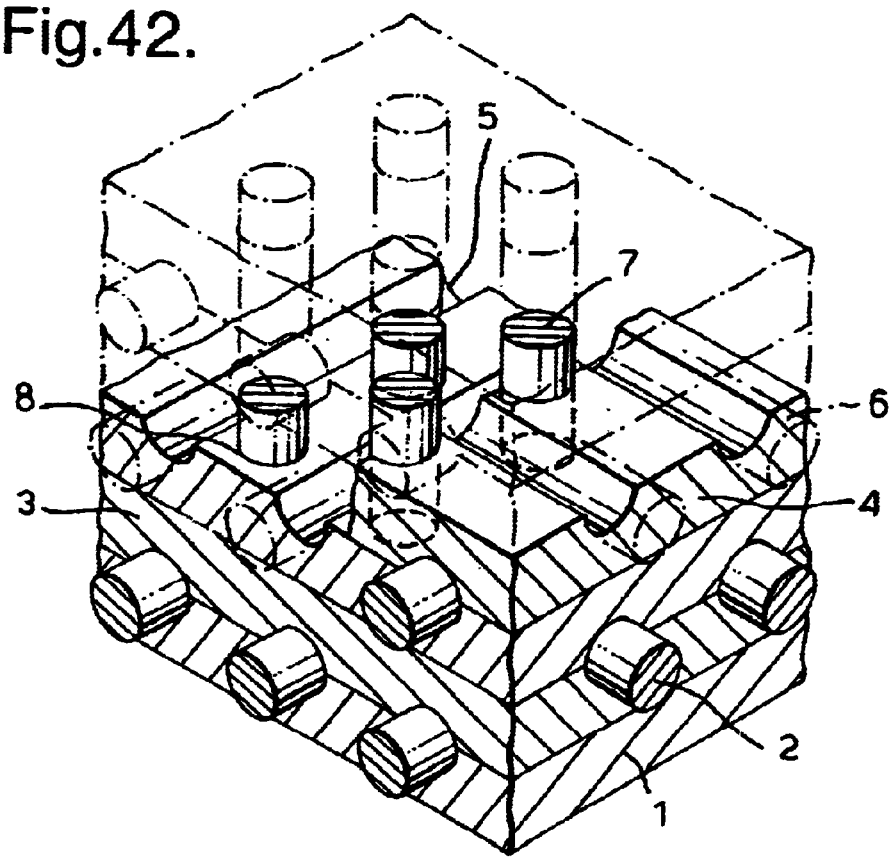
FIG. 42 illustrates the building up of structures according to the present invention in accordance with the present special method.

FIG. 42 illustrates the building up of structures according to the present invention in accordance with the present special method. FIG. 42 illustrates a section of a reinforced body built up of discrete sub-bodies produced separately from reinforcement components and subsequently placed in intimate mutual contact and in intimate contact with reinforcement components with subsequent mechanical fixation. On a sub-body 1 are arranged reinforcement components 2, and then a sub-body 3 in intimate contact with both 1 and 2. 4 is a section of a next sub-body which is arranged on top of and in intimate contact with the sub-body 3 and reinforcement components (not shown) arranged in cavities 5. 6 designates a next layer of reinforcement components. 7 designates transverse reinforcement, and 8 designates cavities adapted to receive transverse reinforcement.

The transverse reinforcement may be arranged prior to arranging the sub-bodies and the horizontal reinforcement components, or may be arranged subsequently, pushed down through the cavities 8.

Compared to the casting illustrated in FIG. 41, this process sequence permits:

1. production of bodies of higher quality made possible through 1.1 better combinations of selection of materials and mechanical production (compression, vibration etc.)

1.2 better combinations of selection of materials, mechanical production processes and subsequent solidification processes; thus, e.g., the solidification of the sub-bodies may take place over large temperature ranges and large pressure ranges 1.3 production of sub-bodies with complex structures, such as composite structures with hard, strong, fracture-tough matrices and strong reinforcement which can be present in high concentration relative to the size of the sub-bodies 1.4 building in of "tailor-made" combinations of various sub-bodies, such a sub-bodies having special shapes allowing effective interlocking, sub-bodies having shapes conferring friction interlocking (interaction conferred by friction forces in structures where two bodies which otherwise have a tendency to slide relative to each other under separation from each other have the sliding and separation tendency counteracted by friction forces aided by compressive forces on the sliding surfaces, the compressive forces increasing as the bodies are moved away from each other, this being obtained, e.g. by using wedge or dovetail geometry), sub-bodies with various functions, such as, e.g., containing electrical conductors, cooling channels, heating channels, channels for introduction of "glue" or fluid matrix material for joining the sub-bodies, etc., and building in of "tailor-made" interface structures, and 2. industrial mass production, combining mass production of sub-bodies and automatic assembling of the these and appertaining reinforcement components.

Figure 43A:
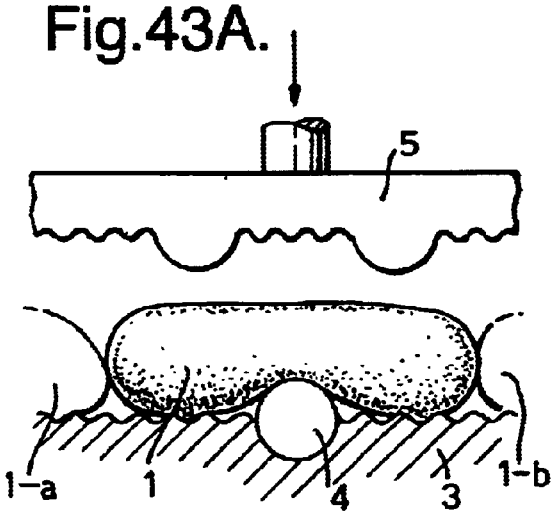
FIG. 43A shows the placing of a sub-body in plastic fluid connection, wholly or partially surrounded by or enclosed in flexible intermediate body, or without such intermediate body, prior to placing in intimate contact with a sub-body and an intermediate reinforcement component.

FIG. 43A shows the placing of a sub-body 1 in plastic fluid condition, wholly or partially surrounded by or enclosed in a flexible intermediate body, or without such intermediate body, prior to placing in intimate contact with a sub-body 3 and an intermediate reinforcement component 4. By mechanical influence, the sub-body 1 is given its final shape in intimate contact with the bodies 3 and 4 against which it is shaped. The situation illustrated in FIG. 43A is the situation before this mechanical influence. The sub-body 1 is shown placed loosely on the bodies 3 and 4. Corresponding sub-bodies in corresponding positions are indicated 1-*a*, 1-*b*. Above the sub-body 1, a press tool 5 is shown in a position on its way to be pressed down against the sub-body 1.

Figure 43B:
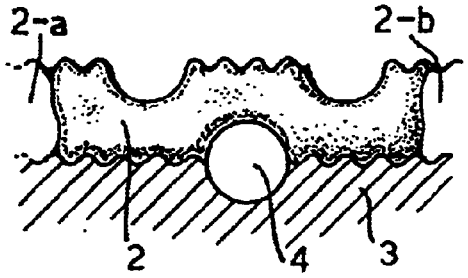
FIG. 43B shows the situation of FIG. 43A after the body has been pressed, by means of the press tool, into intimate contact with the sub-body and the reinforcement component and has, thereby, been given its "final" shape, in intimate contact with the sub-body an the reinforcement component, and together with the neighboring deformable sub-bodies 1*a* and 1*b* which at the same time have been given their "final" shape.

FIG. 43B shows the situation after the body 1 has been pressed, by means of the press tool 5, into intimate contact with the sub-body 3 and the reinforcement component 4 and has, thereby, been given its "final" shape 2, in intimate contact with the sub-body 3 and the reinforcement component 4, and together with the neighbouring deformable sub-bodies 1-*a* and 1-*b* which at the same time have been given their "final" shape 2-*a*, 2-*b*.

The underlying sub-body 3 and reinforcement 4 may be stiff, and relatively non-yielding. Alternatively, both, or one of them, may be plastic/fluid, wholly or partially, or not at all enveloped in a flexible intermediate body.

A flexible intermediate body, e.g., in the form of a thin membrane, net or web, serves in particular to keep fluid/plastic sub-bodies together while they are being placed, analogously to how a water-filled bag can be placed on a floor, with a brick on top of it, in intimate contact with the floor and the brick and with controlled geometry (constant surface area) without flowing out.

Figure 44A:
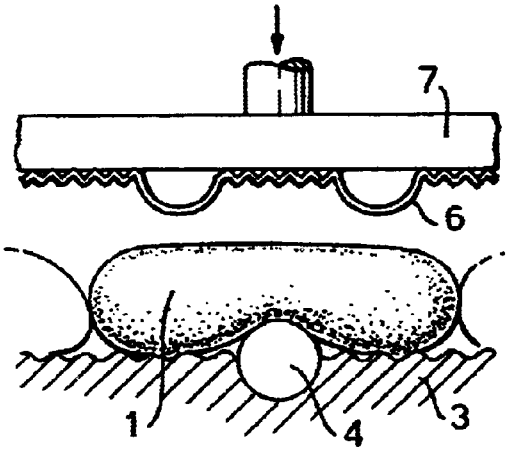
FIGS. 44A–B shows the position with the shaping body and the supporting body prior to and after pressing down against the sub-body.
Figure 44B:
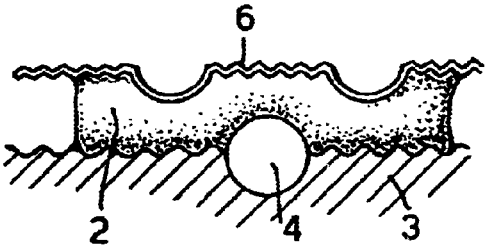
Figure 45A:
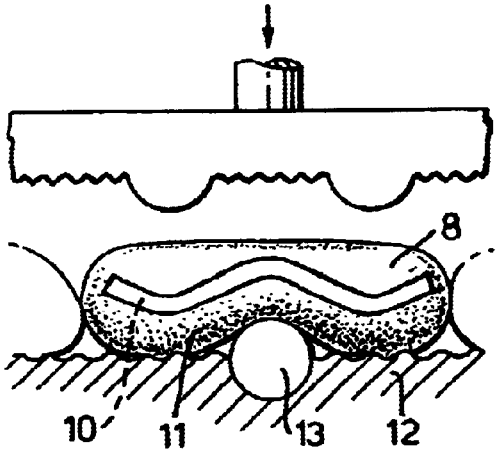
FIGS. 45A–B illustrate the composite structure with a mat.
Figure 45B:
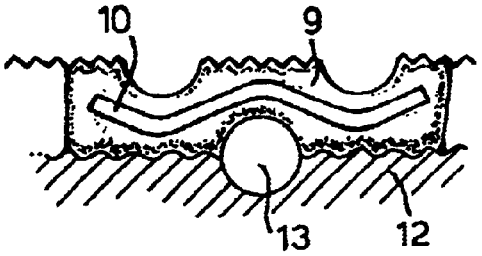

FIGS. 44 and 45 show variants of the situation illustrated in FIG. 43.

FIG. 44 illustrates the introduction of an intermediate body 6. In FIG. 44, a two part press tool consists of the intermediate shaping body 6 and a supporting body 7.

FIG. 44A shows the position with the shaping body 6 and the supporting body 7 on their way to be pressed down against the sub-body 1. FIG. 44B shows the situation after the compression, with the shaping body 6 in intimate contact with the now deformed sub-body 2.

FIG. 45 illustrates that the sub-bodies may have a composite structure, illustrated by components 10 and 11. The system is as in FIG. 44 with a deformable sub-body which is designated 8 prior to the deformation process and 9 after the deformation process. The sub-body contains the sub-body component 10 in contact with another sub-body component 11. 12 designates a body against which 8 is pressed, with a reinforcement component 13 between them. The two sub-body components 10 and 11 differ from each other with respect to their capability of being deformed. During shaping, the embedding component 11 is in plastic/fluid condition. The embedding component 10 may be stiff, substantially non-yielding, but it may alternatively be in plastic/fluid condition.

By operating with sub-bodies in fluid/plastic condition, with controlled/controllable shape, a number of advantages are obtained compared to casting of the whole matrix body (FIG. 41); these are is largely the same as are obtained using the building brick principle with solid sub-bodies, cf. FIG. 42. However, compared to the building brick principle according to the present invention implemented with solid sub-bodies, a far better/much easier intimate contact is obtained between sub-bodies and between sub-bodies and reinforcement bodies.

Preferred embodiments of the invention comprise combining the principles of solid sub-bodies/solid reinforcement components (FIG. 42) and sub-bodies/reinforcement components on plastic/fluid form (FIG. 43), the reinforcement in this case, being, e.g., wires or cables, etc.

Figure 46:
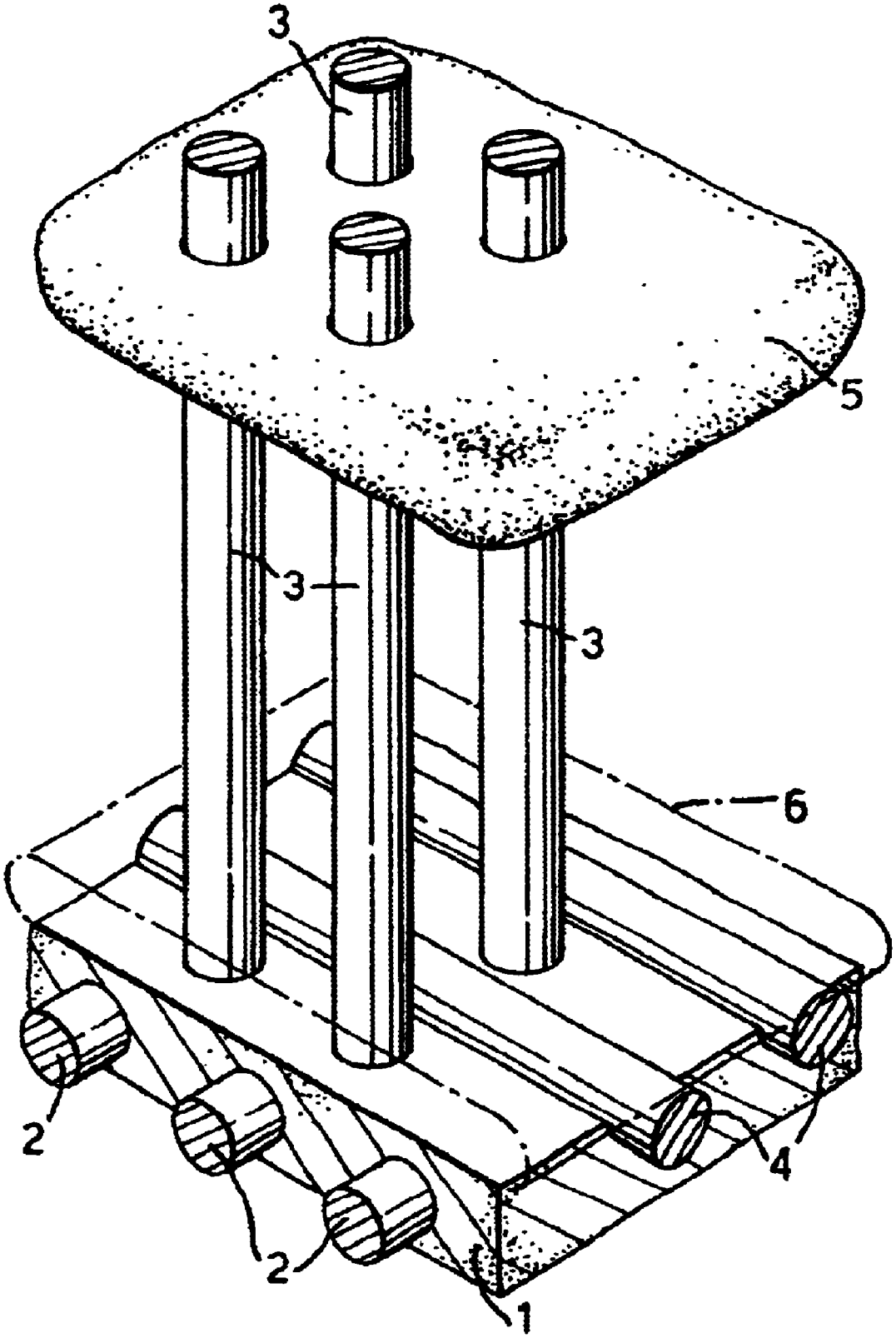
FIG. 46 shows a section of a reinforced body during its production.

This is illustrated in FIG. 46 which shows the course of the process of producing a composite structure with sub-bodies enclosing intermediate reinforcement components, in intimate mutual contact. FIG. 46 shows a section of a reinforced body during its production. 1 is a solid sub-body with reinforcement components 2 completely embedded therein and vertical reinforcement components 3 embedded and protruding from the upper surface of the sub-body 1. In the upper surface of the sub-body 1, horizontal reinforcement components 4 are placed, with about the upper half of them extending above the upper surface of the sub-body 1. A sub-body 5 in plastic/fluid condition, wholly or partially—or not at all—enveloped by/enclosed in a flexible thin delimitation body, immediately before it is mechanically brought into intimate contact with the sub-body 1 and the reinforcement components 4. A contour 6 indicates the shape of the sub-body 5 after it has been brought into intimate mechanical contact with the sub-body 1 and the reinforcement components 4.

The invention provides many possibilities of combinations. Thus, e.g., the sub-body 1 may be of ultra-strong, hard, fracture-tough ceramic material produced by high pressure/high temperature sintering. The reinforcement components 2, 3 and 4 may be cables/rods of ultra-strong steel, or another very strong material, and the sub-body 5 may be fluid metal or fluid metal matrix-based composite enclosed in a bag woven of ceramic fibres.

The above-illustrated principle of using flexible "building blocks" of a solidifiable material may be used for other purposes than for embedding/surrounding a reinforcement. Thus, e.g., a "bulding block" of a solidifiable material may be used as an interlocking member formed in situ be being compressed into a cavity of such a shape that the building brick, when solidified, will interact with surrounding structural components to lock the structure. A solidifiable "building block" which solidifies in situ may, e.g., be constituted by a cement-based DSP material. Such a component may be pre-mixed, optionally packed in a flexible packing material and pre-shaped to a suitable slab shape and then cooled or frozen, which will stop or retard the cement hardening process, for later warming/heating or thawing at the site of use, thereby establishing the ready-to use self-solidifying "building block".

What is claimed is:

1. A shaped article at least part of which is constituted by a composite structure comprising a matrix and a plurality of reinforcement components in intimate contact with and wholly or partly embedded in the matrix, such reinforcement components having an at least 1.5 times higher tensile strength than the matrix, the reinforcement components being (i) plate-shaped components having thicknesses of at least 60 mm which are orientated with their planes substantially parallel to each other, such that the minimum volume per cent concentration ($\phi$) of the plate-shaped components in the composite structure is dependent on the tensile strength ($\sigma_b$) of the plate-shaped components in a direction in the plane of the plate-shaped components in accordance with the following table

| $\sigma_a$ MPa | 300 | 500 | 700 | 1000 | 1500 | 2000 or more |
|---|---|---|---|---|---|---|
| $\phi$ % | 8 | 6 | 4 | 3 | 2 | 1.5 |

intermediate values for the minimum volume percentage of the plate-shaped components being being calculatable by linear interpolation where both the tensile strength and the volume concentration are depicted in logarithmic scale, and/or (ii) elongated components with a transverse dimension of at least 60 mm, such that the minimum requirements with respect to volume concentration of the elongated reinforcement components ($\phi$), tensile strength of the elongated reinforcement components ($\sigma_a$), compressive strength of the matrix ($\sigma_c$), and modulus of elasticity of the matrix (E) are adapted in accordance with the minimum transverse dimension (d) of the elongated reinforcement components in accordance with the following table:

| d (mm) | 60 | 100 | 250 | 600 | 1200 | 3000 or more |
|---|---|---|---|---|---|---|
| $\phi$ (vol %) | 1.8 | 1.5 | 1.0 | 0.7 | 0.5 | 0.3 |
| $\sigma_a$ (MPa) | 190 | 180 | 150 | 100 | 75 | 50 |
| $\sigma_c$ (MPa) | 55 | 50 | 40 | 30 | 20 | 15 |
| E (GPa) | 40 | 30 | 25 | 20 | 15 | 10 |

intermediate values for the minimum requirements for each of the properties being calculatable by linear interpolation where both the transverse dimension (d) and the value for the property in question are depicted in logarithmic scale, the reinforcement components, whether plate shaped or elongated, being constituted by monolithic components and/or being built up of discrete subcomponents, the subcomponents being in intimate contact with each other, and/or spaced from each other and embedded in a solid embedment, the geometry of any reinforcement element which is built up of discrete subcomponents being defined by the envelope of the reinforcement component.

2. A shaped article as claimed in claim 1 wherein the composite structure contains plate-shaped components and the matrix has a compressive strength of at least 60 MPa, a modulus of elasticity of at least 40 GPa, and a fracture energy of at least 0.5 kN/m.

3. A shaped article at least part of which is constituted by a composite structure comprising a matrix and a reinforcement embedded in the matrix, the reinforcement having an at least 1.5 times higher tensile strength than the matrix, the composite structure showing the following properties:

the matrix has a compressive strength of at least 60 MPa, a modulus of elasticity of at least 40 GPa, and a fracture energy of at least 0.5 kN/m, and the reinforcement is in the form of plate-shaped components with a tensile strength of at least 300 MPa, in which case the plate-shaped components constitute at least 8% by volume of the composite structure, or a tensile strength of at least 500 MPa, in which case the plate-shaped components constitute at least 6% by volume of the composite structure, or a tensile strength of at least 700 MPa, in which case the plate-shaped components constitute at least 4% by volume of the composite structure, or a tensile strength of at least 1000 MPa, in which case the plate-shaped components constitute at least 3% by volume of the composite structure, or a tensile strength of at least 1500 MPa, in which case the plate-shaped components constitute at least 2% by volume of the composite structure, or a tensile strength of at least 2000 MPa, in which case the plate-shaped components constitute at least 1.5% by volume of the composite structure, intermediate values for the minimum volume percentage of the plate-shaped components being being calculatable by linear interpolation where both the tensile strength and the volume concentration are depicted in logarithmic scale, the reinforcement components being constituted by monolithic components and/or being built up of discrete subcomponents, the subcomponents being in intimate contact with each other, and/or spaced from each other and embedded in a solid embedment, the geometry of any reinforcement component which is built up of discrete subcomponents being defined by the envelope of the reinforcement component.

4. A shaped article at least part of which is constituted by a composite structure comprising a matrix and a reinforcement embedded in the matrix, the reinforcement having an at least 1.5 times higher tensile strength than the matrix, the composite structure showing the following properties:

the reinforcement is in the form of large elongated reinforcement components having a transverse dimension of at least 60 mm, minimum requirements with respect to volume concentration of reinforcement ($\phi$), tensile strength of the reinforcement ($\sigma_a$), compressive strength of the matrix ($\sigma_c$), and modulus of elasticity of the matrix (E) being adapted in accordance with the minimum transverse dimension (d) of the reinforcement in accordance with the following table:

| d (mm) | 60 | 100 | 250 | 600 | 1200 | 3000 or more |
|---|---|---|---|---|---|---|
| $\phi$ (vol %) | 1.8 | 1.5 | 1.0 | 0.7 | 0.5 | 0.3 |
| $\sigma_a$ (MPa) | 190 | 180 | 150 | 100 | 75 | 50 |
| $\sigma_c$ (MPa) | 55 | 50 | 40 | 30 | 20 | 15 |
| E (GPa) | 40 | 30 | 25 | 20 | 15 | 10 |

intermediate values for the minimum requirements for each of the properties being calculatable by linear interpolation where both the transverse dimension (d) and the value for the property in question are depicted in logarithmic scale, the reinforcement components being constituted by monolithic components and/or being built up of discrete subcomponents, the subcomponents being in intimate contact with each other, and/or in a distance from each other and embedded in a solid embedment, the geometry of any reinforcement component which is built up of discrete subcomponents being defined by the envelope of the reinforcement component.

5. A shaped article as claimed in claim 1 wherein the reinforcement component has a minimum tensile strength of at least 200 Mpa.

6. A shaped article as claimed in claim 1 wherein the reinforcement components or subcomponents are of metal, metal alloys, glass, ceramic, carbon or plastics.

7. A shaped article according to claim 1 wherein the composite structure contains secondary reinforcement components, in addition to the said plateshaped and/or elongated reinforcement components, said secondary reinforcement components being smaller than the plate shaped or elongated reinforcement components.

8. A shaped article as claimed in claim 1 containing plate-shaped components constituting at least part of the main reinforcement of the composite structure.

9. A shaped article according to claim 7 wherein the secondary reinforcement is in the form of rods, fibres, other elongated bodies, granular bodies, irregularly shaped lumps or combinations thereof.

10. A shaped article according to claim 1 wherein the transverse compressive strength of any reinforcement component is at least 10 MPa.

11. A shaped article according to claim 1 wherein the plate-shaped and/or elongated reinforcement components have thicknesses between 60 and 100 mm, between 100 and 250 mm, between 250 and 600 mm, between 600 and 1200 mm, between 1200 and 3000 mm or combinations thereof.

12. A shaped article according to claim 1, wherein the reinforcement component has tensile strength between 500 and 700 MPa, between 700 and 1000 MPa,between 1000 and 1500 MPa, between 1500 and 2000 MPa, between 2000 and 2500 MPa, larger than 2500 Mpa, or combinations thereof.

13. A A shaped article according to claim 1 wherein the matrix material has a compressive strength 90 and 120 MPa, or between 120 and 160 MPa, or between 160 and 220 MPa, or 220 between and 280 MPa, or between 280 and 400 MPa, or larger than 400 Mpa.

14. A shaped article according to claim 1 wherein the matrix material has a modulus of elasticity between 60 and 80 GPa, or between 80 and 100 GPa, or between 100 and 140 GPa, or between 140 and 200 GPa, or larger than 200 Gpa.

15. A shaped article according to claim 1 wherein the matrix material has a fracture energy between 2 and 5 kN/m, or between 5 and 20 kN/m, or between 20 and 50 kN/m, or between 50 and 200 kN/m, or between 200 and 1000 kN/m, or larger than 1000 kN/m.

16. A shaped article according to claim 1 wherein the volume concentration of reinforcement is less than 4 vol % or between 4 and 6 vol %, or between 6 and 10 vol %, or between 10 and 20 vol %, or between 20 and 30 vol %, or between 30 and 50 vol %, or between 50 and 70 vol %, or larger than 70 vol %.

17. A shaped article according to claim 1 wherein the volume concentration of reinforcement is in the range of 2–4% when the thickness of the reinforcement components is at least 60 mm.

18. A shaped article according to claim 1 wherein reinforcement is plate-shaped reinforcement of a tensile strength of at least 700 MPa, and the volume concentration of the reinforcement is in the range of 4–8%.

19. A shaped article according to claim 1 wherein the matrix is a substantially continuous matrix, having substantially the same composition throughout.

20. A shaped article according to claim 1 wherein at least part of the matrix is built up of discrete domains with discernible boundary zones, the discrete domains being in contact with each other, either directly or via intermediate material.

21. A shaped article according to claim 20, wherein at least some of the discrete domains are matrix components fabricated separately.

22. A shaped article according to claim 21, wherein at least some of the matrix components are mechanically interconnected via reinforcement components surrounding or transversing the reinforcement components.

23. A shaped article according to claim 1 wherein the matrix is reinforced with fibres, rods or other elongated bodies.

24. A shaped article according to claim 1 wherein the continuous phase of the matrix is a metal or alloy.

25. A shaped article according to claim 24, wherein the continuous phase of the matrix is aluminium or an aluminium alloy.

26. A shaped article according to claim 1 wherein the continuous phase of the matrix is a plastics material.

27. A shaped article according to claim 1 wherein the continuous phase of the matrix is Portland cement such as normal Portland cement, high early strength Portland cement, sulphate resistant cement, low alkali cement, low heat cement, white Portland cement, Portland blast furnace cement, Portland pozzolana cement, Portland fly ash cement, or of an aluminate cement (high alumina cement).

28. A shaped article according to claim 1 wherein the continuous phase of the matrix is a ceramic material.

29. A shaped article according to claim 1 wherein the continuous phase of the matrix is a DSP material.

30. A shaped article consisting of a composite structure as defined in claim 1.

31. A shaped article as claimed in claim 30 which is a matrix reinforcement element.

32. A shaped article as claimed in claim 30 for use as a matrix reinforcement element.

33. A plate-shaped or elongated reinforcement component which is built up of discrete reinforcing subcomponents embedded in a matrix in intimate contact with each other and/or spaced from each other, the geometry of the reinforcement component being defined by the envelope of the reinforcement component, the matrix in which the reinforcing subcomponents are embedded having a compressive strength of at least 60 MPa, a modulus of elasticity of at least 20 GPa, and a fracture energy of at least 0.5 kN/m.

34. A reinforcement component according to claim 33, wherein the matrix has a modulus of elasticity of at least 30 GPa.

35. A reinforcement component according to claim 33, wherein the matrix has a modulus of elasticity of at least 40 GPa.

36. A shaped article as claimed in claim 1 comprising plate-shaped or elongated reinforcement components which are built up of discrete reinforcing subcomponents embedded in a matrix in intimate contact with each other and/or spaced from each other, the geometry of each reinforcement component being defined by the envelope of the reinforcement component, the matrix in which the reinforcing subcomponents are embedded having a compressive strength of at least 60 MPa, a modulus of elasticity of at least 20 GPa, and a fracture energy of at least 0.5 kN/m.

37. A shaped article according to claim 36 wherein the reinforcement components are components produced separately from the matrix of the article, as assessible by a difference in structure and/or properties between the matrix of the article and the matrix of the individual reinforcement components, and/or by a distinct boundary between the matrix of the article and the matrix of the reinforcement component.

38. A shaped article according to claim 36 wherein the reinforcement components have been made in situ by casting at least part of their matrix material around one or several reinforcement subcomponents which are optionally embedded in a matrix material.

39. A method for predicting mechanical behaviour, and/or the effect of mechanical behaviour, of a body B of a system A including the body and subjected to a physical influence P, the mechanical behaviour including fracture of the body B or of a part of the body B as a result of the physical influence, the system A being complex in that the body B is built up as a composite body, and the fracture of the body B or the part thereof is complex., i.e., includes tensile fracture and fracture other than pure tensile fracture, the method comprising providing a model M of the system A, the model M including a model, designated $B_{model}$ of the body B, or of the part thereof, the modelling including modelling based on parameters relating size and mechanical behaviour of the body B or the part thereof, the parameters including parameters related to fracture, at least one of these parameters related to fracture being a parameter which is not solely related to tensile fracture, performing, on the model system M, a modelling of the physical influence P, recording the behaviour of the model body $B_{model}$ resulting from the influence, including the complex fracture behaviour thereof and/or the effect of said complex fracture behaviour, and determining the predicted mechanical behaviour of the body B or the part thereof, including the complex fracture behaviour of the body B or the part thereof, and/or the effect of the complex fracture behaviour, by transferring the recorded behaviour of the model body $B_{model}$ to predicted behaviour of the body B or the part thereof by the use of one or more algorithms which include the above-mentioned parameters.

40. A method according to claim 39, wherein the model M is a physical model, and the model body $B_{model}$ is geometrically similar to the body B, or the part of the model body $B_{model}$ corresponding to the part of body B which is subjected to fracture is geometrically similar to the corresponding part of the body B which is subjected to fracture, but differs from the body B or the part thereof in that 1. the materials of the model body $B_{model}$ differ from the corresponding materials of the body B or the part thereof by having mechanical properties, including mechanical properties decisive for complex fracture, which are different from the mechanical properties of the body B, and
2. the size of the model body $B_{model}$ optionally differs from the size of the body C, the relationship between the size and the materials of the model body $B_{model}$ and the size and the materials of the body B or the part thereof being such that the ratio between at least two of the size/behaviour-related parameters decisive to complex fracture behaviour is identical or substantially identical in the model body $B_{model}$ and in the body B (or the part thereof; the at least two parameters including at least one parameter which is not a parameter solely related to pure tensile fracture, or the said ratio differs from being identical or substantially identical by a known or assessible correction function, the method comprising subjecting the model system to a physical influence $P_{model}$ which is adapted so that it is geometrically and dynamically similar to the physical influence P, recording the behaviour of the model body $B_{model}$ resulting from the influence, including the complex fracture behaviour thereof and/or the effect of said complex fracture behaviour, and determining the predicted mechanical behaviour of the body B or the part thereof, including the complex fracture behaviour of the body B or the part thereof, and/or the effect of the complex fracture behaviour, by transferring the recorded behaviour of the model body $B_{model}$ to predicted geometrically similar behaviour of the body B or the part thereof by the use of one or more algorithms which include the above-mentioned at least two parameters and, if necessary, the above-mentioned correction function.

41. A method according to claim 39, wherein the model is an analytical model.

42. A method according to claim 41, wherein the modelling and the determination of the predicted mechanical behaviour are performed using a computer system.

43. A method according to claim 39, wherein the model is a combination of a physical model and an analytical model, the physical modelling being performed as claimed in claim 2, and information from the behaviour recorded in the physical modelling being used in the analytical modelling.

44. A method according to claim 39 wherein the parameters relating size and mechanical behaviour of the body B or the part thereof include a parameter expresssing deformation work done over the volume of the body B or the part thereof up to start of failure.

45. A method according to claim 44, wherein the parameter expression deformation is $$W_E = \frac{L^3\sigma^2 \cdot const}{E}$$

wherein σ is a characteristic strength.

46. A method according claim 45, wherein σ is a tensile strength $\sigma_0$.

47. A method according to claim 45, wherein σ is a compressive strength $\sigma_c$.

48. A method according to claim 39 wherein the parameters relating size and mechanical behaviour of the body B or the part thereof include a parameter expresssing work done in a fracture zone during fracture.

49. A method according to claim 48, wherein the parameter expressing work done is $W_G = L^2 \cdot G$, wherein G is characteristic fracture energy.

50. A method according to claim 49, wherein G is characteristic fracture energy related to tensile fracture.

51. A method according to claim 49, wherein G is the fracture energy related to shear failure, $G_\tau$.

52. A method according to claim 39 wherein the parameters relating size and mechanical behaviour of the body B or the part thereof include a parameter expresssing the ratio $$\frac{W_G}{W_E}.$$

53. A method according to claim 52 wherein the ratio $$\frac{W_G}{W_E}$$

expressed by $$\frac{W_G}{W_E} = \frac{La^2}{EG} \cdot const.$$

54. A method according to claim 53, wherein σ is tensile strength $\sigma_0$, and G is tensile fracture energy.

55. A method according to claim 53, wherein σ is tensile strength $\sigma_0$, and G is fracture energy in shear, $G_\tau$.

56. A method according to claim 49, wherein the modelling includes a parameter describing relationships between characteristic size L and material properties of the system A, including modulus of elasticity E, tensile strength $\sigma_t$ and tensile fracture energy G.

57. A method according to claim 56, wherein the parameter is a dimensionless parameter.

58. A method according to claim 57, wherein the dimensionless parameter is $$\frac{EG}{\sigma_t^2 L}.$$

59. A method according to claim 39 wherein the body B or the part thereof comprises a composite or hybrid structure built up of two or more components, and the modelling includes modelling of the composite or hybrid structure.

60. A method according to claim 59, wherein the modelling includes a parameter describing one or more characteristic sizes of composite components.

61. A method according to claim 60, wherein the modelling includes a parameter describing diameter of reinforcement (d).

62. A method according to claim 61, wherein the parameter describing diameter of reinforcement (d) is a dimensionless parameter relating the diameter to the modulus of elasticity $E_m$ of a matrix surrounding the reinforcement and the tensile strength $\sigma_m$ and the tensile fracture energy of said matrix $G_m$.

63. A method according to claim 59, wherein the dimensionless parameter is $$\frac{EG_m}{\sigma_m^2 d}.$$

64. A method according to claim 39 wherein the body B or the part thereof shows anisotropic properties, and the modelling includes modelling of the anisotropic properties.

65. A method according to claim 64, wherein the modelling includes one or more parameters describing direction-dependent properties, and the modelling includes modelling of the direction-dependent properties.

66. A method according to claim 65, wherein the direction-dependent properties are selected from tensile strength $\sigma_{tx}$, modulus of elasticity $E_x$ and fracture energy $G_x$ in an x-direction and the corresponding property/properties selected from $\sigma_{ty}$, $E_y$ and $G_y$ in another direction y.

67. A method according to claim 66, wherein the direction y is perpendicular to the x-direction.

68. A method according to claim 65 wherein the one or more parameters are selected from the dimensionless parameters $$\frac{a_{tx}}{a_{ty}}, \frac{E_x}{E_y} \text{and} \frac{G_x}{G_y}.$$

69. A method according to claim 39 wherein the body B or the part thereof shows mechanical properties that are not homogeneously distributed, such as properties varying continuously throughout the body, and the modelling includes modelling of then non-homogeneous distribution of said mechanical properties.

70. A method according to claim 69, wherein the modelling includes parameters describing the variation of properties that are not homogeneously distributed.

71. A method according to claim 70, wherein the parameters are dimensionless parameters relating relative values of properties to relative positions in the body B or the part thereof.

72. A method according to claim 71, wherein the properties that are not homogeneously distributed are one or several properties selected from tensile strength ($\sigma_t$), modulus of elasticity (E) and tensile fracture energy ($G_t$), and the dimensionless parameters are parameters relating corresponding relative values of properties selected from $$\frac{\sigma_{tx}}{\sigma_{tr}}, \frac{E_x}{E_r}, \frac{G_{tx}}{G_{tr}}$$

$$\frac{\sigma_{ty}}{\sigma_{tr}}, \frac{E_y}{E_r}, \frac{G_{ty}}{G_{tr}}$$

$$\frac{\sigma_{tz}}{\sigma_{tr}}, \frac{E_z}{E_r}, \frac{G_{tz}}{G_{tr}}$$

to corresponding relative positions $$\frac{x}{L}, \frac{y}{L}, \frac{z}{L},$$

index r referring to reference properties in a reference position.

73. A method according to claim 39 wherein the modelling includes parameters describing strength parameters other than unidirectional tensile strength.

74. A method according to claim 73, wherein the modelling includes parameters describing strength under uniaxial compression, $\sigma_c$ (compressive strength).

75. A method according to claim 73, wherein the modelling includes parameters describing shear strength, $\tau_0$.

76. A method according to claim 75, wherein the modelling includes parameters describing shear strength as a function of the action of stresses acting transverse to the shear.

77. A method according to claim 39 wherein the modelling includes fracture energy in shear, including fracture energy in shear.

78. A method according to claim 77, wherein the modelling includes fracture energy in shear under transverse load.

79. A method according to claim 73 wherein the modelling includes one or more dimensionless parameters describing strength ratios.

80. A method according to claim 79, wherein the modelling includes a dimensionless strength ratio $$\frac{\sigma_c}{\sigma_t}$$

between compressive strength $\sigma_c$ and tensile strength $\sigma_t$ of the body B or the part thereof.

81. A method according to claim 79, wherein the modelling includes a dimensionless strength ratio $$\frac{\tau_0}{\sigma_c}$$

between shear strength and compressive strength of the body B or the part thereof.

82. A method according to claim 79, wherein the modelling includes a dimensionless strength ratio $$\frac{\tau_0}{\sigma_t}$$

between shear strength and tensile strength of the body B or the part thereof.

83. A method according to claim 39 wherein the modelling includes modelling of shape changes of the body B or the part thereof as a result of the physical interaction, including shape changes outside fracture zones.

84. A method according to claim 43, wherein the modelling includes parameters describing similarity in conditions under loading in terms of substantially identical relationships between relative stresses ($\sigma$) and absolute strain ($\epsilon$) in the body B or the part thereof and the model body $B_{model}$.

85. A method according to claim 84, wherein the modelling is physical modelling.

86. A method according to claim 85, wherein the modelling includes the relationship $$\frac{\varepsilon_P}{\varepsilon_M} \approx 1$$

for $$\frac{\sigma_P}{\sigma_{P.0}} \approx \frac{\sigma_M}{\sigma_{M.0}}$$

wherein $\sigma_0$ is the tensile strength, and the indices P and M refer to the prototype (the body B or the part thereof) and the model body $B_{model}$ respectively.

87. A method according to claim 40 wherein the ratio between a characteristic size $L_p$ of the prototype body (the body B or the part thereof) and a characteristic size $L_m$ of the corresponding model body $B_{model}$ or, conversely, the ratio between a characteristic size $L_m$ of a model body $B_{model}$ and a characteristic size $L_p$ of the corresponding prototype body (the body B or the part thereof) tis in the range between 2 and 1000, the material (s) and/or structure (s) of the model body $B_{model}$ being correspondingly adapted so that governing parameters relating properties and sizes have substantially identical values in prototype and model.

88. A method according to claim 87, wherein the ratio between a characteristic size $L_p$ of the prototype body (the body B or the part thereof) and a characteristic size $L_m$ of the corresponding model body $B_{model}$, or, conversely, the ratio between a characteristic size $L_M$ of a model body $B_{model}$ and a characteristic size $L_P$ of the corresponding prototype body is in one of the following ranges:

2–5

5–10

10–30

30–100

100–1000, larger than 1000, the material(s) and/or structure(s) of the model body $B_{model}$ being correspondingly adapted so that governing parameters relating properties and sizes, such as $$\frac{EG}{\sigma_t^2 L},$$

have substantially identical values in prototype and model.

89. A method according to claim 40 wherein the ratio between a characteristic size $L_p$ of the prototype body (the body B or the part thereof) and a characteristic size $L_m$ of the corresponding model body $B_{model}$, or, conversely, the ratio between a characteristic size $L_m$ of a model body $B_{model}$ and a characteristic size $L_p$ of the corresponding prototype body is larger than 1000.

90. A method according to claim 40 wherein the ratio between the value of a material strength related to a prototype body and the value of the corresponding material strength related to the corresponding model body, or, conversely, the reverse ratio, is in the range of 1.5–50, the material (s) and/or structure (s) of the model body being correspondingly adapted so that governing parameters relating properties and sizes have substantially identical value in prototype and model.

91. A method according to claim 90, wherein the ratio between the value of a material strength related to a prototype body and the value of the corresponding material strength related to the corresponding model body, or, conversely, the reverse ratio, is in one of the following ranges:

1.5–2

2–5

5–10

10–50, the material(s) and/or structure(s) of the model body being correspondingly adapted so that governing parameters relating properties and sizes, such as $$\frac{EG}{\sigma_t^2 L},$$

have substantially identical value in prototype and model.

92. A method according to claim 40 wherein the ratio between the value of a material strength related to a prototype body and the value of the corresponding material strength related to the corresponding model body, or, conversely, the reverse ratio, is larger than 50, the material (s) and/or structure (s) of the model body being correspondingly adapted so that governing parameters relating properties and sizes have substantially identical value in prototype and model.

93. A method according to claim 40 wherein the ratio between the value of a modulus of elasticity related to a prototype body and the value of the corresponding modulus of elasticity related to the corresponding model body, or conversely, the reverse ratio, is in the range of 1.5–50, the material (s) and/or structure (s) of the model body being correspondingly adapted so that governing parameters relating properties and sizes have substantially identical value in prototype and model.

94. A method according to claim 93, wherein the ratio between the value of a modulus of elasticity related to a prototype body and the value of the corresponding modulus of elasticity related to the corresponding model body, or conversely, the reverse ratio, is in one of the following ranges:

1.5–2

2–5

5–10

10–50, the material(s) and/or structure(s) of the model body being correspondingly adapted so that governing parameters relating properties and sizes, such as $$\frac{EG}{\sigma_t^2 L},$$

have substantially identical value in prototype and model.

95. A method according to claim 40 wherein the ratio between the value of a modulus of elasticity related to a prototype body and the value of the corresponding modulus of elasticity related to the corresponding model body, or conversely, the reverse ratio, is larger than 50, the material (s) and/or structure (s) of the model body being correspondingly adapted, so that governing parameters relating properties and sizes have substantially identical value in prototype and model.

96. A method according to claim 40 wherein the ratio between the value of a density p related to a prototype body and the value of the corresponding density related to the corresponding model body, or conversely, the reverse ratio, is in one of the following ranges:

1.5–2

2–5

5–10

10–50 larger than 50 the material (s) and/or structure (s) of the model body being correspondingly adapted so that governing parameters relating properties and sizes have substantially identical value in prototype and model.

97. A method according claim 96, wherein the ratio between the value of a density p related to a prototype body and the value of the corresponding density related to the corresponding model body, or conversely, the reverse ratio, is in one of the following ranges:

1.5–2

2–5

5–10

10–50, the material (s) and/or structure (s) of the model body being correspondingly adapted so that governing parameters relating properties and sizes have substantially identical value in proptotype and model.

* * * * *

UNITED STATES PATENT AND TRADEMARK OFFICE

CERTIFICATE OF CORRECTION

PATENT NO. : 6,651,011 B1
DATED : November 18, 2003
INVENTOR(S) : Hans Henrik Bache It is certified that error appears in the above-identified patent and that said Letters Patent is hereby corrected as shown below:

Column 86,
Line 54, "($\sigma_b$)" has been replaced with -- ($\sigma_a$) --

Column 91,
Line 49, "(or the part therof;" has been replaced with -- (or the part thereof), --

Signed and Sealed this

Thirteenth Day of April, 2004

JON W. DUDAS
*Acting Director of the United States Patent and Trademark Office*